US008509668B2

(12) United States Patent
Takemura

(10) Patent No.: US 8,509,668 B2
(45) Date of Patent: Aug. 13, 2013

(54) FIXING DEVICE

(75) Inventor: Taichi Takemura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 145 days.

(21) Appl. No.: 13/271,719

(22) Filed: Oct. 12, 2011

(65) Prior Publication Data

US 2012/0093550 A1 Apr. 19, 2012

(30) Foreign Application Priority Data

Oct. 14, 2010 (JP) ..... 2010-231076

(51) Int. Cl.
*G03G 15/20* (2006.01)

(52) U.S. Cl.
USPC ..... 399/329; 399/328

(58) Field of Classification Search
USPC ..... 399/328–331
See application file for complete search history.

(56) References Cited

U.S. PATENT DOCUMENTS

| | | | | |
|---|---|---|---|---|
| 6,505,027 | B2 * | 1/2003 | Takeuchi et al. | 399/328 |
| 7,260,353 | B2 | 8/2007 | Takemura | |
| 8,385,801 | B2 * | 2/2013 | Sugaya | 399/329 |

FOREIGN PATENT DOCUMENTS

| | | | |
|---|---|---|---|
| JP | 2002-148983 | A | 5/2002 |
| JP | 2004-184517 | A | 7/2004 |
| JP | 2006-091501 | A | 4/2006 |

* cited by examiner

*Primary Examiner* — Hoang Ngo
(74) *Attorney, Agent, or Firm* — Fitzpatrick, Cella, Harper & Scinto

(57) ABSTRACT

A fixing device includes a belt heating a toner image on recording material, a member slidable on the belt inner surface, a pressor pressing the belt against the member to form a recording material nip, and a projection and recess provided on a nip forming surface of the member. When pressure applied when a toner temperature of the toner image reaches a softening temperature T1 (° C.) is P1 (kgf/cm$^2$), pressure applied when the toner temperature reaches an incipient fluidization temperature T2 (° C.) is P2 (kgf/cm$^2$), the toner temperature when P(t)/η(t) wherein η(t)is a toner melt viscosity (Pa·s) and P(t) is a pressure (kgf/cm$^2$) applied with the toner melt viscosity η(t) is maximum is T3 (° C.), and pressure applied when the toner temperature reaches T3 (° C.) is P3 (kgf/cm$^2$), the following relationships are satisfied:

$$0.3<P1/(P1+P2+P3), \quad 1)$$

$$0.3<P2/(P1+P2+P3), \text{ and} \quad 2)$$

$$0.2<P3/(P1+P2+P3)<0.3. \quad 3)$$

3 Claims, 24 Drawing Sheets

$L[\mu m]$ $$V_{\bigcirc} = \frac{4}{3}\pi\left(\frac{L}{2}\right)^3 [\mu m^3]$$

$$S_{\bigcirc} = \pi\left(\frac{L}{2}\right)^2 [\mu m^2]$$

$$S_p = \frac{\sqrt{3}}{2} L^2 [\mu m^2]$$

$$H = \frac{V_{\bigcirc}}{S_p} = \frac{4}{3}\pi\left(\frac{L}{2}\right)^3 \cdot \frac{2}{\sqrt{3}L^2} = \frac{\pi L}{3\sqrt{3}} [\mu m]$$

$$T = \left(1 - \frac{S_{\bigcirc}}{S_p}\right) \times 100 = \left(1 - \pi\left(\frac{L}{2}\right)^2 \cdot \frac{2}{\sqrt{3}L^2}\right) \times 100 \fallingdotseq 9.31 [\%]$$

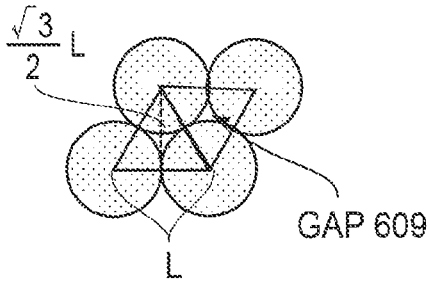

FIG.11

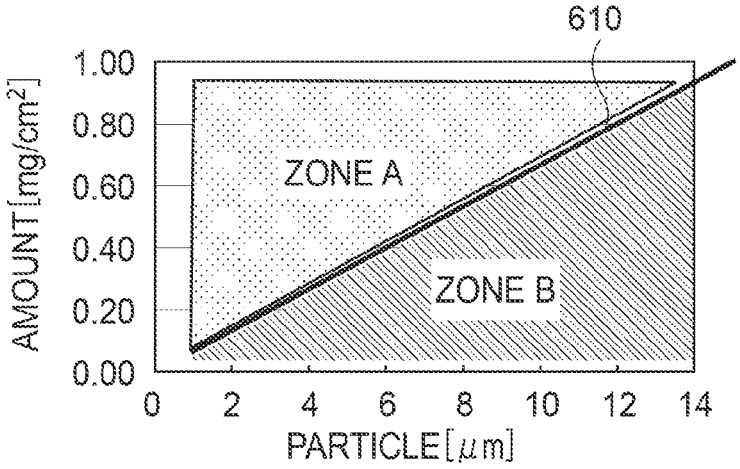

FIG.12

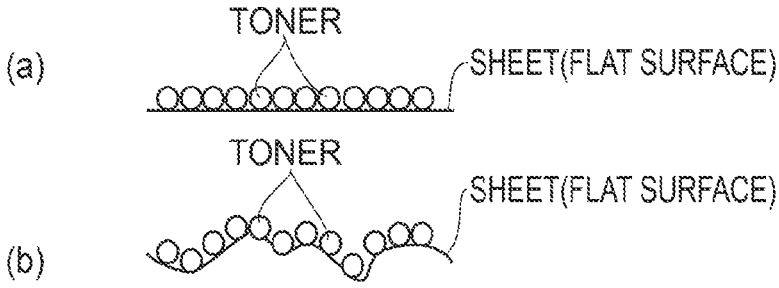

FIG.13

FIXING DEVICE

FIELD OF THE INVENTION AND RELATED ART

The present invention relates to a fixing device for fixing an unfixed toner image, by heat-pressing the toner image, formed on a recording material through an image forming process, such as an electrophotographic process, an electrostatic recording process or a magnetic recording process, of a transfer type or a direct type.

An image forming apparatus using the electrophotographic process or the like to obtain a hard copy, such as a copying machine, a facsimile machine or a printer is currently used in various fields with development of its technology and enlargement of market demand. Particularly, in recent years, demands for environmental response and cost reduction are increased, so that a toner consumption reducing technique has become very important. This technique is important also from the viewpoint of reduction in energy generated in a process in which the toner is fixed on the recording material. Particularly, in the image forming apparatus of the electrophotographic type for office use, the technique plays an important part also from a demand for energy saving.

On the other hand, by development of digitalization and colorization, the image forming apparatus of the electrophotographic type is started to be applied to a part of a print field, so that commercialization of the image forming apparatus is started to become conspicuous in the fields of graphic arts and short-run printing such as print on-demand (POD).

In the case where the entry of the image forming apparatus into the POD market is taken into consideration, the electrophotographic type has a feature of an on-demand property as digital to press but involves many problems such as a color reproduction region, texture, image stability and media compatibility, in order to appeal market value as an output product. While addressing these problems, also from the viewpoint that awareness of the above-described cost reduction is raised and that a cost per sheet of the output product is suppressed at a low level, the toner consumption reducing technique becomes important.

Incidentally, in the copying machine or the like using the electrophotographic process, there is a need to fix the unfixed toner image formed on the recording material (recording medium or image supporting member to obtain a fixed image. As a fixing method therefor, a solvent fixing method, a pressure fixing method, a heat-fixing method and the like have been known. Of these methods, from the viewpoint of a fixing performance, the heat-fixing method is currently used widely.

As the heat-fixing method, there has been conventionally known a heating roller method in which a certain pressure is applied between a pair of rollers (heating roller and pressing roller) at least one of which is heated and the recording material carrying thereon the unfixed toner image is passed between the pair of rollers to effect fixing. This method is simple in constitution or the like and is a most widely used fixing method.

On the other hand, when the entry into the POD market is taken in consideration, there is a need to address speed-up. In the case where the unfixed toner image is fixed at a higher speed, there is a need to apply sufficient thermal energy and pressure to the unfixed toner image and the recording material. In order to transmit a sufficient heat quantity, the pair of rollers can be increased in diameter or a temperature of a fixing roller can be increased but there are many increasing disadvantages such that the image forming apparatus is increased in size and that necessary electric power is increased. Further, it can also be considered that a pressure is increased but an increase in fixing nip width, between the pair of rollers, with the pressure is not large and therefore so much effect cannot be expected.

In view of this, a fixing device of a belt nip type in which an endless belt is used to increase the fixing nip as described in Japanese Laid-Open Patent Application (JP-A) 2006-091501 has been proposed. The belt nip type in which a heat-fixing roller rotatably supported and a pressing belt capable of endless movement are press-contacted and the recording material is sent belt these roller and belt to fix the unfixed toner image is being known.

Further, as described above, particularly in the image forming apparatus using the electrophotographic type for office use, from the viewpoint of energy saving, the fixing method which is called a film fixing method has been frequently used separately from the fixing device of the heating roller type or the belt nip type.

In the film fixing type, as described in JP-A 2006-091501 and JP-A 2004-184517, the nip is formed by sandwiching a heat-resistant film (fixing film) between a ceramic heater as a heating member and the pressing roller as a pressing member. Then, the recording material on which the unfixed toner image is formed and carried is introduced into the nip between the film and the pressing roller and is nip-conveyed together with the film. As a result, the heat of the heater is applied to the recording material via the film in the nip, so that the unfixed toner image is heat-fixed on the recording material surface by the pressure in the nip.

Further, as described in JP-A 2002-148983, a heating device of an electromagnetic induction heating type in which eddy current is generated in the film itself or an electroconductive member brought near to the film to generate heat by Joule heat has also been proposed.

In such a film heating type or electromagnetic induction heating type, as the fixing member, a thin member of a heat-resistant resin material or the like is used. For that reason, compared with the heating roller type, thermal capacity is remarkably small, so that warm-up can be performed in a shorter time than that in the heating roller type and thereof the film heating type or the electromagnetic induction heating type is excellent in on-demand property.

Recently, the energy saving is advanced in the fixing method, so that further energy saving or the toner consumption reduction as a means for reducing a total cost has been accelerated. At the same time, a demand that an image quality to date is not lowered is also increasing. That is, as described above, the demand is such that in the fixing method using the film heat-fixing type or the electromagnetic induction heat-fixing type, a high-quality image obtained through the heating roller type or the belt nip fixing type is outputted with low toner consumption.

However, a new problem arises in that the unfixed toner image with a small toner amount is fixed by using the conventionally proposed heat-fixing method to output the high-quality image with the low toner consumption. In the case where the present inventor form the unfixed toner image with a toner amount smaller than that in the conventional manner and fixes the unfixed toner image as a full-color image by using the conventionally used fixing method, the following problem arises. That is, an image quality of a single color and an image quality of secondary color or multi-order color cannot be maintained simultaneously.

This is because the conventional fixing method is constituted on the assumption that the toner amount is large, i.e., that the toner image is formed in multiple layers on the recording material. That is, in the fixing nip, a pressure distribution is constituted so that a fixing pressure is larger at a more downstream side to press the toner on the recording material in a sufficiently melted state, thus obtaining a good fixing state. However, it has been found that the thus-constituted inner nip pressure distribution is not suitable for the case of a small toner.

The above phenomenon will be described with reference to schematic views. As shown in FIG. 35, in the case where each of a single color toner image and a secondary color toner image is formed in multiple layers on the recording material in a conventional state of a large toner amount, even when a high pressure is applied to a nip downstream side where the toner is sufficiently melted, it was possible to obtain a good fixing state both for the single color and the secondary color.

On the other hand, in the case where in a state of a small toner amount for the purpose of the toner consumption reduction, the single color toner image is formed in a single layer or in a state close to the single layer state or the secondary or multi-order toner image is formed in multiple layers, the following phenomenon occurs. That is, in the above-described fixing pressure distribution such that the high pressure is applied at the nip downstream side, the high pressure is applied to the toner melted at the nip downstream side and therefore in the case where the toner image of the secondary color, the multi-order color or the like is formed in multiple layers, the above fixing pressure distribution is very effective.

However, in the case where the toner image of the single color is formed in the single layer, the toner is excessively melted. As a result, such a phenomenon, that the toner is dropped from fibers of the recording material surface to expose a texture of paper, which is called a "see-thru" phenomenon, or such a phenomenon that a surface property of the toner image is impaired is caused to occur. Further, as shown in FIG. 37, in the case where a temperature or a pressure in the nip is controlled to the extent that the single color toner image causes no "see-thru" phenomenon, the secondary or multi-order toner image is placed in an insufficient fixing state, so that a phenomenon that chroma is lowered occurs.

After this, when the toner amount is decreased and used to form the toner image in the single layer or in the state close to the single layer state, there is a need to create a good toner melting state with respect to both of the toner image formed in the single layer and the toner image formed in the multiple layer. For this reason, proposal of a new fixing method in which a function of obtaining the toner melting state is extracted and the extracted function is fulfilled becomes very important.

SUMMARY OF THE INVENTION

The present invention is accomplished in view of the above circumferences.

A principal object of the present invention is to provide a fixing device capable of obtaining a good fixing state even in the case where an amount of a toner in layer is small.

According to an aspect of the present invention is to provide a fixing device comprising:

a belt for heating a toner image on a recording material;

a back-up member slidable on an inner surface of the belt;

a pressing member for pressing the belt against the back-up member to form a nip in which the recording material is to be nip-conveyed; and a projection-recess portion, provided on a nip-forming surface of the back-up member, including a projection and a recess with respect to a recording material conveyance direction in the nip, wherein when a pressure applied when a toner temperature of the toner image reaches a softening temperature T1 (° C.) is P1 (kgf/cm$^2$), a pressure applied when the toner temperature reaches an incipient fluidization temperature T2 (° C.) is P2 (kgf/cm$^2$), the toner temperature when P(t)/η(t) wherein η(t) is a toner melt viscosity (Pa·s) and P(t) is a pressure (kgf/cm$^2$) applied with the toner melt viscosity η(t) is maximum is T3 (° C.), and a pressure applied when the toner temperature reaches T3 (° C.) is P3 (kgf/cm$^2$), the following relationships 1), 2) and 3) are satisfied:

$$0.3<P1/(P1+P2+P3), \quad 1)$$

$$0.3<P2/(P1+P2+P3), \text{ and} \quad 2)$$

$$0.2<P3/(P1+P2+P3)<0.3. \quad 3)$$

These and other objects, features and advantages of the present invention will become more apparent upon a consideration of the following description of the preferred embodiments of the present invention taken in conjunction with the accompanying drawings.

Figure 3A:
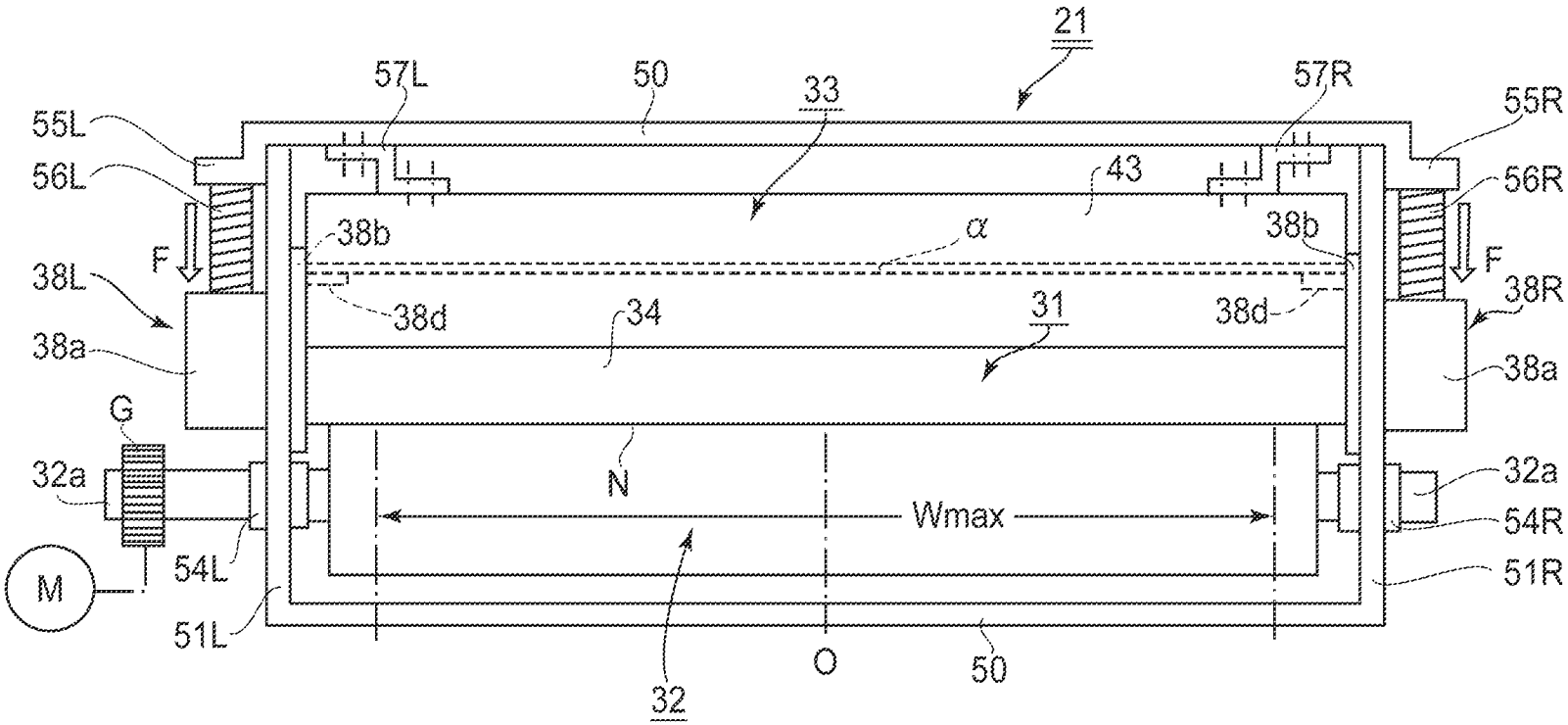
FIG. 3A is a schematic front view of the fixing device.
Figure 3B:
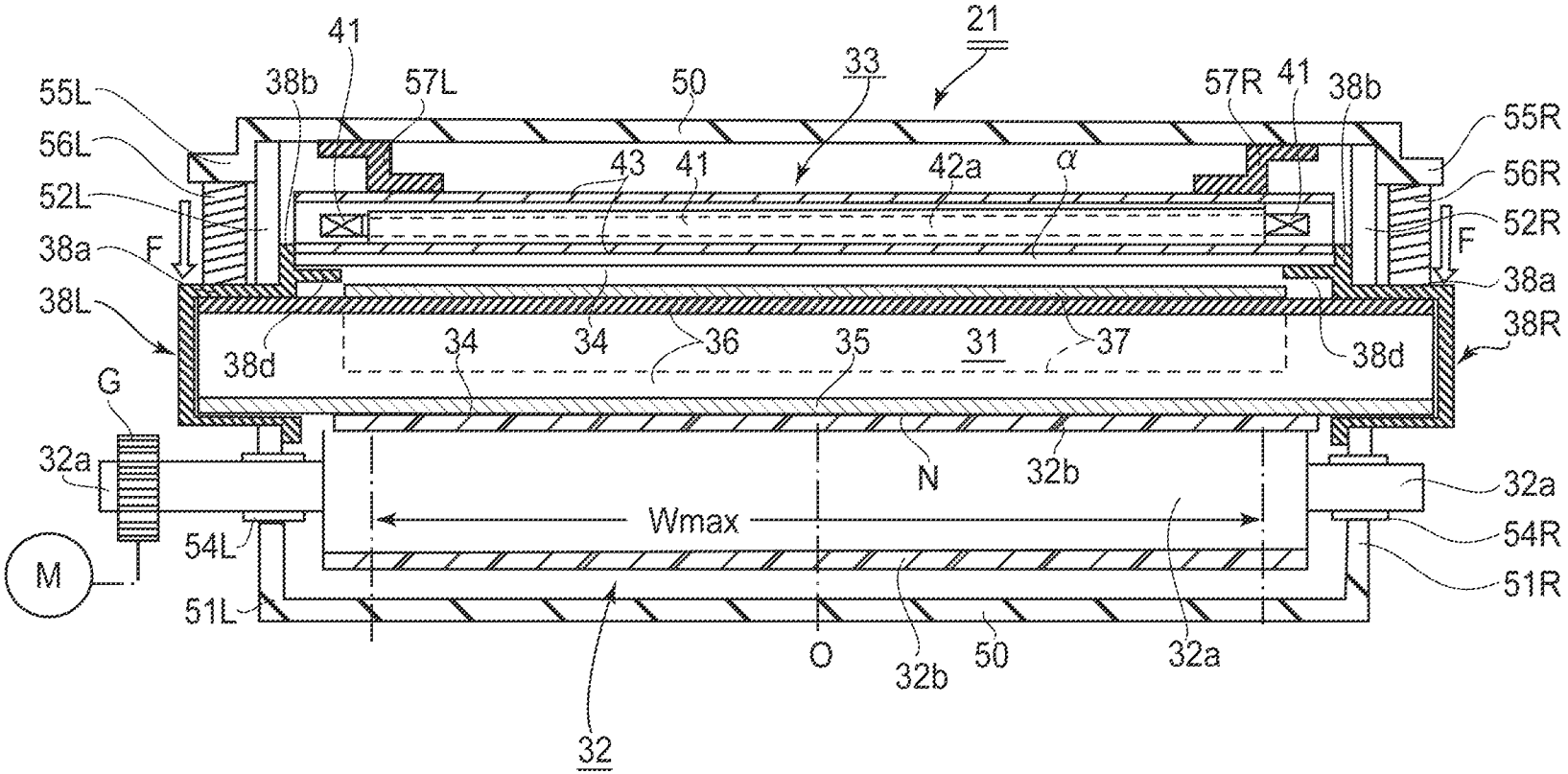
FIG. 3B is a schematic longitudinal front view of the fixing device.
Figure 4:
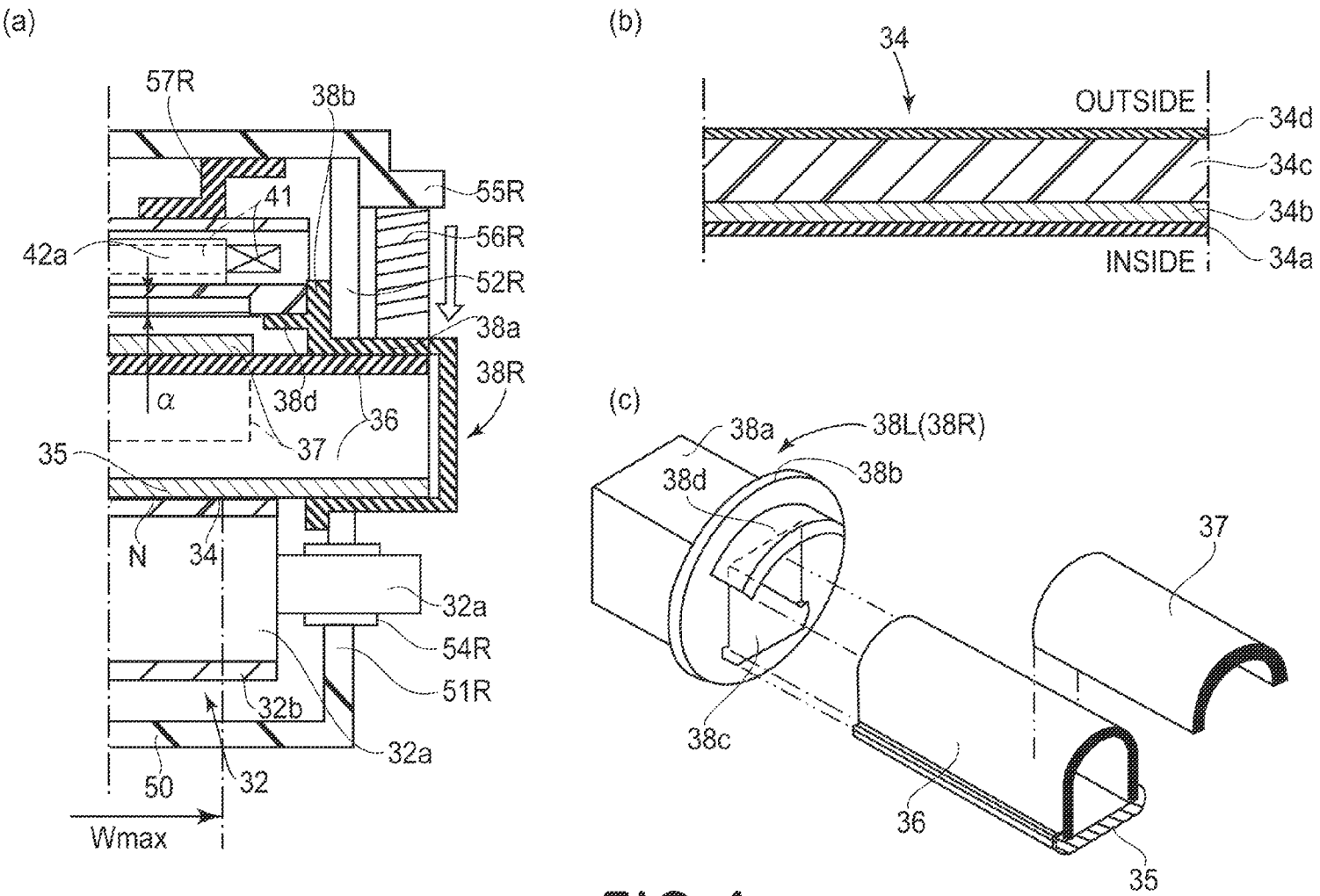

Part (a) of FIG. 4 is a partly enlarged view of FIG. 3B, (b) of FIG. 4 is a schematic layer-structural view of a fixing belt, and (c) of FIG. 4 is a partly exploded perspective view of a fixing pad, a stay, a core and a cap member.

Figure 5:
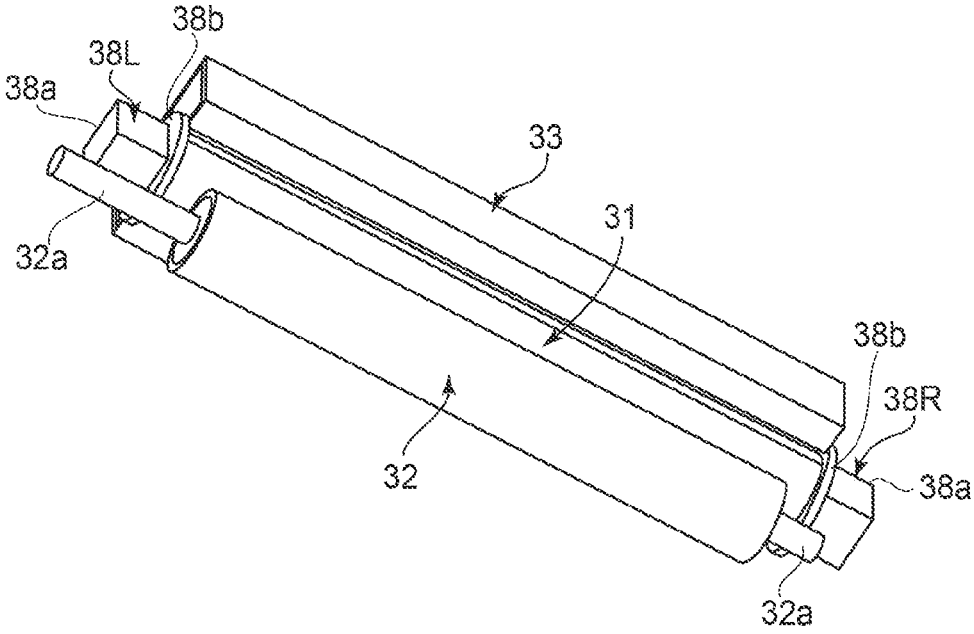

FIG. 5 is a perspective view of an outer appearance of a fixing belt unit, a pressing roller and an exciting coil unit as seen from a pressing roller side.

Figure 6:
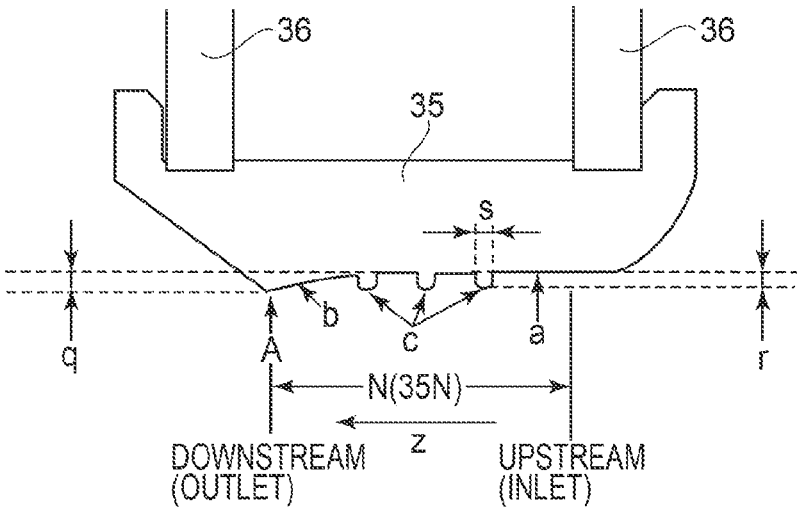

FIG. 6 is an illustration of a structure of the fixing pad.

Figure 7:
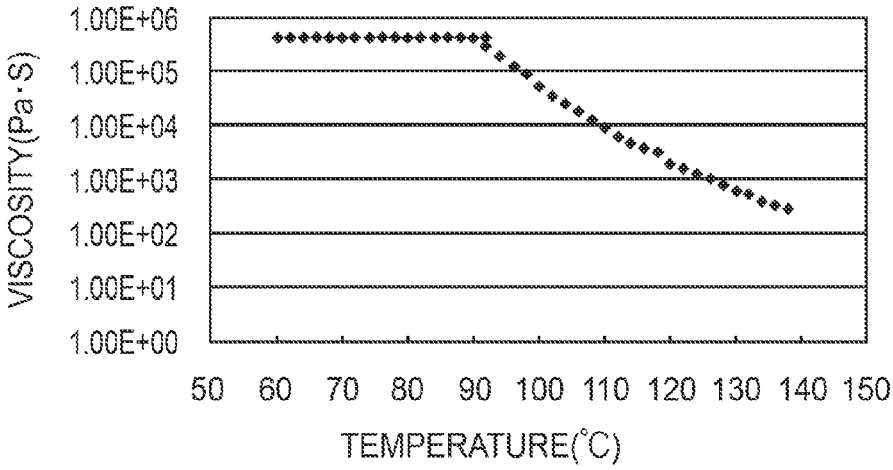

FIG. 7 is a graph of a melt viscosity characteristic of a toner used in Embodiment 1.

Figure 8:
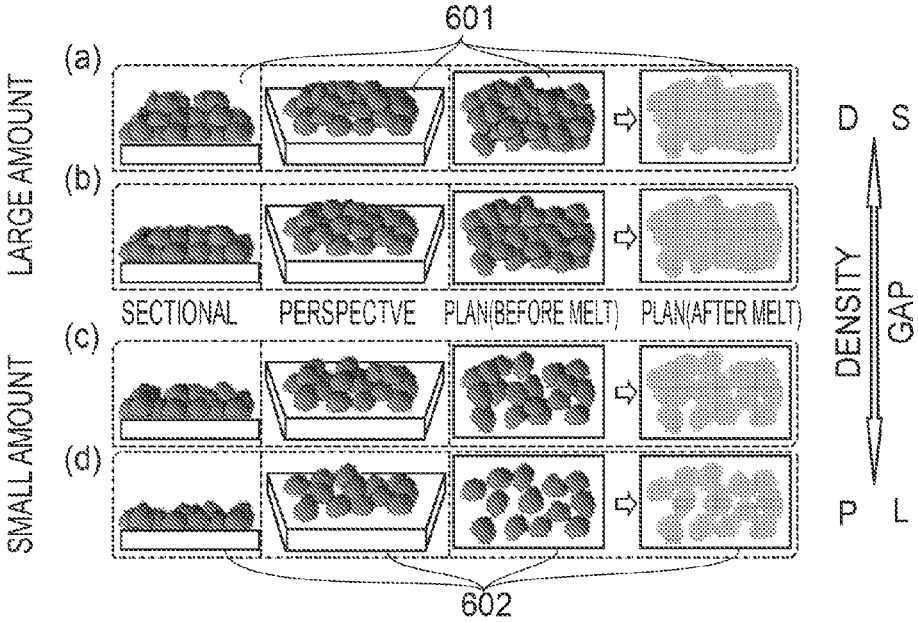

FIG. 8 is a schematic view for illustrating a toner amount and a covered state of a recording material (paper).

Figure 9:
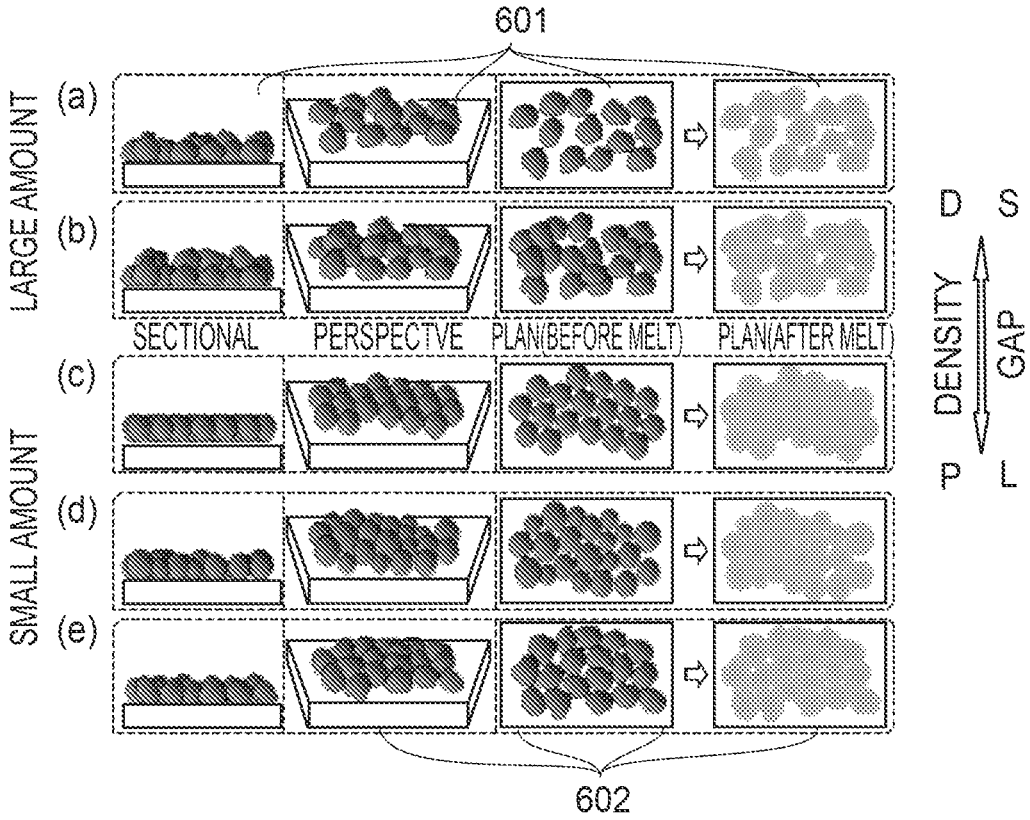

FIG. 9 is a schematic view showing toner layer formation states when the toner amount is small (when there is a clearance) and when toner particles are arranged in a single layer with no clearance.

Figure 10:
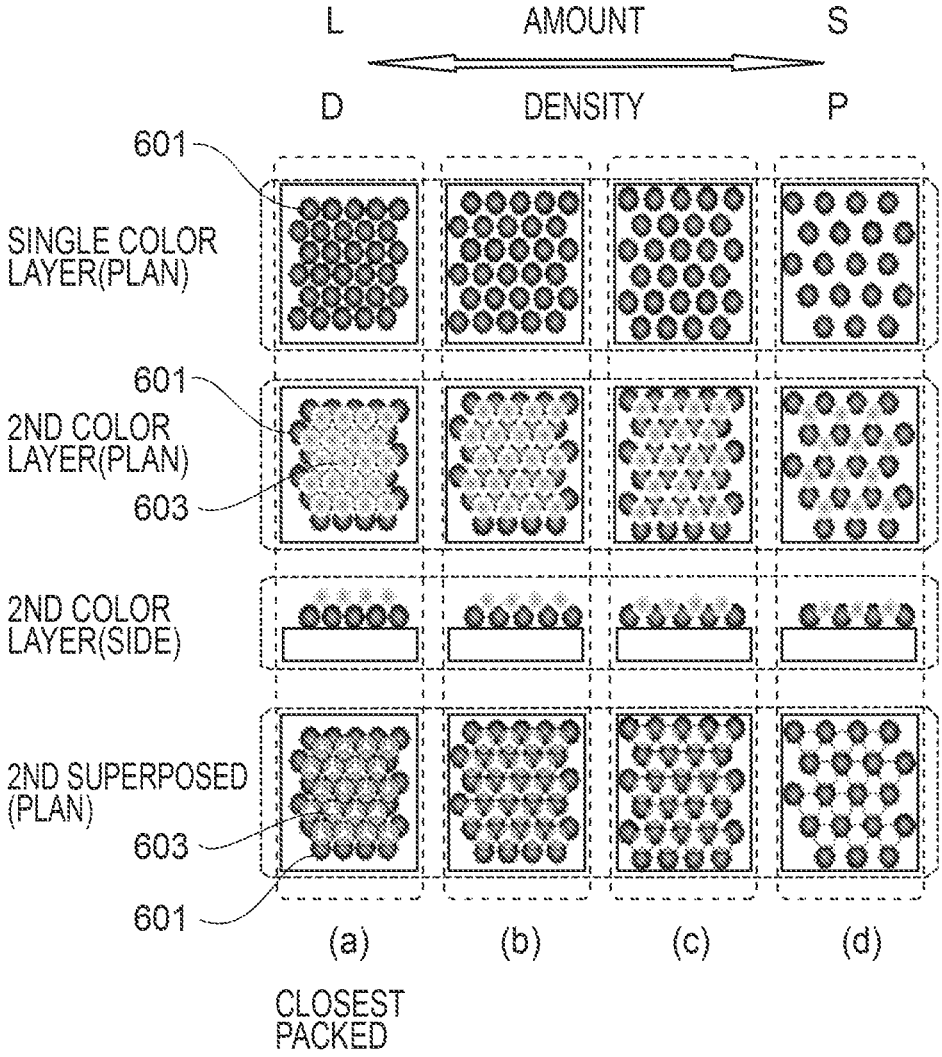

FIG. 10 is a schematic view for illustrating toner layer formation states with respect to toner amounts of spherical toner particles having the same volume.

FIG. 11 is a schematic view for illustrating various parameters in an ideal arrangement state.

FIG. 12 is a graph for illustrating relationship between a particle size of the toner and a toner amount per unit area.

Parts (a) and (b) of FIG. 13 are schematic views showing toner arrangement states on recording materials different in surface property.

Figure 14:
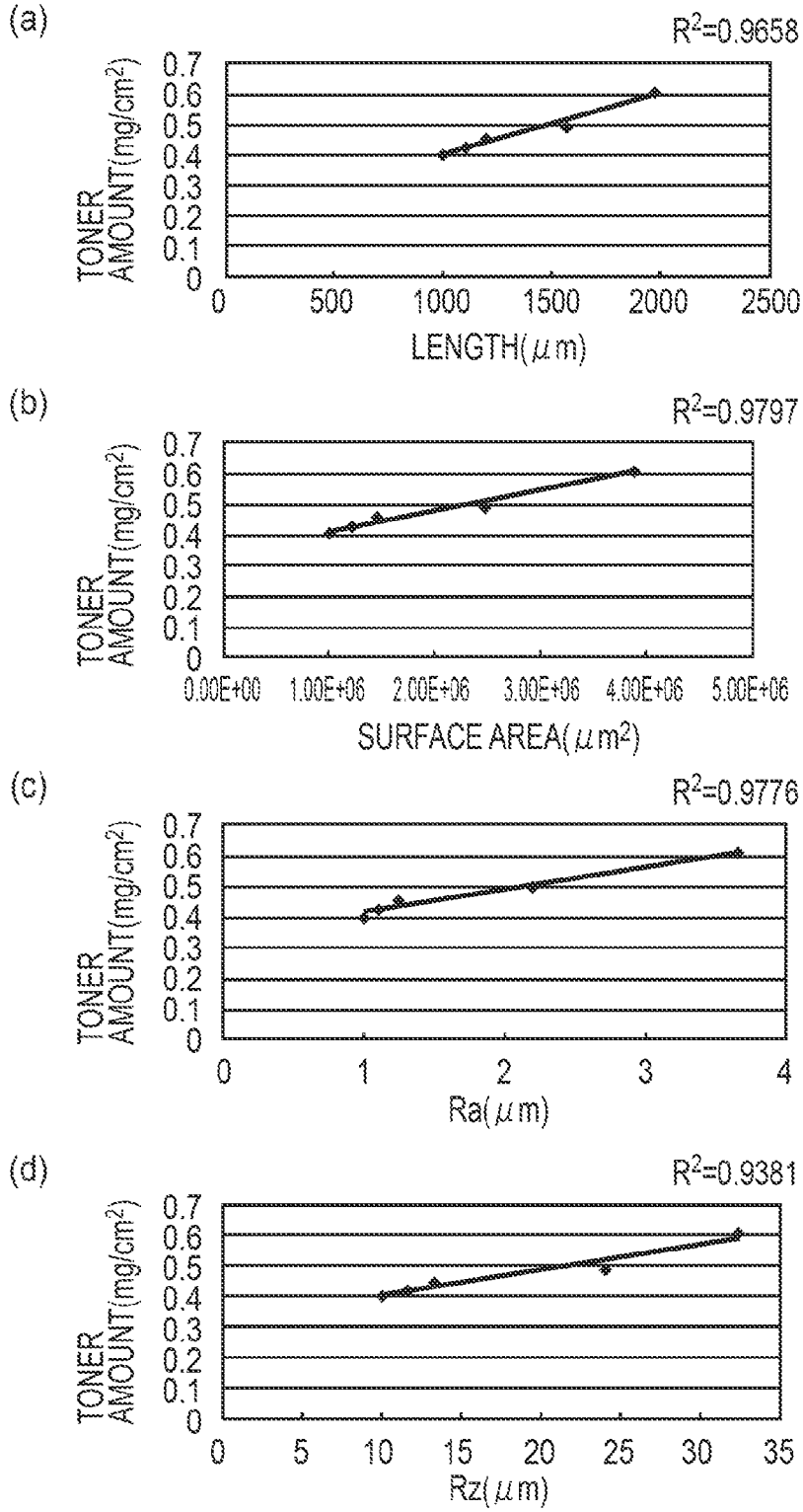

Parts (a) to (d) of FIG. 14 are graphs each showing a relationship between a recording material surface property and the toner amount of a solid single color toner image.

Figure 15:
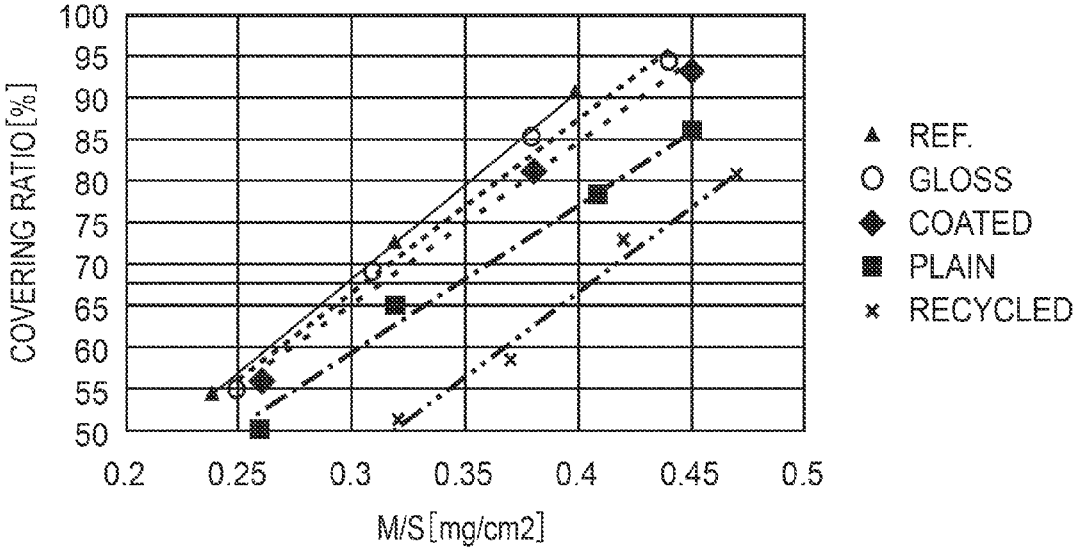

FIG. 15 is a graph showing a relationship between an unfixed toner amount and a recording material covering ratio.

Figure 16:
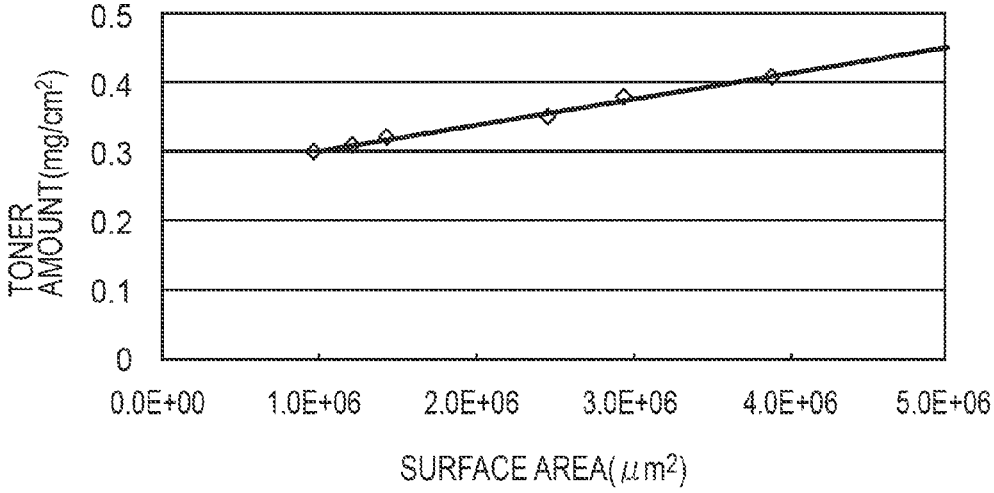

FIG. 16 is a graph showing a relationship between a surface area of the recording material and the toner amount of the solid single color toner image.

Figure 17:
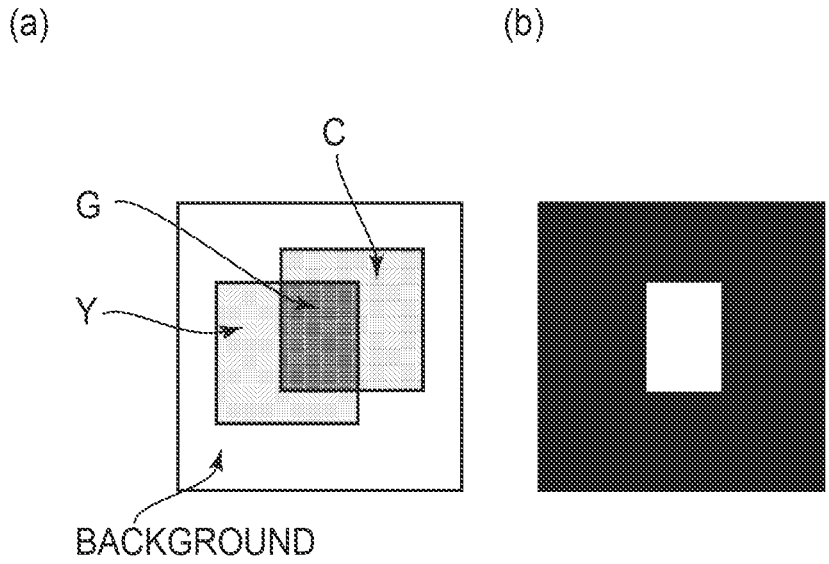

Parts (a) and (b) of FIG. 17 are schematic views for illustrating binary image processing of an obtained image.

Figure 18:
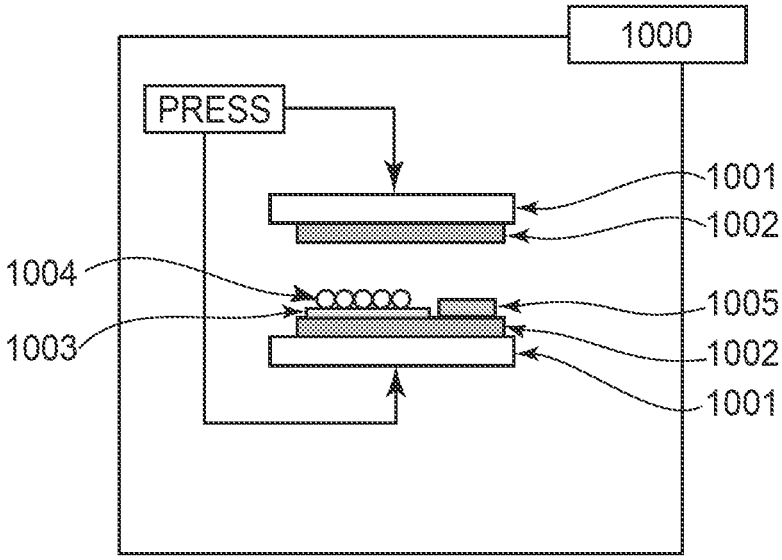

FIG. 18 is a schematic view of a pressing structure using a metal plate.

Figure 19:
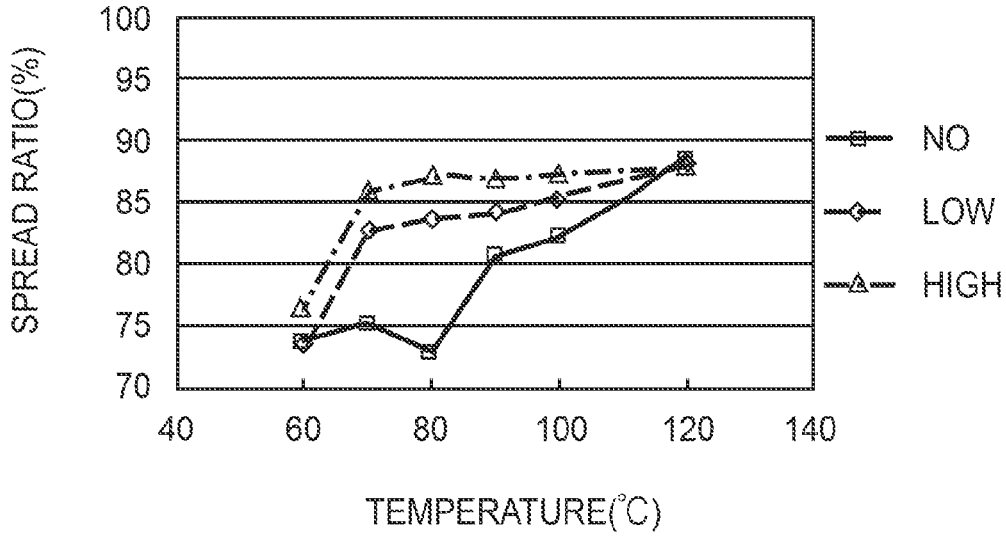

FIG. 19 is a graph showing a relationship between a toner temperature and a spread amount of the single color toner.

Figure 20:
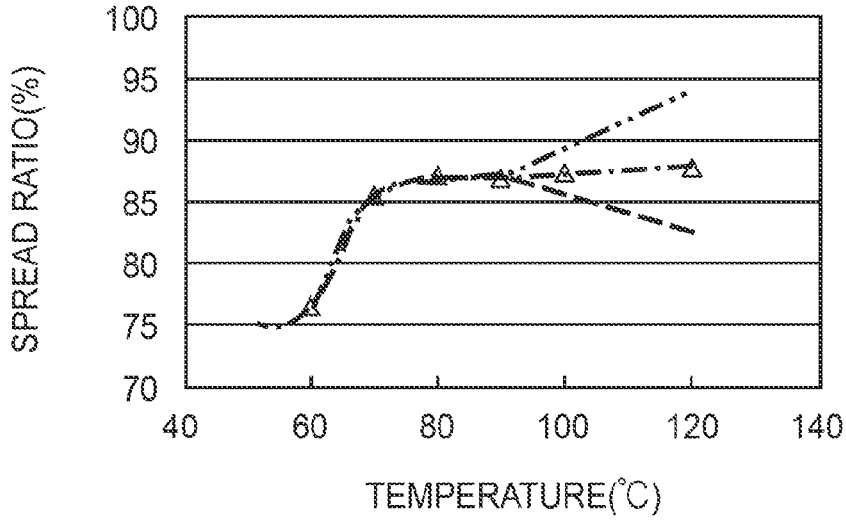

FIG. 20 is a graph showing a relationship between the single color toner spread amount and a see-thin amount.

Figure 21:
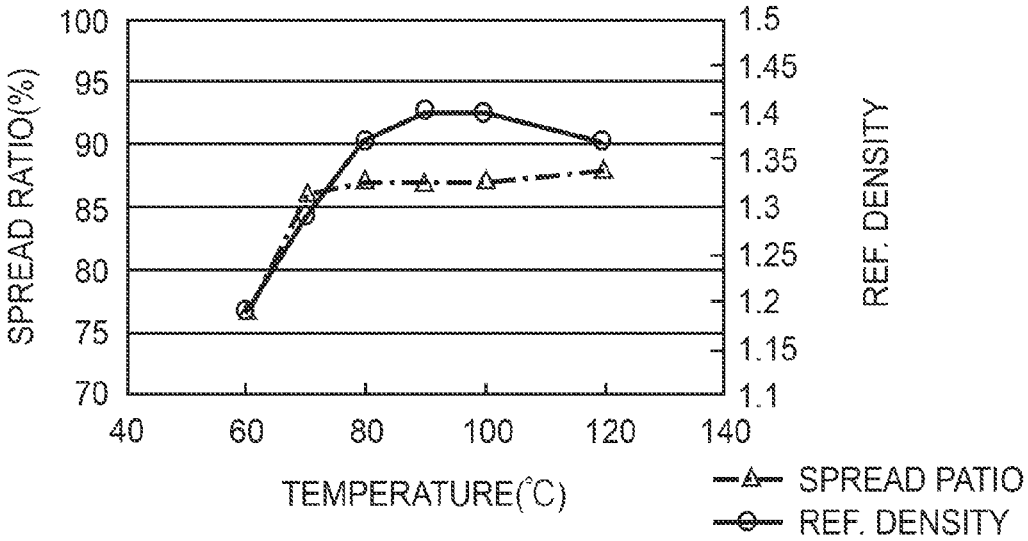

FIG. 21 is a graph showing a relationship between the single color toner spread amount and a reflection density.

Figure 22:
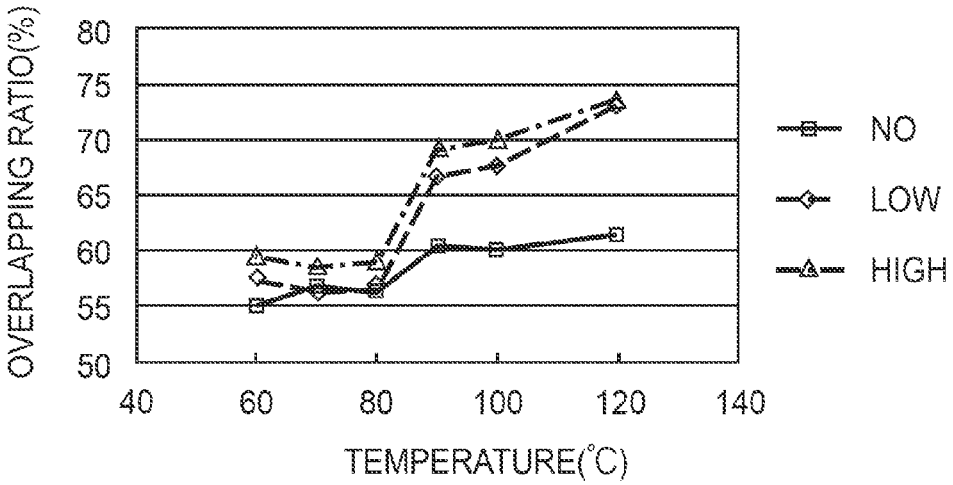

FIG. 22 is a graph showing a relationship between the toner temperature and a secondary color toner overlapping ratio.

Figure 23:
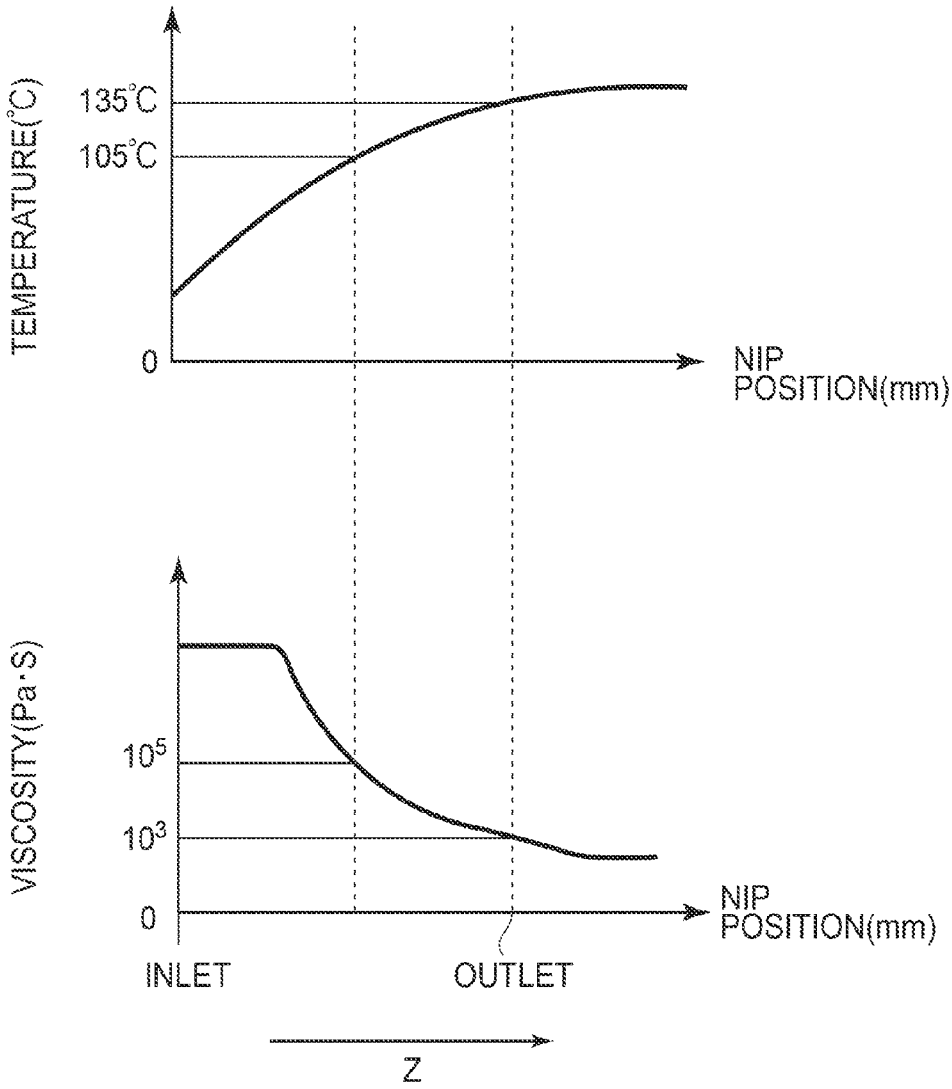

FIG. 23 is a schematic view showing a temperature charge and a toner melt viscosity characteristic in a fixing nip.

Figure 24:
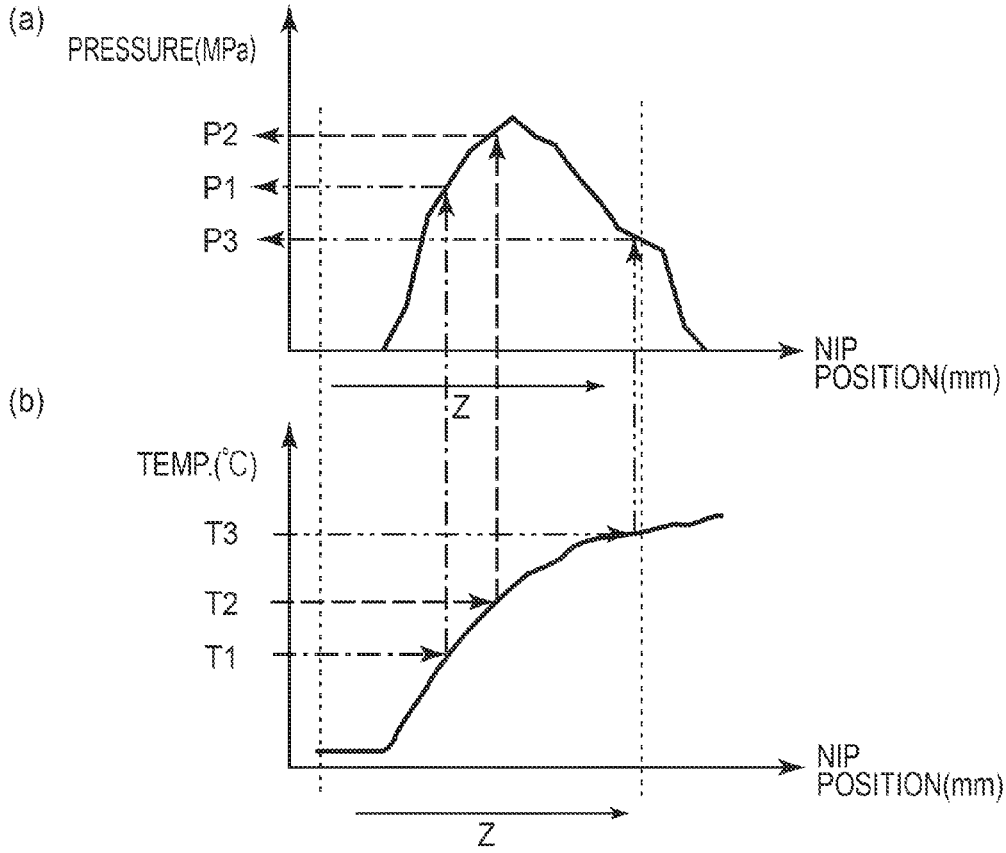

Parts (a) and (b) of FIG. 24 are schematic views for illustrating a method of calculating pressures P1, P2 and P3.

Figure 25:
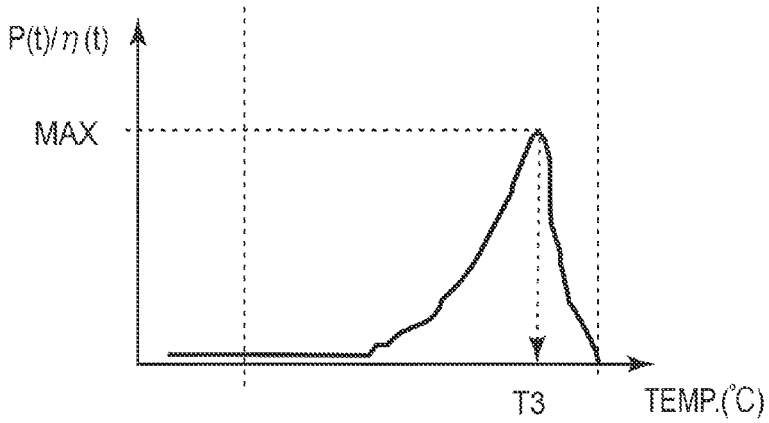

FIG. 25 is a graph for illustrating a method of calculating the pressure P3.

FIGS. 26 to 32 are graphs each showing an example of a pressure distribution in the fixing nip in Embodiment 1.

Figure 33:
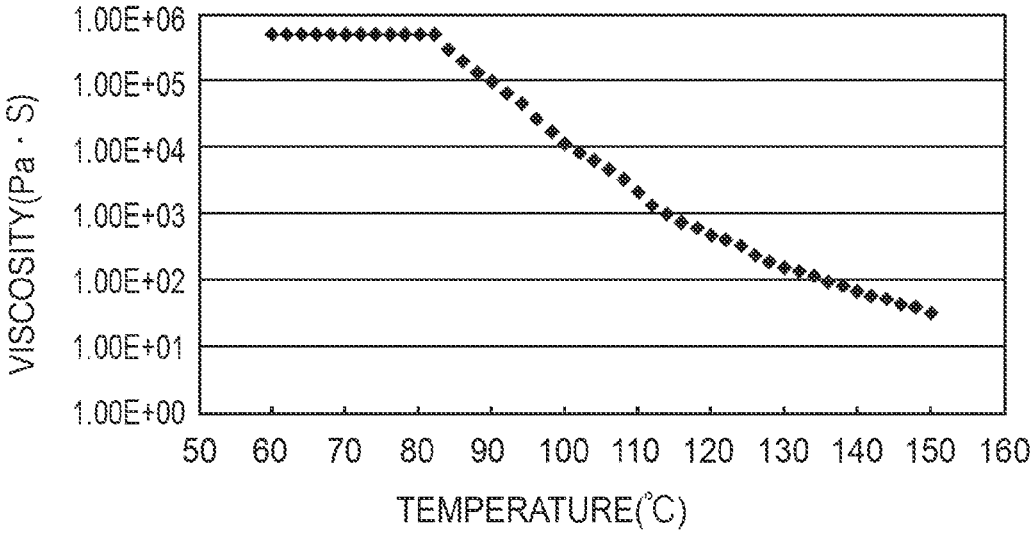

FIG. 33 is a graph showing a melt viscosity characteristic of a toner used in Embodiments 2 and 3.

Figure 34:
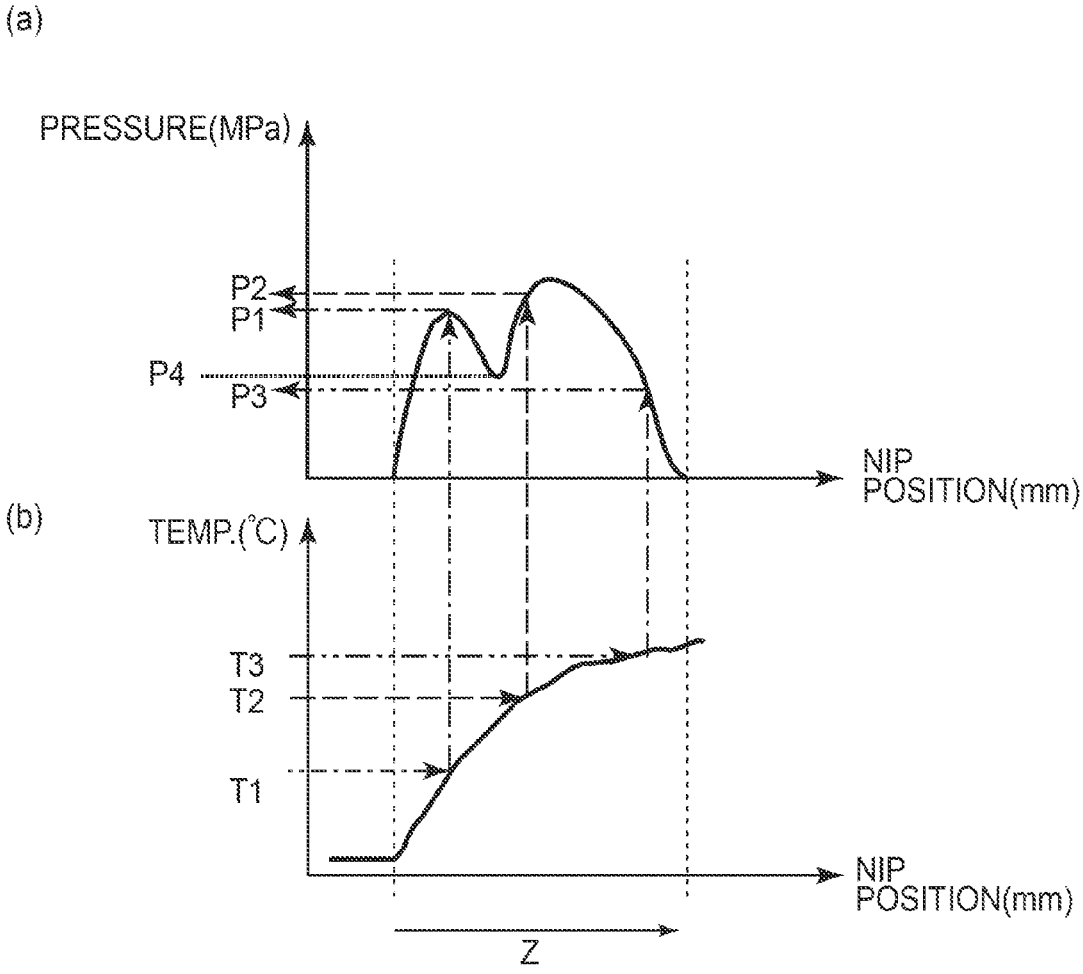

Parts (a) and (b) of FIG. 34 are schematic views for illustrating a method of calculating a pressure P4 in Embodiment 3.

Figure 35:
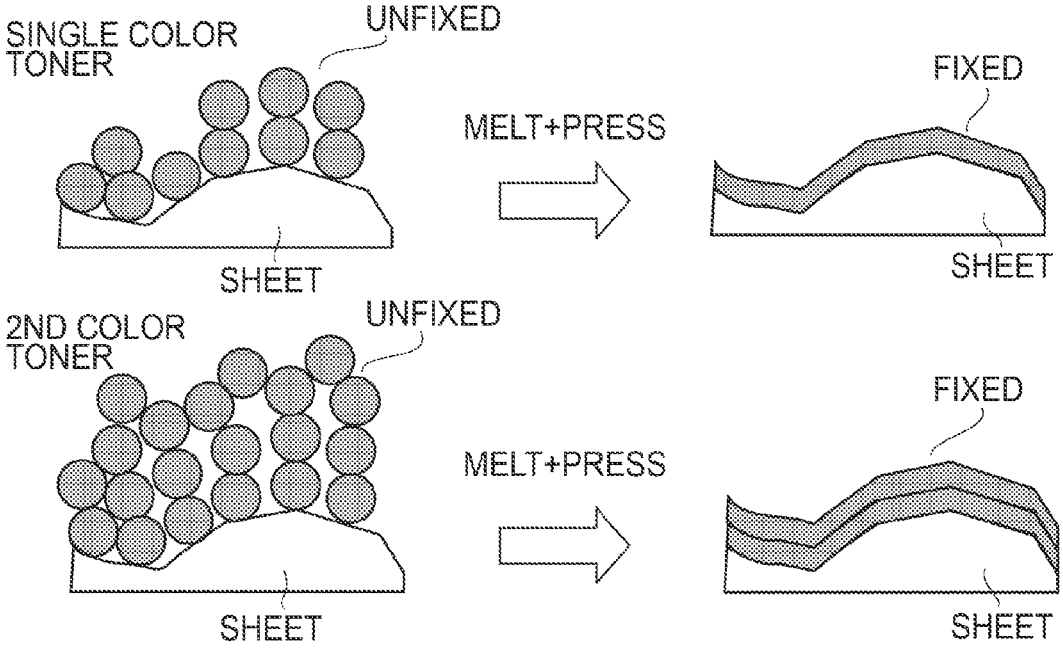
Figure 36:
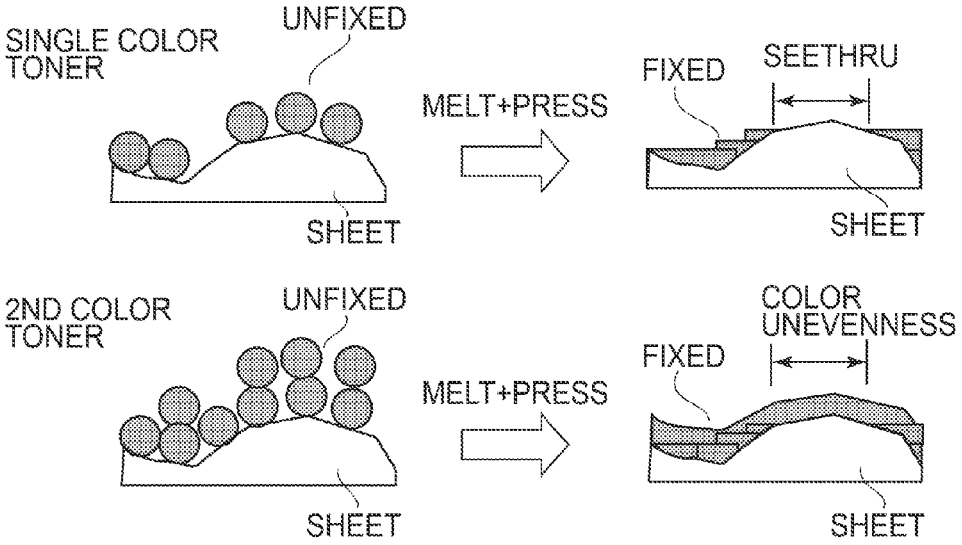
Figure 37:
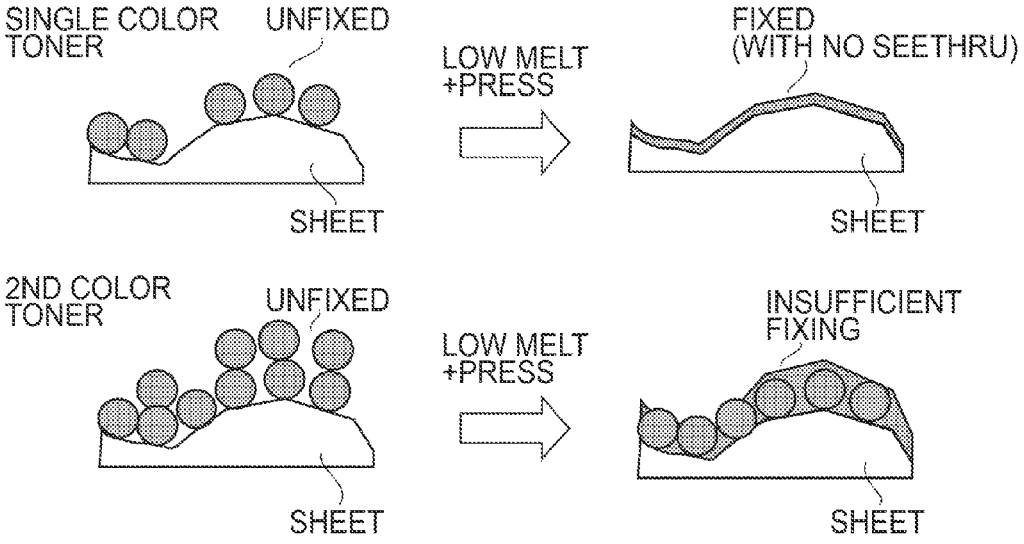

FIGS. 35, 36 and 37 are schematic views each showing a toner melting state on a recording material.

DESCRIPTION OF THE PREFERRED EMBODIMENTS

The present invention will be described in detail based on the following embodiments with reference to the drawings. However, dimensions, materials, shapes, relative positions and the like of constituent elements (parts) described in the following embodiments may appropriately be modified depending on a constitution of an image forming apparatus to which the present invention is applied or depending on various conditions. Therefore, the scope of the present invention is not limited to those unless otherwise specified.

[Embodiment 1]

<Image Forming Apparatus>

Figure 1:
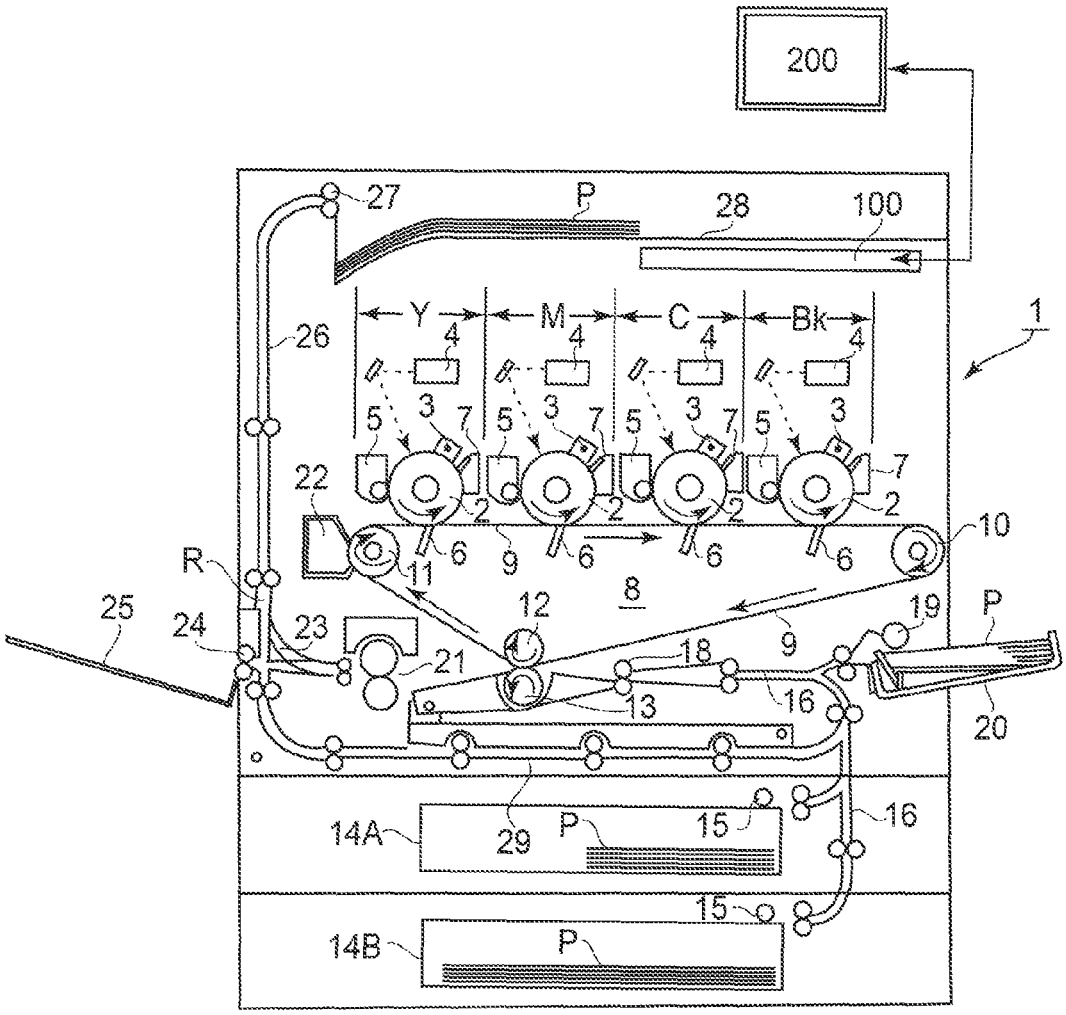
FIG. 1 is a schematic longitudinal sectional view showing a structure of an image forming apparatus in Embodiment 1.

FIG. 1 is a schematic longitudinal view showing a general structure of an electrophotographic color printer 1 as an example of an image forming apparatus in which a fixing device 21 according to the present invention is mounted.

This printer 1 performs an image forming operation depending on image information inputted from a device 200 communicatably connected with a control circuit portion (control board: CPU) 100, thus being capable of forming a full-color image on a sheet-like recording material P and then outputting the full-color image as a hard copy.

The device 200 is a computer, an image reader, a facsimile machine or the like. The control circuit portion 100 as the control portion sends signals to and receives signals from the external host device 200. Further, the control circuit portion 100 sends signals to and receives signals from various devices for image formation on the printer side to manage image forming sequence control.

On the recording material P, a toner image is to be formed. As the recording material, it is possible to use plain paper, a resin material sheet-like product, thick paper, an OHT sheet (sheet for an overhead projector), envelope, post card, label, and the like.

In the printer, first to fourth image forming portions Y, M, C and Bk are disposed side by side from left to right in FIG. 1 with respect to a horizontal direction. Each of the image forming stations is an electrophotographic process mechanism of a laser exposure type and has the same constitution except that the color of a developer (toner) accommodated in a developing device. That is, each of the image forming portions Y, M, C and Bk includes a drum-type electrophotographic photosensitive member (image bearing member, hereinafter referred to as a drum) 2 rotationally driven in a counterclockwise direction indicated by an arrow at a predetermined speed. Around each drum 2, a primary charger 3, a laser scanner 4, a developing device 5, a primary transfer blade 6, and a cleaner 7 which are process means acting on the drum 2 are disposed.

Under the image forming portions Y, M, C and Bk, an intermediary belt unit 8 is disposed. The belt unit 8 includes an intermediary transfer belt 9 which is flexible and endless (hereinafter referred to as a belt) and rollers, around which the belt 9 is extended, including a driving roller 10, a tension roller 11 and a secondary transfer opposite roller 12. The primary transfer blade 6 of each of the image forming portions Y, M, C and Bk is disposed inside the belt 9 and presses an upper belt portion, between the tension roller 11 and the driving roller 10, against the lower surface of the drum 2. A contact portion between each drum 2 and the belt 9 constitutes a primary transfer portion. Against the secondary transfer opposite roller 12, a secondary transfer roller 13 presses the belt 9. A contact portion between the belt 9 and the secondary transfer roller 13 constitutes a secondary transfer portion. The belt 9 is circulatingly moved in a clockwise direction indicated by an arrow at a speed corresponding to the rotational speed of the drum 2 by the driving roller 10.

In this embodiment, the first image forming portion Y accommodates the developer (color toner) of yellow (Y) and forms a Y toner image on the drum 2. The second image forming portion M accommodates the developer of magenta (M) and forms an M toner image on the drum 2. The third image forming portion C accommodates the developer of cyan (C) and forms a C toner image on the drum 2. The fourth image forming portion Bk accommodates the developer of black (Bk) and forms a Bk toner image on the drum 2.

The control circuit portion 100 causes each of the image forming portions Y, M, C and Bk to perform an image forming operation on the basis of a color-separated image signal inputted from the device 200. As a result, at the respective image forming portions, color toner images of yellow (Y), magenta (M), cyan (C), and black (Bk) are formed, respectively, on surfaces of associated rotating drums 2. Electrophotographic image forming principle and process for forming a toner image on the drum 2 are well known in the art, thus being omitted from description.

The toner images formed on the drums 2 at the respective image forming portions are successively transferred onto an outer surface of the belt 9, in a superposition manner, which is rotationally driven in the same direction as the rotational directions of the respective drums 2 at a speed corresponding to the rotational speeds of the respective drums 2. As a result, on the surface of the belt 9, unfixed full-color toner images are synthetically formed in a superposition manner of the above-described four toner images Y, M, C and Bk.

With predetermined sheet feeding timing, a sheet-feeding roller 15 at a stage selected from a plurality of sheet-feeding cassettes 14A and 14B in which various recording materials P having different widths are stacked and accommodated is driven. As a result, one sheet of the recording material P stacked and accommodated in the sheet-feeding cassette at the selected stage is separated and fed to be conveyed to registration roller pair 18 through a conveying path 16. When a manual sheet feeding mode is selected, a sheet-feeding roller 19 is driven. As a result, one sheet of the recording material P placed and set on a multi-sheet feeding tray 20 is separated and fed to be conveyed to the registration roller pair 18 through the conveying path 16.

The registration roller pair 18 once receives the recording material P and, in the case where the sheet P is obliquely moved, causes the recording material P to move in a straight line. Then, the registration roller pair 18 sends the recording material P to a secondary transfer portion which is the contact portion between the belt 9 and the secondary transfer roller 13 in synchronism with the toner images on the belt 9. As a result, at the secondary transfer portion, the full-color synthetic toner images on the belt 9 are secondary-transferred collectively onto the surface of the recording material P. That is, on the surface of the recording material P, an unfixed toner image which is a superposed image of a plurality of the color toner images are formed.

The recording material P coming out of the secondary transfer portion is separated from the surface of the belt 9 and guided into the fixing device 21. By this fixing device 21, the above-described toner images of a plurality of colors on the recording material P are melted and mixed to be fixed on the surface of the recording material P as a fixed image.

The surface of the belt 9 after the separation of the recording material P at the secondary transfer portion is subjected to removal of residual deposited matter such as secondary transfer residual toner or the like by a belt cleaner 82 to be cleaned, thus being repeatedly subjected to image formation.

In the case of a print mode, other than the full-color mode, such as a single color mode (e.g., a monochromatic mode), a secondary color mode or a multi-order color mode, an associated image forming portion is subjected to image forming operation control. In the case of the one-side print mode, the path of the recording material P coming out of the fixing device 21 is switched by a switching flapper 3 in accordance with a predetermined designation to be discharged on a face-up sheet discharge tray 25 disposed on the side surface of the printer or discharged on a face-down sheet discharge tray 28 disposed on the upper surface of the printer. In the case of the discharge on the tray 25, the recording material P coming out of the fixing device 21 passes through the lower surface side of the flapper 23 placed in a first attitude in a straight line and is discharged on the tray 25 by first sheet discharge rollers 24 with an image surface up. In the case of the discharge on the tray 28, the recording material P coming out of the fixing device 21 passes through the upper surface side of the flapper 23 placed in a second attitude and is guided upward, thus being conveyed upward through a conveying path 26. Then, the recording material P is discharged on the tray 28 by second sheet discharge rollers 27 with an image surface up.

In the case of both-side print mode, the recording material P on which the first surface has already been subjected to image formation and fixation and which comes out of the fixing device 21 passes through the upper surface side of the flapper 23 placed in the second attitude and is guided upward, thus being conveyed upward through the conveying path 26. When a trailing end of the recording material P reaches a reversing point R during the conveyance of the recording material P, the drive mode along the conveying path 26 is changed into a reverse conveying drive mode. As a result, the recording material P is moved back to enter a both-side conveying path 29 in a reversed state. As a result, the recording material P is subjected to image transfer on a second surface. The recording material P coming out of the secondary transfer portion is guided into the fixing device 21 again. The path of the recording material P which has been subjected to the both-side printing and comes out of the fixing device 21 is, similarly as in the case of the one-side print mode, switched by the switching flapper 23 in accordance with the predetermined designation to be discharged on the tray 25 or the tray 26. A portion constituted by the flapper 23, the conveying path 26, and the like is an example of a reversing means.

<Fixing Device 2>

The fixing device 21 in this embodiment is of a belt heating type and is constituted so that an endless belt having an electroconductive layer and flexibility is externally heated through induction heating (1H) by a magnetic field generating means. That is, the fixing device 21 uses a flexible rotatable endless belt, (a thin fixing belt having an electroconductive layer (induction heat generating member)) which generates heat by the action of magnetic flux, as the heating member (fixing member) for heating the recording material P. The fixing device 21 is of the belt heating type and a pressing rotatable member drive type (free belt type) in which the belt is heated through the induction heating by the magnetic field generating means (magnetic flux generating means) provided outside the belt.

In the following description, with respect to the fixing device 21 or members constituting the fixing device 21, a front surface is a surface at which the fixing device is viewed from a recording material entrance side and a rear surface is a surface (recording material exit side) opposite from the front surface. Left and right are those in the case where the fixing device is viewed from the sheet entrance side. Further, the longitudinal direction is a direction parallel to a direction perpendicular to the recording material conveyance direction in a plane of the recording material conveying path. A short direction is a direction perpendicular to the longitudinal direction. An upstream side and a downstream side are those with respect to the recording material conveyance direction. A sheet passing width is a dimension of the recording material with respect to a direction perpendicular to the recording material conveyance direction in a plane of the sheet.

Figure 2:
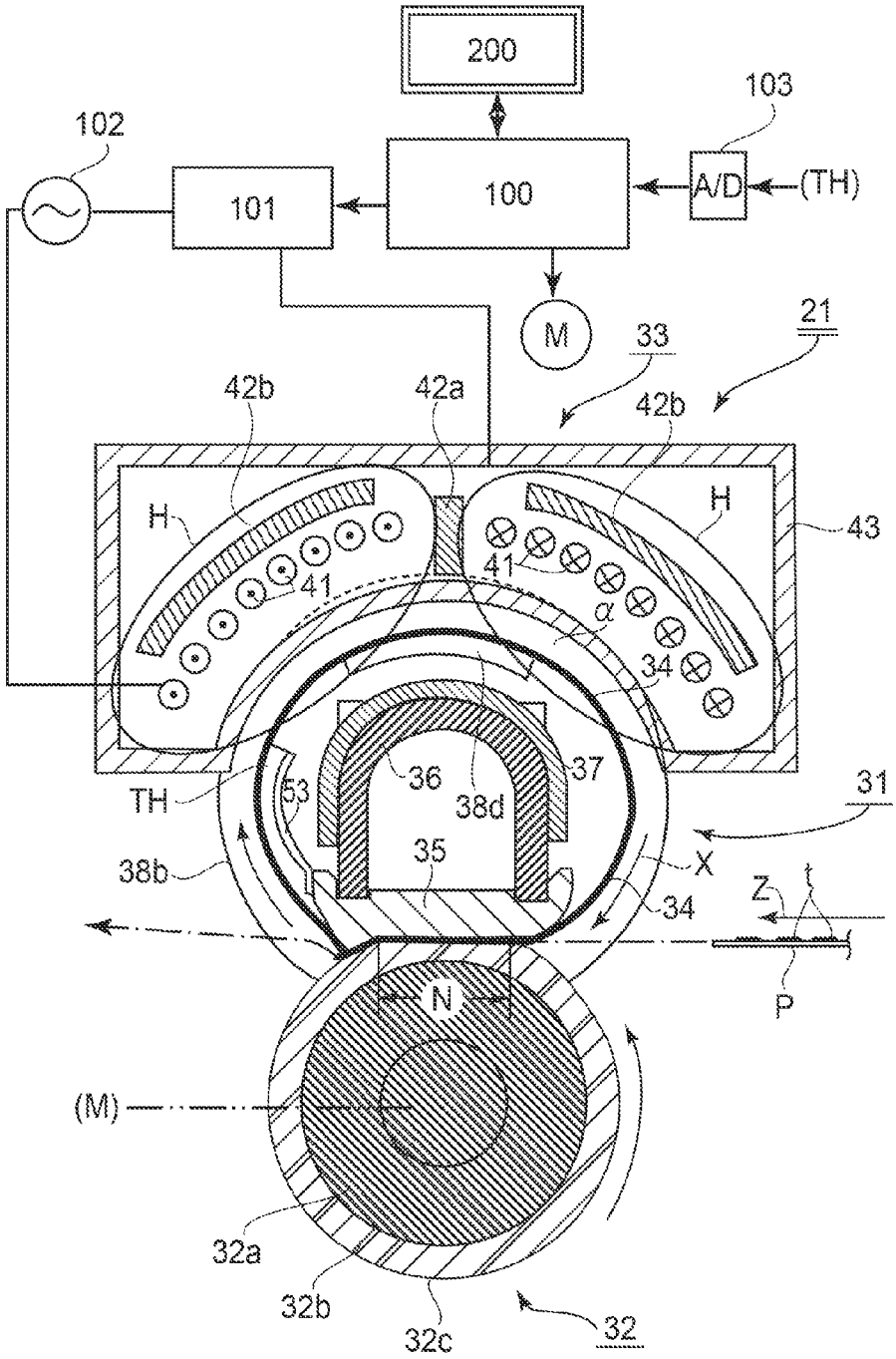
FIG. 2 is an enlarged schematic cross-sectional view and control system block diagram of a principal portion of a fixing device in Embodiment 1.

FIG. 2 is an enlarged schematic cross-sectional view and control system block diagram of a principal portion of the fixing device 21. FIG. 3A is a schematic front view of the fixing device 21, and FIG. 3B is a schematic longitudinal front view of the fixing device 21. Part (a) of FIG. 4 is a partly enlarged view of FIG. 3B, (b) of FIG. 4 is a schematic layer-structural view of a fixing belt, and (c) of FIG. 4 is a partly exploded perspective view of a fixing pad, a stay, a core and a cap member. FIG. 5 is a perspective view of an outer appearance of members constituting the fixing device 21, including a fixing belt unit 31, a pressing roller 32 and an exciting coil unit 33 as seen from a pressing roller 32 side.

The fixing device 21 includes the fixing belt unit 31 disposed and held between left and right opposite side plates 51L and 51R of a device frame (chasis) 50 at both longitudinal end portions of the belt unit 31. The fixing device 21 further includes the elastic pressing roller 32 (elastic rotatable pressing member) as an opposite member, disposed and held between the left and right opposite side plates 51L and 51R at both longitudinal end portions of the pressing roller 32. The belt unit 31 and the pressing roller 32 are disposed vertically in parallel to each other between the side plates 51L and 51R. The belt unit 31 and the pressing roller 32 press-contact each other to form a fixing nip N, between the pressing roller 32 and a fixing belt 34 on the belt unit 31 side, having a predetermined width with respect to a belt rotational direction.

Further, the fixing device 21 includes the exciting coil unit 33 (induction heating device), as the magnetic field generating means for generating the magnetic flux, provided and held by the device frame 51 at the side 180 degrees opposite from the pressing roller 32 side with respect to the belt unit 31. The exciting coil unit 33 is an elongated member extending in a longitudinal direction perpendicular to the rotational direction of the belt 34 and is oppositely disposed outside and in non-contact with the belt 34 of the belt unit 31 with a substantially constant gap α. In this embodiment, the unit 33 is provided in consideration of a maximum rotation locus of the belt 34.

(1) Belt unit 31

In the belt unit 31, the belt 34 uses ferromagnetic metal such as iron or the like (metal having high magnetic permeability), so that a larger amount of the magnetic flux generated from the coil unit 33 can be confined inside the metal. That is, a magnetic flux density can be increased, so that eddy current is generated on the metal surface and therefore the belt is efficiently caused to generate heat. The belt unit 31 includes a fixing pad 35 as a back-up member (pressure applying member) and a pressing stay 36 as a rigid member which are inserted into and fixedly disposed inside the belt 34. The fixing pad 35 is a heat-resistant and heat-insulating member extending in its longitudinal direction crossing a recording material conveyance direction E.

As a material for the pad 35, those with good insulating and heat-resistant properties, such as phenolic resin, polyimide resin, polyamide resin, polyamideimide resin, PEEK resin, PES resins, PPS resin, PFA resin, PTFE resin, and LCP resin are used. The pad 35 performs the functions such as the back-up of the belt 34, pressure application in the nip N, necessary profile (pressure distribution) formation in the nip N with respect to the recording material conveyance direction Z and improvement in conveyance stability of the belt 34 during the rotation.

The pressing stay 36 is a mold steel product having rigidity such as SUS or the like and having an inverted U-like cross-sectional shape. The pressing stay 36 supports the fixing pad 35. Further, the belt unit 31 includes a magnetic core (magnetic shielding core) 37 formed inside the belt 34 of a ferromagnetic material in the inverted U-like cross section, as a magnetic shielding member, and disposed so as to cover an outer surface of the pressing stay 36. Lengths of the fixing pad 35 and the pressing stay 36 are longer than a length of the belt 34 and are protruded from the both end portions of the belt 34 toward the outside at left and right (both) end portions of the fixing pad 35 and the pressing stay 36. With the protruded end portions, capping members (end members) 38L and 38R are engaged and fitted.

Referring to (b) of FIG. 4 which is the schematic view showing a layer structure of the belt 34, the belt 34 is a four-layer lamination composite material belt is a cylindrical (endless) heat-resistant member as a heating member for conducting the heat and includes, from an inner surface side to an outer surface side, a base layer 34*a*, an electroconductive layer 34*b*, an elastic layer 34*c* and a surface parting layer 34*d*, thus having flexibility as a whole and holding a substantially cylindrical shape in a free state.

In the belt 34 in this embodiment, the base layer 34*a* is a nickel layer (metal layer) formed by electro-casting in an inner diameter of 30 mm and a thickness of 40 μm. The base layer 34*a* is provided as a sliding layer for preventing abrasion (wearing) of the electroconductive layer 34*b* formed outside the base layer 34*a* from directly rubbing with the pad 35 as the back-up member and for reducing a sliding friction with a temperature sensor TH1 provided at the inner surface of the belt 34.

The electroconductive layer 34*b* is a layer which generates heat by the electromagnetic induction function of the magnetic field (flux) generated by the coil unit 33 and is formed and used in an about 1-50 μm thick metal layer of iron, cobalt, nickel, copper, chromium, or the like. There is need to reduce the WUT (warm-up time) by lowering the thermal capacity, so that the electroconductive layer 34*b* may preferably be formed in a small thickness as thin as possible. In this embodiment, in order to compatibly realize the heat generating efficiency and the thermal capacity, as the electroconductive layer 34*b*, an about 40 μm-thick layer of nickel having high electrical conductivity.

The elastic layer 34*c* in this embodiment is a heat-resistant silicone rubber layer. The thickness of the silicone rubber layer may preferably be set in a range of 100 μm to 1000 μm. In this embodiment, the thickness of the elastic layer 34*c* is 300 μm in consideration that the heat capacity of the belt 34 is decreased to reduce the WUT and that a suitable fixed image is obtained when the color image is fixed. The silicone rubber layer has a rubber hardness (JIS-A) of 20 degrees and a thermal conductivity of 0.8 W/m.K.

The surface parting layer 34*d* is a layer directly contactable to the unfixed toner image t formed on the recording material P, so that there is the need to use a material having good releasability. As a material constituting the surface parting layer 34*d*, e.g., it is possible to use a tetrafluoroethylene-perfluoroalkylvinyl ether copolymer (PFA), polytetrafluoroethylene (PTFE), a silicone copolymer, or a combination of these materials for forming a composite layer, or the like. The surface parting layer 34*d* is provided as an uppermost layer of the belt in a thickness of 1-50 μm of a material appropriately selected from the above materials. When the thickness of the surface parting layer 34*d* is excessively thin, durability is lowered in terms of anti-wearing property to shorten a life time of the fixing belt 34. On the other hand, when the thickness is excessively thick, the surface hardness of the belt 34 is increased and therefore contact non-uniformity between the belt and the image surface is liable to occur, thus undesirably causing image defect. In is embodiment, in view of a balance between the anti-wearing property and the thermal capacity of the belt 34, a 30 μm-thick layer of PFA (tetrafluoroethylene-perfluoroalkylvinyl ether copolymer) is used.

The magnetic core 37 is disposed inside the belt 34 and opposes the coil unit 33 through the belt 34 and adjusts the magnitude of induced magnetic field exerted from the coil unit 33 to the belt 34. The magnetic core 37 has the function of improving a heat generating efficiency of the belt 34. Further, the magnetic core 37 also has the function of suppressing warming of the pressing stay 36 through the induction heating by covering an outer surface of the pressing stay 36 as the metallic material to block the magnetic flux toward the pressing stay 36. As the magnetic core 37, a material having high magnetic permeability and low loss is used. The magnetic core 37 is used for enhancing an efficiency of a magnetic circuit and for magnetic shielding with respect to the pressing stay 36. As a typical example of the material for the magnetic core 37, ferrite core is used.

Left and right capping members 38L and 38R are a heat-resistant member of a heat-resistant material and are a molded member having the same shape. Part (c) of FIG. 4 is an exploded perspective view showing the left (right) capping member 38L (38R), the left (right) end portion of the pressing stay 36 which supports the fixing pad 35, and the core 37.

Each of the left and right capping members 38L and 38R includes a pressure-receiving portion 38*a* which covers an associated left (or right) end portion of the pressing stay 36 which supports the fixing pad 35. The capping member 38L and 38R further include a flange portions 38*b*, each provided integrally with the associated pressure-receiving portion 38*a*, opposing the left and right end surfaces of the belt 34. The pressure-receiving portion 38*c* and the flange portion 38*b* are provided with a hole 38*d* for permitting insertion of the end portion of the pressing stay 36 which supports the fixing pad 35. Further, each of the capping members 38L and 38R includes a belt rotation guide member 38*c*, provided at the inner surface side opposite from the pressure-receiving portion 38*a* side of the flange portion 38*b*, for regulating the rotation locus of the belt 34 from the inside of the belt 34 by supporting the end position of the belt 34 from the belt inside.

The left and right capping members 39L and 39R are engaged and fitted with the left and right end portions of the pressing stay 36 which supports the fixing pad 35. The belt 34 is externally engaged rotatably around the pad 35, the stay 36 and the core 37 which are provided between the left and right capping members 38L and 38R.

The pressure-receiving portions 38*a* of the members 38L and 38R of the unit 31 are engaged with slit portions (engaging grooves) 52L and 52R, respectively, provided to the left and right opposite side plates 51L and 51R of the device frame 50. As a result, the left and right capping members 38L and 38R are guided by the vertical guide slit portions 52L and 52R, respectively, thus being disposed slidably (movably) in a direction toward the pressing roller 32 and its opposite direction with respect to the left and right opposite side plates 51L and 51R. That is, the unit 31 is provided slidably movable in the direction toward the pressing roller 32 and its opposite direction with respect to the opposite side plates 51L and 51R.

Inside the belt 34, a thermistor TH as a temperature detecting means for detecting the belt temperature in order to control the temperature of the belt 34 is disposed. This thermistor TH is caused to elastically contact the inner surface of the belt 34 at its temperature detecting portion by a spring property of an elastic member 53 while a base portion thereof is held by the pad 35 and an end portion thereof is held at an end portion of the elastic member 53. The thermistor TH may also be configured to be disposed outside the belt 34 and to elastically contact the outer surface of the belt 34 at its temperature detecting portion.

(2) Pressing roller 32

In this embodiment, the pressing roller 32 is prepared by providing an elastic layer 32*b* of a heat-resistant rubber such as a silicone rubber or a fluorine-containing rubber or of a foam member of the silicone rubber, on a core metal 31*a* and by forming a parting layer 32*c* at an outer peripheral surface of the elastic layer 32*b*. In this embodiment, a silicone rubber layer as the elastic layer 32*b* is provided on the core metal 32*a* of iron alloy having a diameter of 20 mm at a longitudinal central portion and a diameter of 19 mm at longitudinal end portions. Further, at the outer peripheral surface of the elastic layer 32*b*, as the parting layer 32*c*, a layer of a fluorine-containing resin (such as PFA or PTFE) is provided in a thickness of 30 μm. The outer diameter of the roller 32 is 30 mm.

The roller 32 has an ASKER-C hardness of 70 degrees. The pressing roller 32 are rotatably supported and disposed between the left and right opposite side plates, 51L and 51R through bearing members 54L and 54R at both (left and right) end portions of its core metal 32*a*, a drive gear G is fixedly provided.

As described above, at the upper side of the roller 32 supported by the frame 50, the unit 31 is disposed with the pad 35 downward while the left and right members 38L and 38R are engaged with the slit portions 52L and 52R of the frame 50.

Between the pressure-receiving portion 38*a* of the left capping member 38L of the belt unit 31 and a left spring receptor 55L provided to the device frame 50 and between the pressure-receiving portion 38*b* of the right capping member 38R and a right spring receptor 55R, urging springs 56L and 56R are provided, respectively, in a compressed state. A predetermined expansion force F of the left and right urging springs 56L and 56R acts on the fixing pad 35 through the pressure-receiving portions 38*a* of the left and right capping members 38L and 38R and through the pressing stay 36.

As a result, the fixing pad 35 press-contacts the belt 34 to press the pressing roller 32 against elasticity of the elastic layer 32*b*, so that the fixing nip N as an image fixing and heating portion with a predetermined width with respect to the recording material conveyance direction Z is formed between the belt 34 and the pressing roller 32. That is, the roller 32 is provided outside the belt 34 and press-contacts the belt 34 toward the pad 35 to form the nip N with the predetermined width with respect to the belt rotational direction X.

In this embodiment, to the belt 34 and the roller 32, the pressure of 600N is applied and thus the width of the nip N with respect to the recording material conveyance direction Z is about 9 mm at the longitudinal end portions and is about 8.5 mm at the longitudinal central portion under application of the pressure of 600N. As a result, a conveying speed of the recording material P at the widthwise end portions in the nip is higher than that at the widthwise central portion in the nip, so that there is an advantage that the recording material P is less liable to cause creases (paper creases).

The pad 35 is a member for assisting formation of pressure profile in the nip N and the shape of a nip-forming surface 35N is formed so that the pressure profile (pressure distribution) in the nip N with respect to the recording material conveyance direction Z is a necessary pressure profile (FIG. 6).

This will be described specifically later in (5).

(3) Exciting Coil Unit 33

The coil unit 33 includes a curved portion which is curved along the outer peripheral surface of the substantially cylindrical belt 34 in a substantially semicircular range in cross section. The coil unit 33 is disposed in parallel with the belt unit 31 with respect to their longitudinal directions with a predetermined spacing α between its inner surface and the outer surface of the belt 34 on an opposite side from the pressing roller 32 side with respect to the belt unit 31. The coil unit 33 is disposed between the left and right opposite side plates 51L and 51R by being attached to the device frame 50 through left and right brackets 57L and 57R on its left and right sides.

In this embodiment, the coil unit 33 includes an exciting coil 41, a first magnetic core 42*a* provided at a winding central portion of the coil 41, and a second magnetic core 42*b* provided on a side opposite from the belt 34 side with respect to the coil 41. The coil 41 and the magnetic cores 42*a* and 42*b* are stored in a holder (casing) 43 as a supporting member. The first and second magnetic cores 42*a* and 42*b* and the above-described magnetic core 37 provided inside the belt 34 are formed of the ferromagnetic material which may preferably be ferrite or the like having high magnetic permeability and low residual magnetic flux density.

The coil 41 has a substantially elliptical shape (elongated boat shape) with respect to its longitudinal direction and is disposed inside the holder 43 so as to follow the outer peripheral surface of the belt 34. As a core wire of the coil 41, Litz wire prepared by bundling approximately 80-160 strands of fine wires having a diameter of 0.1-0.3 mm is used. As the fine wires, insulation coating electric wires are used. The Litz wire is wound 8 to 12 times around the magnetic cores 42*a* and 42*b* to constitute the coil 41 to be used. To the coil 41, an exciting circuit 101 (electromagnetic induction heating driving circuit or high-frequency converter) is connected, so that an alternating current can be supplied to the coil 41.

The magnetic cores 42*a* and 42*b* are configured to cover the winding central portion and its peripheral portions of the coil 41, thus performing the function of efficiently introducing AC magnetic flux generated from the coil 41 into the electroconductive layer 34*b* of the belt 34. That is, the magnetic cores 42*a* and 42*b* are used for an increase in efficiency of the magnetic circuit 101 and for magnetic shielding.

(4) Fixing Operation

With predetermined control timing on the basis of the image formation start signal input from the device 200, the control circuit portion 100 effects so-called warming up such that the temperature of the belt 34 of the fixing device 21 is increased up to a temperature suitable for heat-fusing the toner image.

The printer 1 is placed in an image formable state after the surface temperature of the belt 34 reaches a predetermined temperature of, e.g., 180° C. The warming up of the fixing device 21 is performed in such a manner that the pressing roller 32 starts its rotation and correspondingly the belt 34 starts its circulation movement and at the substantially same time or immediately after the start of the movement of the belt 34, the alternating current is supplied from the exciting circuit 101 to the coil 41 of the coil unit 33.

The pressing roller 32 is driven by turning on a fixing motor M (a driving means for rotationally driving the rotatable pressing member).

A driving force from the fixing motor M is transmitted to the drive gear G through a power transmitting system (not shown), so that the pressing roller 32 which is the rotatable pressing member is rotationally driven in the counterclockwise direction indicated by the arrow in FIG. 2 at a predetermined speed. By the rotation of the pressing roller 32, a frictional force is generated between the surface of the pressing roller 32 and the surface of the belt 34 in the fixing nip N, thus exerting a rotational force on the belt 34. As a result, the belt 34 is rotated around the pad 35, the stay 36 and the core 37 at the substantially same rotational speed as that of the pressing roller 32 in the counterclockwise direction indicated by the arrow X while intimately sliding the nip-forming surface 35N of the fixing pad 35 in the fixing nip N at its inner surface. Shifting movement of the belt 34 in the longitudinal direction due to the rotation of the belt 34 is prevented by receiving the belt left end surface by the flange portion 38*b* of the left capping member 38L or by receiving the belt right end surface by the flange portion 38*b* of the right capping member 38R. By applying silicone oil or grease as a lubricant between the pad 35 and the belt 34, a friction resistance between the pad 35 and the belt 34 may also be further reduced.

Further, the control circuit portion 100 turns on the exciting circuit 101. As a result, the alternating circuit (high-frequency current) of 20-50 kHz is caused to flow from an AC power source 102 to the coil 41. Then, the magnetic flux indicated by H around the coil 41 in FIG. 2 is repetitively generated and destroyed. Further, when the magnetic flux H is guided by the magnetic cores 42*a* and 42*b* to cross the electroconductive layer 34*b* of the belt 34, eddy current is generated in the electroconductive layer 34*b* so as to create a magnetic field for preventing a change in magnetic field by the magnetic flux H. The eddy current generates Joule heat by a specific resistance of the electroconductive layer 34*b*. That is, Joule heat is generated in proportion to a skin resistance of the electroconductive layer 34*b* or a magnitude of the current passing through the electroconductive layer 34*b*. By the heat generation of the electroconductive layer 34*b*, the rotating belt 34 is increased in temperature.

On the other hand, the thickness of the electroconductive layer 34*b* of the belt 34 is smaller than a skin depth of the belt 34, so that the magnetic flux penetrates through the electroconductive layer 34*b* to form a closed path (circuit) toward the magnetic core 37 disposed inside the belt 34. At this time, the magnetic core 37 is disposed closest to the belt 34 while keeping a certain distance therebetween, so that the closed magnetic circuit is in an extremely closed state, in which the magnetic flux density is enhanced effectively to induction-heat the belt 34 with no temperature non-uniformity.

In this embodiment, an electrically insulating state between the belt 34 and the coil 41 is kept by a 0.5 mm-thick mold, so that a distance between the belt 34 and the coil 41 is constant at 1.5 mm (a distance between the mold surface and the belt surface is 1.0 mm) and therefore the belt 41 is uniformly heated.

Then, the temperature of the belt 34 is detected by the thermistor TH, so that electrical information on the detecting temperature is input into the control circuit portion 100 through an A/D converter 103. The control circuit portion 100 controls the exciting circuit 101 so that the belt temperature is increased and kept at a preset temperature (fixing temperature) on the basis of the detected temperature information from the thermistor TH. That is, the control circuit portion 100 controls the electric power supply (energization) from the AC power source 102 to the coil 41.

In the above-described manner, the pressing roller 32 is driven and the belt 34 is temperature-controlled so as to increase in temperature up to the predetermined fixing temperature. In this state, the recording material P carrying thereon unfixed toner images t is introduced into the fixing nip N with a toner image carrying surface directed toward the belt 34 side. The recording material P intimately contacts the outer peripheral surface of the belt 34 in the fixing nip N and is nip-conveyed through the fixing nip N together with the belt 34. As a result, heat of the belt 34 is applied to the recording material P and the sheet P is subjected to application of the nip pressure, so that the unfixed toner images t are fixed under heat and pressure application on the surface of the recording material P as a fixed image. The recording material P having passed through the fixing nip N is separated from the outer peripheral surface of the belt 34 to be conveyed to the outside of the fixing device.

Here, the conveyance of the recording materials P having large and small (various) widths or sizes in the printer 1 and the fixing device 21 in this embodiment is performed in a so-called center line basis conveyance mode in which a center line of the recording material P with respect to a width direction of the recording material P is taken as a reference line. In FIG. 3, a reference symbol O represents a center reference line (a phantom line) for the sheet conveyance. Further, a reference symbol Wmax represents a sheet passing are a width of the sheet, having a maximum recording material P passing width, capable of passing through the printer or the fixing device 21.

The unit 33 including the coil 41 is disposed outside the belt 34, not inside the belt 34 where the temperature becomes high. As a result, the temperature of the coil 41 is less liable to become a high temperature, so that the electric resistance is also not increased and thus it becomes possible to alleviate loss by the Joule heating even when the high-frequency current is passed through the coil 41. Further, the disposition of the coil 41 outside the belt 34 also contributes to a decrease in size (heat capacity) of the belt 34 and it can be said that the constitution in this embodiment is also excellent in energy saving property.

With respect to the warm-up time (WUP) of the fixing device 21 in this embodiment, the constitution with a very low heat capacity is employed and therefore when the power of, e.g., 1200 W is inputted into the coil 41, the coil temperature reaches 180° C. as a target temperature in about 15 sec. As a result, there is no need to perform a heating operation during stand-by, so that power consumption can be suppressed at a very low level.

(5) Fixing Pad 35

FIG. 6 is an enlarged cross-sectional view of the fixing pad 35. The pad 35 is molded so that a shape of the nip-forming surface 35N changes the pressure profile to the necessary pressure profile with respect to the recording material conveyance direction Z in the nip N.

The pad 35 is the heat-resistant and heat-insulating member extending in its longitudinal direction crossing the recording material conveyance direction Z and performs the functions such as the back-up of the belt 34, pressure application in the nip N, and improvement in conveyance stability of the belt 34 during the rotation. As a material for the pad 35, those with good insulating and heat-resistant properties, such as phenolic resin, polyimide resin, polyamide resin, polyamide-imide resin, PEEK resin, PES resins, PPS resin, PFA resin, PTFE resin, and LCP resin are used.

In this embodiment, at the nip-forming surface 35N of the pad 35, in order to change the pressure profile to the necessary pressure profile with respect to the recording material conveyance direction Z in the nip N, as a projection-recess portion (uneven portion), a flat surface portion a, a slope portion b and projections c are provided. Each of the flat surface portion a, the slope portion b and the projections c extends continuously over at least a full-length area of a sheet passing area width Wmax of the recording material P of a maximum sheet passing width with respect to a direction perpendicular to the recording material conveyance direction Z at the nip-forming surface 35N.

The slope portion b is provided at a downstream side of the nip-forming surface 35N with respect to the recording material conveyance direction Z. The slope portion b is a protrusion which protrudes toward the roller 32 more than the flat surface portion a and point A is a vertex position of the slope portion b. By the slope portion b, such an effect of improving a separation property of the recording material P from the belt 34 at a recording material outlet portion of the nip N and an effect of enlarging a nip width are obtained.

A protrusion amount q of the slope portion b may preferably be about 0.1 mm or more and about 1.0 mm or less on the basis of the surface of the flat surface portion a. When the protrusion amount q is excessively small, the separating property of the recording material P from the belt 34 at the recording material outlet portion of the nip N is insufficient, so that winding jam of the recording material P can occur in the fixing device 21. On the other hand, when the protrusion amount q is excessively large, a curl amount of the recording material P on which the image is fixed can become very large. Further, when a larger protrusion amount q, a bending stress to the belt 34 becomes larger, so that fatigue fracture of the belt 34 is liable to occur. In this embodiment, the protrusion amount q is 0.5 mm.

The projections c project toward the roller 32 at the nip-forming surface 35N and are needed to change the pressure profile to the necessary pressure profile in the nip N with respect to the recording material conveyance direction Z. Each projection c may preferably have a projection shape having a height r of about 0.1 mm or more and about 1.0 mm or less and a width s of about 0.1 mm or more and about 1.0 mm or less on the basis of the surface of the flat surface portion a with respect to the recording material conveyance direction Z.

When the projection height r is excessively high, a degree of pressure concentration is large, so that it is difficult to form a necessary pressure distribution. Further, when the projection height r is excessively low, the pressure is excessively dispersed, so that it is similarly difficult to form the necessary pressure distribution. Similarly, the pressure is excessively dispersed when the projection width s is excessively wide, and is excessively concentrated when the projection width s is excessively narrow, so that it is difficult to form the necessary pressure distribution. In this embodiment, each of the projection height r and the projection width s is 0.5 mm. Further, three projections c are provided at positions of 3 mm, 5 mm and 7 mm from the vertex position A of the slope portion b toward the upstream side of the recording material conveyance direction Z to create the pressure distribution.

The number and arrangement of the projections c will be described later more specifically together with a pressure distribution shape, a toner image density and a change in chroma.

<Relationship Between Toner Characteristic and Melt State>

A relationship between a toner characteristic and a toner melt state in this embodiment will be described. First, the toner used in this embodiment was prepared by using a polyester-based resin. As a method of manufacturing the toner, it is possible to use a pulverization method or a method (polymerization) of directly manufacturing the toner in a medium such as a suspension polymerization, an interfacial polymerization or a dispersion polymerization. In this embodiment, the toner manufactured by the pulverization method was used. Incidentally, the component and manufacturing method of the toner are not limited to those described above.

As the toner for each color, the toner constituted by a transparent thermoplastic resin containing an associated color dye can be used. In this embodiment, a colored toner using as a binder a polyester resin having a temperature-viscosity characteristic (melt viscosity characteristic) as shown in FIG. 7 was used. The melt viscosity characteristic of the toner used in this embodiment was calculated (measured9 by using a flow tester ("CFT-500D", mfd. by Shimadzu Corp.). The measuring condition was as follows.

(Measuring Condition)

Measuring mode: temperature-rising method
Die hole diameter: 1 mm
Die length: 1 mm
Test load: 10 kg
Cylinder pressure: $9.807\times10^5$ Pa
Temperature-rising speed: 4° C./min.
Reheating time: 300 sec.

Under the above condition, the toner in this embodiment is measured by the temperature-rising method, so that a flow curve, a softening temperature and an incipient fluidization temperature are obtained. From the obtained flow curve, the melt viscosity characteristic as shown in FIG. 7 can be calculated. In this case, the softening temperature Ts and the incipient fluidization temperature Tfb are defined as follows.

Ts: the temperature at which an inner void disappears and a single transparent body or phase with a uniform outer appearance is obtained while having a non-uniform stress distribution.

Tfb: the temperature at which a piston is slightly raised due to thermal expansion of a sample and then is started to lower clearly.

<Phenomenon when Toner Amount on Recording Material is Small.

A lamination state of the unfixed toner image on the recording material in this embodiment will be described. As described above, the see-thru phenomenon of the single-color toner is liable to principally occur when the amount of the unfixed toner image on the recording material is small. The lamination state when the see-thru phenomenon is liable to occur will be described.

(1) Phenomenon that Background of Recording Material (Paper) Cannot be Covered with Toner First, a phenomenon that a background of the recording material cannot be covered with the toner will be described. A relationship between the toner amount and the recording material covering state in the case of the single color will be described. Parts (a) to (d) of FIG. 8 are schematic views for illustrating the relationship between the toner amount and the recording material covering state. Specifically, a difference in each of toner layer formation states when the amount of the toner 601 on the recording material 602 is large and small is shown. In order to see overlapping of the toner particles, a side view, a perspective view, a plan view (before melt) and a plan view (after melt) of the toner layer are shown. In the order of (a), (b), (c) and (d), the toner layer state is gradually changed so that the toner amount is gradually decreased.

In (a) and (b) of FIG. 8 showing the state of the large toner amount, it is understood from the plan views (after melt) that the paper is sufficiently covered with the toner. That is, it is understood that even in the unfixed state (before melt), there is no space between adjacent toner particles and thus the background of the recording material is fully covered.

On the other hand, in (c) of FIG. 8 showing the state of the small toner amount, it is understood that the paper is covered after the melting of the toner at a portion where the toner particles overlap with each other or contact each other two-dimensionally but the background of the paper is in a see-thru state after the melting of the toner at a portion where there is a space between the adjacent toner particles. Further, in (d) of FIG. 8 showing the state of the smaller toner amount, there is no overlapping of the toner particles and therefore it is understood that a degree of the covering of the paper with the toner particles after the melting is further lowered.

Of these, the toner is formed in the single layer at the portion where the clearance between the toner particles is small and therefore even when there is a clearance, it is understood that there is a portion where the covering of the paper somewhat proceeds during unfixing by melt-spread after the melting. However, with a larger clearance between the toner particles on the recording material, a degree of the recording material covering state with the toner is lowered.

Here, an ideal state for forming the toner layer with a small clearance in a smaller toner amount will be described. Parts (a) to (e) of FIG. 9 are schematic views for illustrating the toner layer formation states when the toner amount is small (when there is the clearance) and when the toner particles are arranged in the single layer with no clearance.

Part (a) of FIG. 9 shows the case where the toner amount on the flat surface is very small, the presence of many clearances cannot be avoided. As shown in (b) of FIG. 9, also in the case where the toner amount on the recording material is somewhat increased compared with the case of (a), when there are a three-dimensionally overlapping portion of the toner particles and the clearance portion, the degree of covering of the paper is also decreased and thus it is difficult to obtain good overlapping also during the secondary color toner image formation.

Therefore, in the case where the toner particles are ideally arranged in the plane, compared with the arrangement state of (b), the clearance is decreased but the toner particles have irregular shapes. For that reason, even when all the toner particles contact each other, it is understood that there is a large clearance portion.

Similarly, also in the case where the spherical toner particles provide the particle distribution, when the toner particles which enter under the large-sized toner particles and are arranged are taken into account, the clearance is liable to increase.

That is, as shown in (c) of FIG. 9, in the case where the spherical toner particles with the same particle size are arranged in a closed-packed state, the toner particles can be arranged on the flat surface most efficiently. Further, in this state, all the adjacent toner particles contact each other, so that the paper can be most covered with the toner particles with the same volume.

For example, in the case where elliptical toner particles are well arranged in a long diameter direction, it is considered that the covering state with a higher degree than that in (c) can be achieved. However, when the elliptical toner particles are arranged in a short diameter direction, the degree of the covering state is lower than that in (c). For that reason, in the case where an average arrangement of the elliptical toner particles is considered, compared with the spherical toner particles, the covering ratio results in a lower value.

Next, the toner layer formation state with respect to the toner amount (toner density) of the spherical toner particles with the same particle size capable of creating the ideal arrangement state will be described.

FIG. 10 is a schematic view showing the toner layer formation states with respect to the toner amount (toner density) of the spherical toner particles with the same volume. When the single color toner layer formation states are compared, as shown in (a), the toner particles are in the state in which all the adjacent toner particles contact each other at the time of the closest-packed state and therefore the clearance is smallest. On the other hand, it is understood that the clearance is gradually increased with a decreasing toner amount in the order of (b), (c) and (d).

Various parameters at the time of the ideal arrangement state will be described. FIG. 11 is a schematic view for illustrating the various parameters in the ideal arrangement state. When the particle size (diameter) of each of the toner particles is L (μm), a toner volume Vo ($\mu m^3$), a planar toner particle projected area So ($\mu m^2$) and a unit area Sp ($\mu m^2$) in which one toner particle is contained are represented as follows, respectively.

$$V_O = \frac{4}{3}\pi\left(\frac{L}{2}\right)^3$$

$$S_O = \pi\left(\frac{L}{2}\right)^2$$

$$S_p = \frac{\sqrt{3}}{2}L^2$$

From these parameters, a toner amount per unit area H (average height) H (μm) of a single layer (single color) when the toner particles are arranged in the closest-packed state is calculated as follows.

$$H = \frac{V_O}{S_p} = \frac{4}{3}\pi\left(\frac{L}{2}\right)^3 \cdot \frac{2}{\sqrt{3}L^2} = \frac{\pi L}{3\sqrt{3}}$$

FIG. 12 is a graph showing a relationship between the toner particle size and the toner amount per unit area (average height) in the ideal arrangement state. In FIG. 10, a solid line 610 represents the ideal arrangement state. In a zone A, the toner amount per unit area is larger than that in the ideal arrangement state, and in a zone B, the toner amount per unit area is smaller than that in the ideal arrangement state. That is, in the zone B, the toner amount on the recording material is insufficient and thus the clearance occurs.

Here, a ratio (proportion) T (%) of the clearance in the ideal arrangement, i.e., the clearance (amount unit area) when the toner particles are arranged in the closest-packed state (FIG. 11) is represented as follows.

$$T = \left(1 - \frac{S_O}{S_p}\right) \times 100 = \left(1 - \pi\left(\frac{L}{2}\right)^2 \cdot \frac{2}{\sqrt{3}L^2}\right) \times 100 \approx 9.31$$

This means that the clearance ratio H (%) is always 9.31(%) in the relationship between the toner particle size and the toner amount per unit area (average height) providing the ideal arrangement state shown in FIG. 12, i.e., the solid line 610 in the graph of FIG. 12. In other words, irrespective of the toner amount, the clearance ratio in the ideal arrangement state is 9.31(%).

In the above, in consideration of the toner particle arrangement state, with respect to the toner amount per unit area, the toner volume per unit area (μm) (=average height) is used for the description but generally when the toner amount per unit area is measured and controlled, a weight per unit area (mg/cm$^2$) is used. In accordance with this, when a density ρ (g/cm$^3$) is taken into consideration in the above formula representing the ideal arrangement state (the closest state of the spherical toner particles), the toner amount per unit area can be converted into a toner amount per unit area A (mg/cm$^2$) represented by the following formula.

$$A = \rho \times H = \rho \times \frac{1}{10} \times \frac{\pi L^3}{3\sqrt{3}L^2} = \frac{\rho\pi L}{30\sqrt{3}}$$

In this formula, "1/10" is a factor for unit alignment.

Incidentally, in the above, the case of the lamination state and arrangement state of the toner particles when the recording material surface is uniform are described. However, in the case where the image is formed on the recording material, projections and recesses are present on the recording material surface. This uneven state varies depending on the types of the recording material. For example, with respect to the toner amount A (the minimum toner amount in the ideal closest-packed arrangement state of the spherical toner particles), the uneven state varies depending on the surface property of the recording material.

For example, in the case where the surface property of the recording material is relatively small as in the case of coated paper, the toner amount is a value close to the above-described value A. On the other hand, in the case where the surface property of the recording material is not good a in the case of recycled paper, the toner amount is a value considerably larger than the value A. That is, also with respect to a degree of color registration (occurrence of the secondary color or the multi-order color), when the surface property of the recording material is not good, the degree of color registration is decreased.

<Relationship Between Recording Material Surface Property and Solid Single-Color Toner Amount>

Next, a relationship between the recording material surface property and the solid single-color toner amount will be described. Although described above, when the lamination state and arrangement state are ideal states, the toner layer lamination and arrangement state in which the recording material is covered is such a state that the toner particles are in the closest-packed state in which they are adjacent to each other, and the toner amount in the state corresponds to the minimum toner amount in which the recording material is covered with the single layer of the toner particles at a maximum level.

At this time, when the unfixed toner particles have a specific gravity ρ (g/cm$^3$), a weight-average particle size L (μm) and the toner amount per unit area A (mg/cm$^2$), the toner amount A is represented by: $A=(\rho\pi L)/30\sqrt{3}$. Further, in this case, a ratio (proportion) Q (%) at which the recording material can be covered with the single layer of the toner particles at the maximum level is represented as follows.

$$Q=100-9.31=90.69(\%)$$

Here, a measuring method of the volume-average particle size will be described. The average particle size of the toner can be measured using various apparatuses and methods. Such as a Coulter Counter T-II or Coulter Multisizer (mfd. by Coulter Co. Ltd.) which is connected with an interface (mfd. by Nikkaki Bios Co., Ltd.) for outputting a number average distribution and a volume-average distribution, a personal computer (Model "PC 9801", mfd. by NEC Personal Computers, Ltd.). As the electrolytic solution, a 1%-aqueous solution of reagent-grade sodium chloride is prepared.

For example, "ISOTON R-II" (mfd. by Coulter Scientific Japan Co.) can be used.

The measuring method was as follows. To 100-150 ml of the electrolytic solution, 0.1-0.5 ml of a surfactant as a dispersant, preferably, alkylbenzenesulfonic acid salt, was added, and to this mixture, 2-20 mg of test sample was added. Then, the electrolytic solution in which the test sample was suspended was dispersed in an ultrasonic dispersing device for roughly 1-3 minutes. Then, a volume and the number of the toner particles in the range of 2-40 μm were measured with the use of the above-mentioned Coulter Counter TA-II fitted with a 100 μm-aperture to calculate the volume distribution and the number distribution.

From the volume distribution, a weight-average particle size based on the weight of the toner particles was obtained (by using a center value of each channel as a represented value of each channel).

However, when the recording material surface property is changed in the case where the recording material surface is uniform, with respect to the above relationship, the toner amount necessary to cover the recording material is changed depending on the surface property. Parts (a) and (b) of FIG. 13 are schematic cross-sectional views when the toner particles are arranged on the two types of the recording materials different in surface property. In (a) of FIG. 13, the case where the surface property of the recording material (paper) is smooth is shown and in this case, the state in which the toner particles are adjacent to each other to cover the recording material surface is shown. On the other hand, in (b) of FIG. 13, the recording material has a poor surface property (the unevenness) and in this case, the toner particles are not adjacent to each other and thus the recording material is not covered with the toner particles.

That is, in the case where the recording material surface property as in the coated paper is relatively smooth, the toner amount necessary to cover the recording material is the value close to the above value A. On the other hand, in the case where the recording material surface property is poor, the toner amount is the value larger than the value A.

Here, a relationship between the recording material surface property and the toner amount necessary to cover the recording material at the covering ratio of 90.69% is actually as shown in FIG. 14. Parts (a) to (d) of FIG. 14 are graphs showing relationships between the toner amount necessary cover the recording material at the covering ratio of 90.69% and associated factors including an uneven line length (μm) of the recording material surface ((a)), a surface area ($\mu m^2$) ((b)), an arithmetic-average roughness Ra obtained from the uneven surface shape of the recording material ((c)) and a ten point-average roughness Rz ((d)).

That is, (a) of FIG. 14 shows the relationship between the uneven line length of the recording material surface and the toner amount necessary to cover the recording material at the covering ratio of 90.69%. Part (b) of FIG. 14 shows the relationship between the recording material surface area and the toner amount necessary to cover the recording material at the covering ratio of 90.69%. Part (c) of FIG. 14 shows the relationship between the recording material surface roughness Ra and the toner amount necessary to cover the recording material at the covering ratio of 90.69%. Part (d) of FIG. 14 shows the relationship between the recording material surface roughness Rz and the toner amount necessary to cover the recording material at the covering ratio of 90.69%.

The recording materials used in this embodiment are as follows. As a gloss film, "GF2" (166 $g/m^2$, mfd. by 3M) is used. As the coated paper, "OK Topkote N" (128 $g/m^2$, mfd. by Oji Paper Co., Ltd.) is used. As plain paper, "CS814" sheet (80 $g/m^2$, mfd. by Nippon Paper Group, Inc.) is used. As the recycled paper, "Office Planner" (64 $g/m^2$, mfd. by Nippon Paper Group, Inc.) is used. However, the recording materials are not limited thereto.

From (a) to (d) of FIG. 14, it is understood that the necessary toner amount and each of the uneven line length, the surface area, Ra (arithmetic-average roughness) and Rz (ten point-average roughness) establish a close interrelationship. Of these, the recording material surface area establishes the closest interrelationship with the necessary toner amount and therefore the recording material surface area is employed as the recording material surface property. Incidentally, each of the above-described surface properties other than the surface area is closedly correlated with the necessary toner amount and therefore can also be employed as the recording material surface property so long as the surface property and the necessary toner amount establish the close interrelationship.

<Relationship Between Recording Material Surface Property and Solid Single Color Toner Image Area>

Next, with respect to the toner used in this embodiment (specific gravity ρ: 1.1 ($g/cm^3$), weight-average particle size L: 6.0 (μm)), the relationship between the surface property of each of the recording materials and the solid single-color toner image amount necessary to cover the recording material will be described. First, the necessary toner amount in the case where the recording material surface is uniform (at a reference surface) is used as a reference value. When this reference toner amount is A0 ($mg/cm^2$), the value A0 is not limited when the value A0 falls within a range of: $A0<(\rho\pi L)/30\sqrt{3}$. In this embodiment, the value A0 is 0.3 ($mg/cm^2$).

FIG. 15 is a graph showing a relationship between the toner amount and the covering ratio with respect to each of the recording materials. When the toner amount A at the reference surface ("REF") is 0.3 ($mg/cm^2$), it is understood that the covering ratio of the recording material with the toner at the reference surface is about 68%.

Next, the toner amount providing the recording material covering ratio of 68% of 0.31 ($mg/cm^2$) for the gloss paper ("GLOSS"), 0.32 ($mg/cm^2$) for the coated paper ("COATED"), 0.35 ($mg/cm^2$) for the plain paper ("PLAIN") and 0.41 ($mg/cm^2$) for the recycled paper ("RECYCLED"). Incidentally, the above values are used for the recording materials in this embodiment and are not limited to the specific values described above.

Next, a relationship between the toner amount obtained in the above-described manner and the surface area of the respective recording materials is shown in FIG. 16. Although described above, the recording material surface area and each necessary toner amount show the close interrelationship. Therefore, the relationship between the recording material surface area X ($\mu m^2$) and the solid single-color toner image amount Y ($mg/cm^2$) on each recording material can be represented by: $Y=4\times10^{-8}X+0.26$.

Here, in the case where the unfixed toner image t formed on the surface of the recording material P is a superposed image of the plurality of color toner images, a maximum toner amount per unit area for each single color may preferably satisfy relationships described below. That is, when the unfixed toner particles have the specific gravity ρ ($g/cm^3$), the weight-average particle size L (μm), the recording material surface unit length T0 (mm), the recording material surface length per unit length T1 (mm), the toner amount per unit area A0 ($mg/cm^2$) on the recording material when the recording material surface length per unit length is T1, the toner amount satisfying the following relationships is the maximum toner amount for each single color.

$$A0<(\rho\pi L)/30\sqrt{3},$$

$$A1=T1\times A0/T0, \text{ and}$$

$$A1<(T0/T1)\times(\rho\pi L)/30\sqrt{3}.$$

<Relationship Between Pressure and Toner Melting>

Next, a relationship between the pressure and the toner melting will be described. The toner melting state is determined by the fixing condition such as a fixing temperature, a fixing speed or a fixing pressure and by a toner viscosity characteristic under the fixing condition. However, as described above, based on whether the toner lamination state is the single layer or the multiple layers, the influence by the pressure is largely changed. Generally, in the case where the toner is formed on the recording material in the multiple layers, by lowering the toner viscosity and applying high pressure in the low-viscosity state, a better fixing performance can be obtained.

However, in the case of the single layer system, when the high pressure is applied in the low-viscosity state, as described with reference to FIG. 36, the toner is excessively melted to be dropped from fibers of the recording material surface. As a result, the "see-thru" phenomenon that the background (texture) of the recording material (paper) is exposed and the phenomenon that the surface property of the toner image is impaired are caused to occur. Further, in the case where the control temperature or pressure is controlled so as not to cause the "see-thru" phenomenon, the melting of the secondary contact toner in the multiple-layer system becomes insufficient, so that a lowering in chroma of the secondary color toner and improper fixing occur.

Therefore, in the case where the toner image is formed on the recording material in the single layer and in the case where the toner image is formed in the single layer state and the multi-layer state in mixture, there is a need to apply the pressure to the toner image at a proper point with respect to the toner melting state.

Here, as a method of checking the toner melting state, a method of calculating a spread ratio of the single color toner and an overlapping ratio of the secondary color toner will be described. The spread ratio of the single-color toner is a proportion (%) which indicates a degree of the presence of an area (region) in which the color of the toner image is observed as the single color on the recording material when the single-color toner layer is formed and then as desired is fixed. The overlapping ratio of the secondary color toner is a proportion (%) which indicates a degree of the presence of an area (region) in which the color of the toner image is observed as the secondary color on the recording material when the secondary color toner layer is formed and then as desired is fixed.

In the following description, as the color toner, the cyan toner is used for verification during calculation of the single-color toner spread ratio, and a combination of the yellow toner and the cyan toner is used for verification during calculation of the secondary color toner overlapping ratio. Further, a calculation method and calculation result of the single color-looking area and the color registration (overlapping) area, i.e., the green-looking area are shown as an example. However, this is also true for other colors and therefore the colors are not limited to those described above.

(1) Calculating Method of Secondary Color Toner Overlapping Ratio

When the resultant image is subjected to transmission image observation through an optical microscope ("STM6-LM", mfd. by OLYMPUS Corp.), it is possible to obtain microscopic images which appear cyan, yellow, green and background color. In an area in which the respective color toners do not overlap, the image appears cyan or yellow as the single color and in an overlapping area, the image appears green. A condition for obtaining the microscopic image in this case is as follows.

Experience: 10 magnifications
Objective lens: 5 magnifications
Actual field of view: 4.4 mm
Numerical aperture: 0.13
Light source filter: MM6-LBD for transmission
Output light quantity: maximum Further, the image obtained under the above condition was captured by and stored in an image filtering software ("FLVFS-FIS", mfd. by OLYMPUS Corp.). In this case, camera properties were set as follows.

[Shutter Group]
Mode: slow
Shutter speed: 0.17 sec
[Level Group]
Gain: R=2.13, G=1.00, B=1.74
Offset: R/G/B=±0
While balance: at screen center
Gamma: R/G/B=0.67
Sharpness: none
[Gain (Camera: PGA-AMP)]
R/G/B=1.34

Next, the obtained microscopic image was subjected to trimming at a central portion where the light quantity within an observation area was stable. The trimming was performed by using a software ("Adobe Photoshop", mfd. by Adobe Systems Inc.) and 2 mm square area was selected at an image central portion. Thus, this trimming operation is employed for being performed in the area in which the light quantity within the observation area. It is also possible to effect, in place of the trimming, calibration or the like of the light quantity balance within the observation area.

Next, from the above obtained trimming image, it is possible to perform binary-coded processing (binarization) at the secondary color portion and other portions. By using an image processing software ("Image-Pro Plus", available from Nippon Roker K.K.), a G (green) area in the observation area is calculated.

The trimming image obtained from the microscopic image is subjected to binarization at the secondary color portion and at another portion (other than the secondary color portion) such as the single color portion or the background color portion, i.e., in the green area and in the cyan, yellow or the background color area. In this embodiment, the green-looking portion is extracted in the obtained image on the basis of a threshold and is converted as a white portion and another color-looking portion is converted as a black portion. With respect to the resultant binarized image, a count of the number of the white portion areas and an area of each white portion area are stored as a count file. The area of the white portion of the binarized image is integrated by a software (e.g., "Excel", mfd. by Microsoft Corp.), so that an area ratio of the while portion was calculated as the G area.

For example, when the image as seen in (a) of FIG. 17 is subjected to the above-described binarization, the binarized image of black/white portions as shown in (b) of FIG. 17 is obtained. When the ratio of the white portion is calculated from the binarized image, the ratio of the G area is calculated as follows.

$$G \text{ area ratio } (\%) = \{(\text{area of white portion})/(\text{area of white portion} + \text{black portion})\} \times 100 = \{0.3 \times 0.4/1.0 \times 1.0\} \times 100 = 12\%$$

(2) Calculating Method of Single-Color Spread Ratio

First, the microscopic image is obtained by the measuring method under the measuring condition as described above. In this case, the shutter speed for the single-color toner is set at about 0.08 sec. This is because the toner amount is smaller than that of the secondary color toner and therefore the toner image is liable to be observed at a low shutter speed rather than at a high shutter speed. Then, the image subjected to the trimming or calibration is subjected to the binarization. The binarization is effected by using a desired (single) color and the background color.

For example, in the case where the single-color spread ratio is measured by using the cyan toner, the binarization is effected in the cyan area and the background color area. The cyan-looking portion is extracted from the obtained image on the basis of a threshold and is converted as the white portion. Further, another color-looking portion, i.e., the background color portion is converted as the black portion.

With respect to the resultant binarized image, a count of the number of the white portion areas and an area of each white portion area are stored as a count file. The area of the white portion of the binarized image is integrated by a software (e.g., "Excel", mfd. by Microsoft Corp.), so that an area ratio of the while portion was calculated as a covering ratio.

<Verification of Toner Characteristic and Toner Melting State>

Next, how to change the single-color spread ratio and the secondary color overlapping ration in the case where the toner used in this embodiment is melted on the recording material was verified. This will be described. In this verification, the toner was fixed on the recording material in an oven fixing device (constant temperature oven) 1000 as shown in FIG. 18.

First, on a metal plate 1001, a fixing member having the same constitution as that of the fixing belt described above was applied so as to permit application of arbitrary pressure. Further, on a recording material 1003, an unfixed toner image 1004 was placed. Then, by sandwiching the unfixed toner image 1004 between a pair of the metal plates 1001 to fix the toner image 1004 on the recording material 1003. Ten, a degree of change in each of the single-color toner spread ratio and the secondary color toner overlapping ratio was verified. Further, a temperature at that time was measured by a thin thermocouple 1005 ("KFST-10-100-200", mfd. by ANBE SMT Co.) applied onto the fixing member 1002.

FIG. 19 is a graph showing a result of measurement of the change in single-color spread ratio when the image of the single color toner is formed on the recording material so as to provide the toner amount per unit area of 0.3 (mg/cm$^2$) and then is fixed in the oven by the above-described fixing method. When the temperature reaches a predetermined temperature, the recording material is taken out from the oven and then the single-color toner spread ratio is calculated by the above-described measuring system.

In FIG. 19, a solid line, a broken line and a chain line represent results under application of no pressure ("NO"), a low pressure (0.15 Ma, "LOW") and a high pressure (0.5 MPa, "HIGH"), respectively, to the metal plates. The abscissa represents the toner temperature and the ordinate represents the single-color toner spread ratio. As the recording material, a sheet ("CS814" (81 g/m$^2$), mfd. by Nippon Paper Group, Inc.) was used.

As is understood from FIG. 19, first, in the case where the toner is heated under pressure, it is understood that the spread ratio is abruptly increased in the neighborhood of 70° C. This is because a softening temperature Ts of the toner used in this embodiment is about 70° C. When the toner temperature reaches the softening temperature Ts, the toner state transfers from a solid state to a transfer state and then to an elastomeric state. In this case, the toner is elastically deformed depending on the pressure, so that the spread ratio is increased depending on the pressure in the pressed state. Therefore, as shown in FIG. 19, the higher pressure state provides a larger spread ratio of the toner.

On the other hand, in the case where the toner is heated under no pressure, it is understood that the spread ratio is abruptly increased in the neighborhood of 90° C. This is because an incipient fluidization temperature Tfb of the toner used in this embodiment is about 90° C. When the toner temperature reaches the incipient fluidization temperature Tfb, the toner state transfers from the elastmeric state to a flowing state. At this time, the toner has a viscosity to the extent that the toner is deformed even by its own eight, so that the toner spread ratio is increased even in the no pressure state.

Incidentally, it is understood that the toner spread ratio in the pressure application state is little increased after being abruptly increased. In this regard, a result of observation of a toner spread state through the microscope is shown in FIG. 20.

The viscosity of the toner is abruptly lowered after the incipient fluidization temperature, and the toner spread ratio is increased depending on the pressure. Therefore, when the high pressure is applied when the viscosity is lowered, the toner spread ratio is expected to be abruptly increased. However, in the case where there is an unevenness at the recording material surface, the spreading of the toner is impaired by the surface unevenness of the recording material. Therefore, in the case where the toner amount is small to the extent that the entire surface of the recording material cannot be covered with the toner, the spread ratio of the single-color toner cannot be increased to a value which is not less than a certain value corresponding to the recording material surface property.

Further, as described above, in the case where the toner image is formed on the uneven recording material, when the toner viscosity is largely lowered and the high pressure is applied, the toner particles located at the projections of the recording material surface are dropped from the fiber surface. For that reason, the background surface of the recording material is exposed, so that the see-thru phenomenon occurs.

In FIG. 20, a chain line represents the single-color toner spread ratio when the high pressure is applied. A broken line represents a toner see-thru amount and a chain double-dashed line represents a toner spread amount.

As described above, in the case where the toner particles are dropped from the recording surface projections due to over-fixing, the background surface at that portion is exposed and the toner amount is decreased to a see-thru amount of the paper fiber. On the other hand, the dropped toner particles enter a recessed portion of the recording material to cover the recording material at that portion. Further, after the toner incipient fluidization temperature, the toner can also spread by its own weight and therefore the toner spread amount is the sum of the amount of the toner entering the recessed portion and the amount of the toner spreading by its own weight.

Therefore, the single-color toner spread ratio is an average of the toner spread amount and the toner see-thru amount after the toner incipient fluidization temperature and therefore the spread ratio itself is not changed.

Here, a relationship between the change in toner spread ratio and a reflection density of the single-color toner on the recording material will be described with reference to FIG. 21. The spread ratio in this verification causes the above-described change in toner melting state and therefore an increase/decrease of the spread ratio is not the same as that of the reflection density. Referring to FIG. 21, the spread ratio is not substantially changed or is slightly increased after the toner temperature reaches about 70° C. On the other hand, the reflection density is decreased at 120° C. from a peak at 90-100° C. This is because the spread ratio itself is increased but due to the occurrence of the see-thru phenomenon, the projections of the recording material surface are exposed and thus the surface property is lowered and the amount of the white background portion is increased and thus the density is lowered.

FIG. 22 is a graph showing a result of measurement of the change in secondary color spread ratio when the image of the secondary color toner, i.e., the cyan toner and the yellow toner in this embodiment is formed on the recording material so as to provide the toner amount per unit area of 0.3 (mg/cm$^2$) and then is fixed in the oven by the above-described fixing method. When the temperature reaches a predetermined temperature, the recording material is taken out from the oven and then the secondary color toner spread ratio is calculated by the above-described measuring system.

As is understood from FIG. 22, first, irrespective of the pressure application and no pressure application, the secondary color toner overlapping ratio is not substantially changed in the neighborhood of 70° C. This is because the toner is in the elastmeric state even when the toner temperature reaches about the softening temperature and therefore the toner itself spreads in the pressure-applied state but as in this embodiment, in the case where the toner amount per unit area is originally small to result in less overlapping in the state of the unfixed toner, the area in which the color toners overlap with each other to create the secondary color-looking portion is not substantially increased even under the pressure application.

On the other hand, in the pressure-applied state, when the toner temperature reaches 90° C. close to the incipient fluidization temperature, the secondary color toner overlapping ratio is abruptly increased. This is because when the toner temperature reaches the incipient fluidization temperature, the toner viscosity is abruptly lowered and thus the toner abruptly spreads by the pressure application to increase the area in which the colors overlap with each other and appear the secondary color even in the small toner amount state. In the no pressure state, the toner spread ratio is increased even by its own weight when the toner temperature is close to the incipient fluidization temperature but is small than that in the pressure-applied state and thus a color-overlapping proportion is also small. Therefore, the secondary color toner overlapping ratio is increased but is not large.

Incidentally, from FIG. 22, it is understood that when the case of the high pressure and the case of the low pressure are compared, the case of the high pressure provides a larger secondary color toner overlapping ratio. At a high-temperature side where the toner is sufficiently melted, the substantially same value is obtained but particularly from the low temperature side, the influence of the pressure is exerted. In order to finally provide the same secondary color toner overlapping ratio after the fixing step, it would be considered that a method in which the low pressure is applied in the first half and the high pressure is applied in the second half or a method in which the high pressure is applied in the first half and the low pressure is applied in the second half is employed.

However, as described above with respect to the related art or the single-color toner spread ratio, in the case of applying the high pressure in the second half, a disadvantage such that the see-thru phenomenon of the single-color toner is liable to occur is caused. On the other hand, in the case of applying the high pressure in the first half, the toner viscosity is not low and therefore the see-thru phenomenon of the toner on the recording material is not caused. Thus, in the first half, i.e., in the neighborhood of the toner so temperature in this embodiment, a sufficient pressure is applied, so that the pressure can be further decreased at a latter half side of the fixing nip.

Next, deformation of the toner at the incipient fluidization temperature or more will be described. As described above, the toner viscosity is abruptly lowered at the incipient fluidization temperature or more. At this time, when a toner melt viscosity at a temperature t (° C.) is $\eta(t)$ (Pa·s) and an applied pressure at the temperature t (° C.) is P(t) (kgf/cm$^2$), a toner deformation amount can be represented by: $P(t)/\eta(t)$. That is, the toner deformation amount is large when the toner viscosity is low, and is large when the pressure is large.

In the fixing step in which the unfixed toner image is fixed on the recording material, in the nip, the toner temperature is increased at a position closer to the outlet of the nip and therefore, the toner viscosity is lowered at the position closer to the outlet of the nip. Particularly, when the toner temperature reaches the incipient fluidization temperature and higher, the toner viscosity is abruptly lowered and therefore the toner at the latter half of the nip in the state in which the toner is liable to deform. In this case, when the pressure is excessively high, the toner melting as described above proceeds excessively, so that the see-thru phenomenon that the background surface of the recording material is exposed is caused. Therefore, it is important that the pressure is not applied more than necessary at the incipient fluidization temperature and higher.

On the other hand, in the case where the pressure is excessively lowered at the incipient fluidization temperature and higher, the toner melting does not proceed completely to cause the improper fixing and a phenomenon that the secondary color toner overlapping ratio is lowered. This is because the toner viscosity is abruptly lowered, as described above, at the incipient fluidization temperature and higher. For that reason, when the pressure is excessively applied, the see-thru phenomenon of the single-color toner occurs. However, the toner deformation amount can be represented by: $P(t)/\eta(t)$ as described above and therefore is abruptly increased by applying the pressure when the toner viscosity is low, so that the toner image is liable to be fixed on the recording material. At the same time, the toner deformation amount is excessively lowered, so that the secondary color toner overlapping ratio is lowered.

With respect to the change in toner melt viscosity in the fixing nip, an example thereof will be described with reference to FIG. 23. FIG. 23 shows a relationship between the position in the fixing nip with respect to the conveyance direction and the toner temperature at the position or the toner melt viscosity at the toner temperature. Incidentally, the toner temperature was measured by the thin thermocouple ("KFST-10-100-200", mfd. by ANBE SMT Co.) applied onto the recording material, and a pressure distribution was measured by using a tactile sensor (mfd. by NITTA Corp.). The toner melt viscosity was measured by using a flow tester ("CFT-500D", mfd. by Shimadzu Corp.).

As is understood from FIG. 23, in the fixing nip, the toner temperature is gradually increased and reaches the highest temperature at the outlet of the fixing nip. For example, when the toner temperature reaches 105° C. in the fixing nip, a corresponding toner viscosity is $1\times10^5$ Pa·s in this embodiment. At the nip outlet, the toner temperature reaches 135° C. and the toner viscosity at that time is $1\times10^3$ Pa·s. Thus, the toner viscosity varies in the fixing nip and a degree of the toner melting is changed depending on whether the toner viscosity is higher or low. Further, a melting and spreading property of the toner when the toner is pressed by the fixing device is also changed.

From the above, with respect to the toner melting state, it is possible to increase the single-color toner spread ratio and the secondary color toner overlapping ratio by applying proper pressure. As a necessary function, there are the following three points 1) to 3).

1) At the toner softening temperature, a pressure sufficient to accelerate the spreading of the single-color toner is applied.
2) At the toner incipient fluidization temperature, a pressure sufficient to enhance the secondary color toner overlapping ratio is applied.
3) After the incipient fluidization temperature, the see-thru phenomenon of the single-color toner is liable to occur and therefore the pressure which is more than necessary is not applied. However, there is a need to apply the pressure to the extent that the secondary color toner overlapping ratio is not lowered.

<Calculating Method of P1, P2 and P3>

A pressure applied when a toner temperature of the toner image reaches a softening temperature T1 (° C.) is P1 (kgf/cm$^2$). A pressure applied when the toner temperature reaches an incipient fluidization temperature T2 (° C.) is P2 (kgf/cm$^2$). The toner temperature when $P(t)/\eta(t)$ wherein $\eta(t)$ is a toner melt viscosity (Pa·s) and P(t) is a pressure (kgf/cm$^2$)

applied with the toner melt viscosity η(t) is maximum is T3 (° C.). A pressure applied when the toner temperature reaches T3 (° C.) is P3 (kgf/cm$^2$). Under this condition, a calculating method of P1, P2 and P3 will be described.

For example, when the fixing step is performed by using the toner having the melt viscosity characteristic as shown in FIG. 7 and using a fixing constitution having a pressure distribution as shown in (a) of FIG. 24, the case where the toner temperature in the fixing nip is changed as shown in (b) of FIG. 24 will be described.

First, the softening temperature, the incipient fluidization temperature and the melt viscosity characteristic of the toner used which can be obtained by the above-described flow tester are obtained in advance. The toner temperature in the fixing nip is changed as shown in (b) of FIG. 24 and therefore a position at which the toner temperature reaches the softening temperature is determined. From the determined position and the obtained pressure distribution data, the pressure P1 applied when the toner temperature reaches T1 is calculated. Incidentally, the pressure distribution and change in temperature rise degree in the fixing nip may desirably be complemented so as to provide a necessary number of points between the obtained data as desired.

Similarly, a position at which the toner temperature in the fixing nip reaches the incipient fluidization temperature T2 is determined. From the determined position and the obtained pressure distribution data, the pressure P2 applied when the toner temperature reaches T2 is calculated.

Further, as described above, the pressure applied when the toner temperature in the fixing nip reaches the temperature t (° C.) is calculated as P(t). Further, from the melt viscosity characteristic of FIG. 7, the toner viscosity at the toner temperature t (° C.) in η(t). At this time, the value of P(t)/η(t) at each temperature can be plotted as shown in FIG. 25. In this case, the temperature when the value of P(t)/η(t) is maximum is T3. From FIG. 24, the pressure P3 applied when the toner temperature reaches T3 is calculated.

<Verification of Pressure and Single-Color Toner Density at Toner Softening Temperature>

Next, verification of the pressure and the single-color toner density at the toner softening temperature was conducted. First, with respect to the temperature change, the toner temperature was measured by the thin thermocouple ("KFST-10-100-200", mfd. by ANBE SMT Co.) applied onto the recording material. The pressure distribution was measured by using a tactile sensor (mfd. by NITTA Corp.). The toner melt viscosity was measured by using a flow tester ("CFT-500D", mfd. by Shimadzu Corp.).

Further, as the toner in this embodiment, the toner having the melt viscosity characteristic as shown in FIG. 7 was used. The softening temperature Ts and the incipient fluidization temperature Tfb of the toner measured by using the follow tester were as follows.

Ts: 73.9° C.

Tfb: 91.0° C.

Further, in this embodiment, the toner had the specific gravity ρ of 1.1 (g/cm$^3$) and the weight-average particle size L of 6.0 (μm). As the recording material, the sheet ("CS814" (81 g/m$^2$) mfd. by Nippon Paper Group Corp.) was used. Further, the toner amount per unit area of the single-color toner was 0.3 (mg/cm$^2$). This toner amount per unit area was set at the value smaller than that necessary to cover the recording material.

With respect to the toner (ρ=1.1 (g/cm$^3$) and L=6.0 (μm)) used in this embodiment, in the case where the toner amount per unit area with respect to the reference surface is set at A0=0.3, as is understood from FIG. 15, the recording material covering ratio with the toner is about 68%. The recording material used in this embodiment is the plain paper and therefore, the toner amount per unit area providing the same covering ratio is 0.35 (mg/cm$^2$). Thus, the toner amount per unit amount used in this embodiment is smaller than that necessary to cover the recording material.

Further, the fixing device used in this embodiment employed the fixing device constitution described above and the fixing speed was set at 300 (mm/sec). The surface temperature of the fixing belt was set so as to appropriately provide a control temperature in a range from 170° C. to 200° C. In this embodiment, the number and interval of the projections of the fixing pad as shown in FIG. 6 were variously changed and in each case, the single-color toner density was measured. The projection height and projection width of each projection was set at 0.5 mm.

The fixing device used in this embodiment has the pressure distribution in the fixing nip, e.g., as shown in FIGS. 26 to 32.

Figure 26:
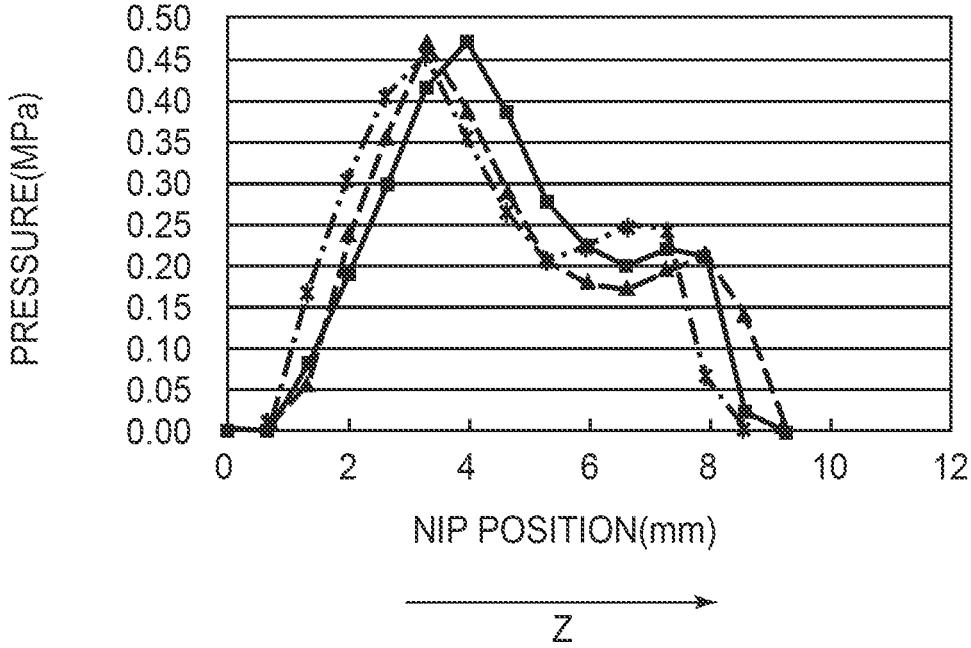
Figure 27:
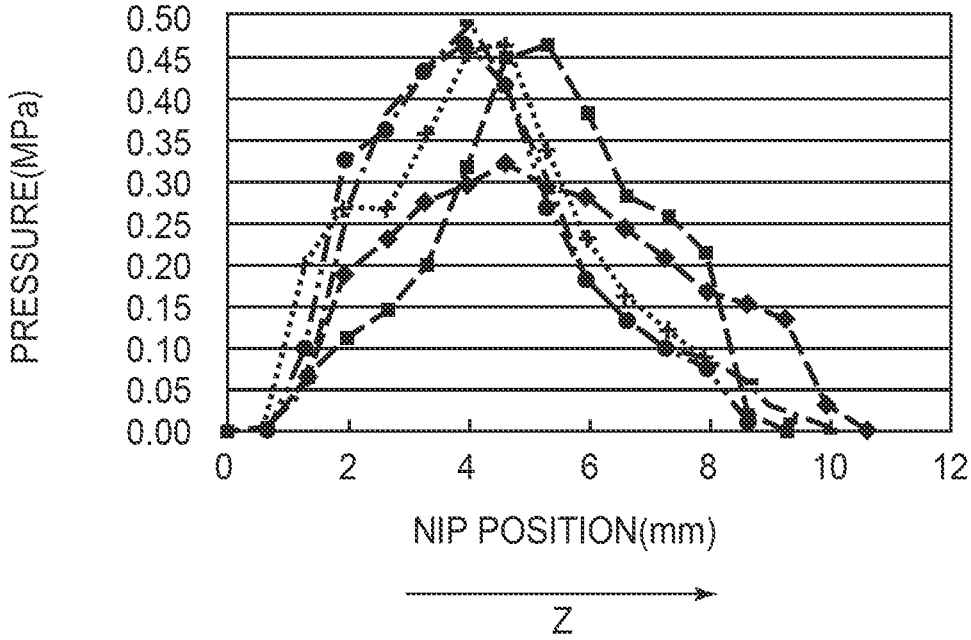

In FIGS. 26 and 27, a peak of the pressure distribution is localized in the first half and can be provided, e.g., by disposing the projections at the first half side of the fixing nip. Specifically, a solid line in FIG. 26 shows the pressure distribution formed by providing the projections at positions of 1 mm and 5 mm upstream from the point A shown in FIG. 6. A broken line shows the pressure distribution formed by providing the projections at positions of 1 mm and 6 mm upstream from the point A. A chain line shows the pressure distribution formed by providing the projections at positions of 2 mm and 6 mm upstream from the point A.

Further in FIG. 27, a solid line shows the pressure distribution formed by providing no projections upstream from the point A shown in FIG. 6. A broken line shows the pressure distribution formed by providing the projections at positions of 1 mm and 4 mm upstream from the point A. A chain line shows the pressure distribution formed by providing the projections at positions of 6 mm and 8 mm upstream from the point A. A dotted line shows the pressure distribution formed by providing the projections at positions of 6 mm and 9 mm upstream from the point A. A chain double-dashed line shows the pressure distribution formed by providing the projections at positions of 7 mm and 9 mm upstream from the point A.

Figure 28:
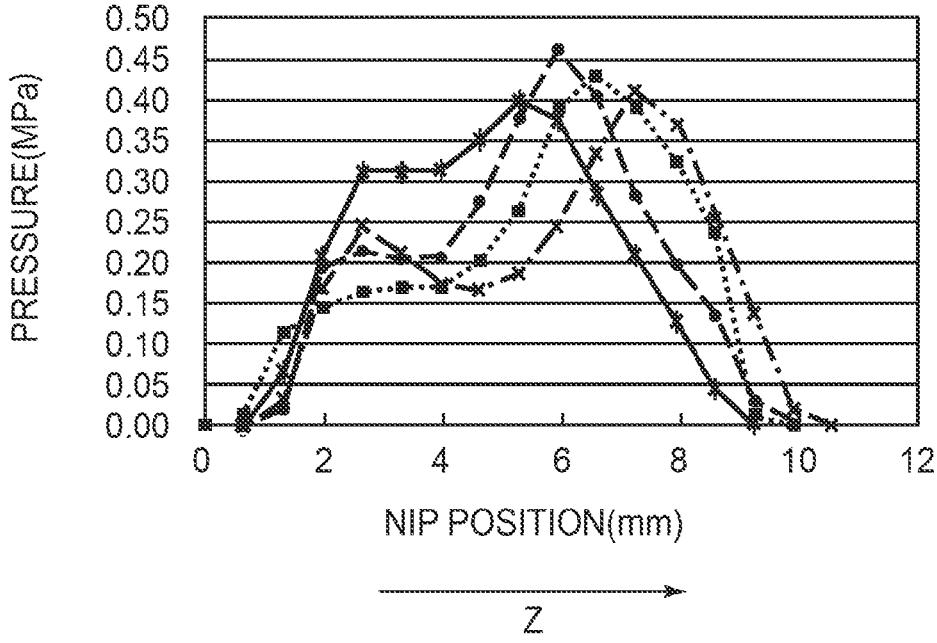

In FIG. 28, a peak of the pressure distribution is localized in the second half and can be provided, e.g., by disposing the projections at the second half side of the fixing nip. Specifically, a solid line shows the pressure distribution formed by providing the projections at positions of 5 mm and 8 mm upstream from the point A shown in FIG. 6. A broken line shows the pressure distribution formed by providing the projections at positions of 5 mm and 9 mm upstream from the point A. A chain line shows the pressure distribution formed by providing the projections at positions of 4 mm and 9 mm upstream from the point A. A dotted line shows the pressure distribution formed by providing the projections at positions of 1 mm and 3 mm upstream from the point A.

Figure 29:
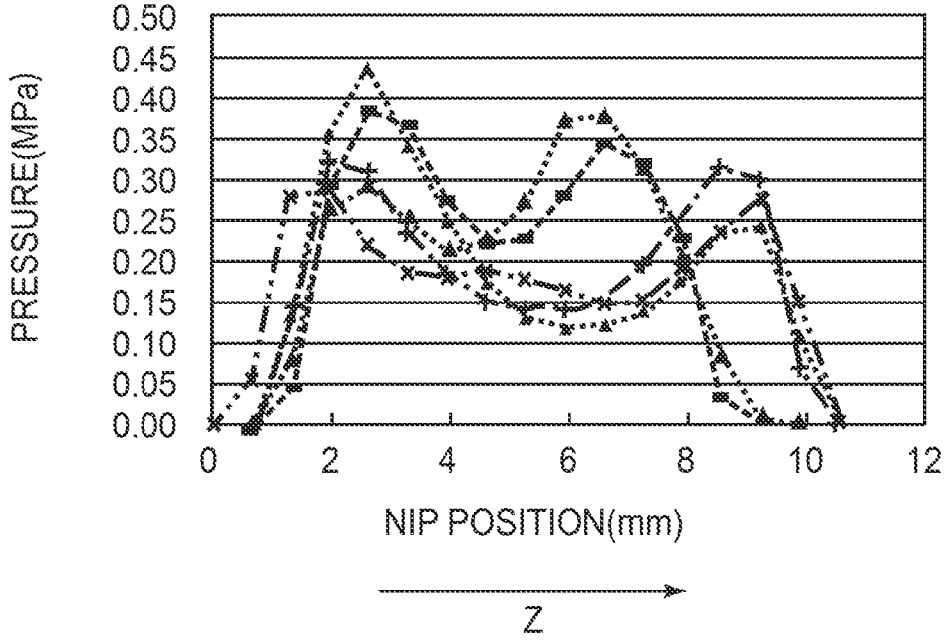

In FIG. 29, a peak of the pressure distribution is localized the first half and the second half and pressure drop is found at a central portion. The pressure distribution can be provided, e.g., by disposing the projections at the first half side and the second half side of the fixing nip. Specifically, a solid line in FIG. 29 shows the pressure distribution formed by providing the projections at positions of 4 mm and 8 mm upstream from the point A shown in FIG. 6. A broken line shows the pressure distribution formed by providing the projections at positions of 3 mm and 7 mm upstream from the point A. A chain line shows the pressure distribution formed by providing the projections at positions of 2 mm and 9 mm upstream from the point A. A dotted line shows the pressure distribution formed by providing the projections at positions of 1 mm and 8 mm upstream from the point A. A chain double-dashed line shows the pressure distribution formed by providing the projections at positions of 7 mm and 9 mm upstream from the point A.

Figure 30:
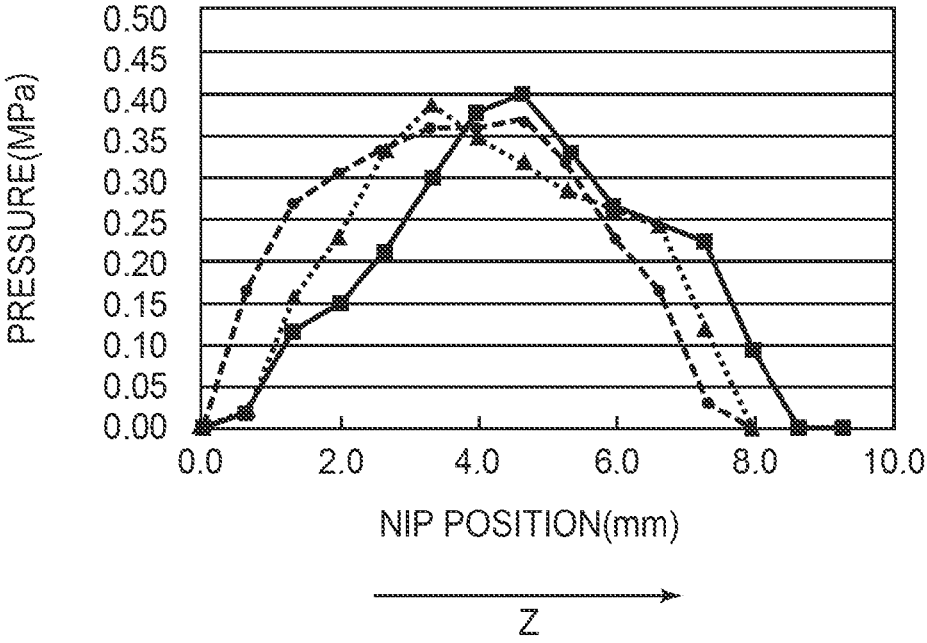

In FIG. 30, a peak of the pressure distribution is localized at a central portion and can be provided, e.g., by disposing the projections at the central portion of the fixing nip. Specifically, a solid line in FIG. 30 shows the pressure distribution formed by providing the projections at positions of 1 mm, 3 mm and 5 mm upstream from the point A shown in FIG. 6. A broken line shows the pressure distribution formed by providing the projections at positions of 5 mm, 7 mm and 9 mm upstream from the point A. A dotted line shows the pressure distribution formed by providing the projections at positions of 2 mm, 4 mm and 6 mm upstream from the point A.

Figure 31:
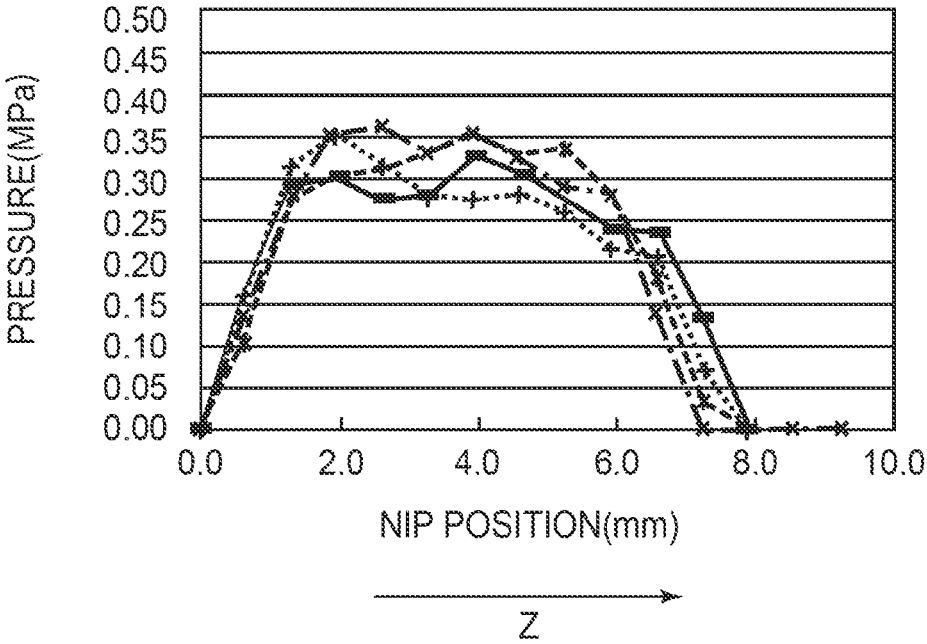
Figure 32:
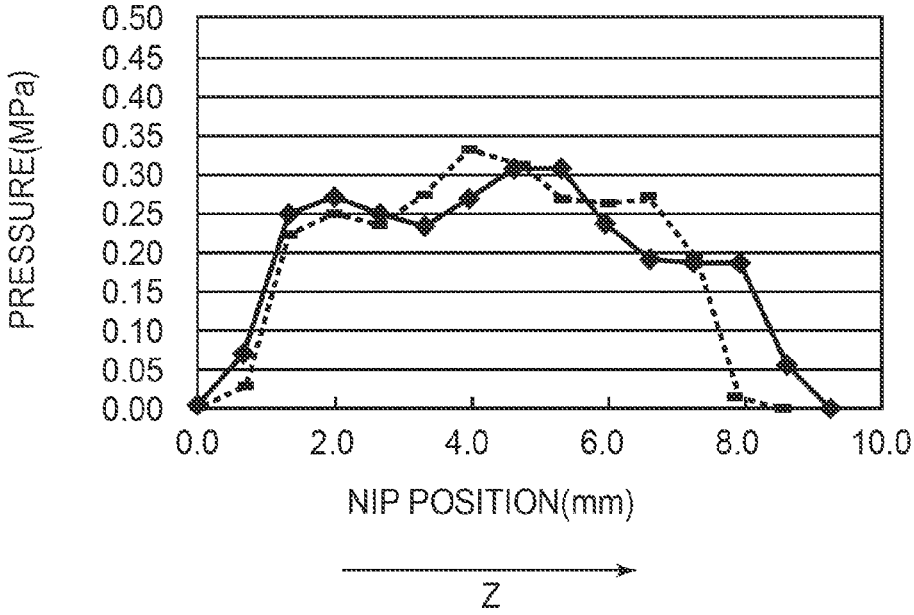

In FIGS. 31 and 32, a shape of the pressure distribution is gentle and a central portion and can be provided, e.g., by disposing the projections at the first half side, the central portion and the second half side with appropriately adjusted intervals in the fixing nip. Specifically, a solid line in FIG. 31 shows the pressure distribution formed by providing the projections at positions of 1 mm, 3 mm, 5 mm and 7 mm upstream from the point A shown in FIG. 6. A broken line shows the pressure distribution formed by providing the projections at positions of 4 mm, 6 mm and 8 mm upstream from the point A. A chain line shows the pressure distribution formed by providing the projections at positions of 3 mm, 5 mm and 7 mm upstream from the point A. A broken line shows the pressure distribution formed by providing the projections at positions of 1 mm, 4 mm and 7 mm upstream from the point A.

Further, in FIG. 32, a solid line shows the pressure distribution formed by providing the projections at positions of 1 mm, 5 mm and 9 mm upstream from the point A. A broken line shows the pressure distribution formed by providing the projections at positions of 3 mm, 5 mm and 9 mm upstream from the point A. A chain double-dashed line shows the pressure distribution formed by providing the projections at positions of 7 mm and 9 mm upstream from the point A.

Incidentally, the above-described pressure distribution providing methods are examples of those for providing the fixing portion pressure distribution used in this embodiment and thus the present invention is not limited thereto. Further, the pressure distributions shown in FIGS. 26 to 32 are representative examples used in the verification in this embodiment. In this embodiment, the verification was conducted by using other various pressure distributions provided by changing the number and arrangement of the projections.

Next, with respect to each pressure distribution in the above-described methods, the pressures P1, P2 and P3 were calculated. As the influence of the pressure applied at the toner softening temperature, a relationship among values Q1, A2 and A3 which are calculated as proportions (percentages) of P1, P2 and P3, respectively, to (P1+P2+P3) and the resultant image density is shown in Table 1 below. Incidentally, in Table 1, the image density is evaluated as to whether or not the resultant image is practically of no problem at an appropriately set control temperature.

In this embodiment, the image density of the fixed toner image was measured as a reflection density by a densitometer ("X-rite 520", mfd. by X-rite, Inc.). Further, the chroma was measured by a spectrophotometer ("Spectrolino", mfd. by GretagMacbeth).

TABLE 1

| Sample No. | Q1 (%) | Q2 (%) | A3 (%) | Density |
|---|---|---|---|---|
| 1 | 18 | 46 | 36 | x |
| 2 | 21 | 46 | 36 | x |
| 3 | 21 | 39 | 39 | x |
| 4 | 24 | 59 | 18 | x |
| 5 | 24 | 48 | 28 | x |
| 6 | 25 | 33 | 42 | x |
| 7 | 26 | 27 | 47 | x |
| 8 | 29 | 50 | 21 | x |
| 9 | 30 | 26 | 44 | x |
| 10 | 31 | 38 | 31 | ○ |
| 11 | 34 | 55 | 11 | Δ |
| 12 | 35 | 38 | 27 | ○ |
| 13 | 35 | 39 | 26 | Δ |
| 14 | 35 | 38 | 27 | Δ |
| 15 | 35 | 36 | 29 | ○ |
| 16 | 36 | 35 | 29 | ○ |
| 17 | 36 | 38 | 26 | Δ |
| 18 | 37 | 28 | 36 | x |
| 19 | 37 | 39 | 24 | ○ |
| 20 | 37 | 23 | 39 | x |
| 21 | 38 | 45 | 18 | Δ |
| 22 | 38 | 38 | 24 | ○ |
| 23 | 38 | 29 | 32 | Δ |
| 24 | 38 | 37 | 24 | Δ |
| 25 | 39 | 45 | 17 | Δ |
| 26 | 39 | 39 | 22 | ○ |
| 27 | 39 | 24 | 37 | x |
| 28 | 41 | 41 | 18 | Δ |
| 29 | 42 | 39 | 20 | ○ |
| 30 | 48 | 30 | 22 | ○ |

(Density)
x: Practically thin (poor) level
Δ: Practically level of no problem
○: Practically good level Here, when the relationship between Q1 and the image density is noted, it is understood that a result that the image density is at the practically thin level with Q1 of 30% or less irrespective of the values of Q2 and Q3. This is because the pressure sufficient to accelerate the single-color toner spreading cannot be applied at the toner softening temperature as described above and such a see-thru phenomenon that the pressure proportion is increased in the second half side of the nip to place the toner in an excessively melted state and thus the toner at the projections of the recording material surface is melted to expose the background surface of the recording material occurs.

Even when Q1 is larger than 30%, there is also the case where the image density is at the practically thin level. This is because the image density is determined by not only the value of Q1 but also another condition (factor). Therefore, in order to achieve the image density at least at the practically level of no problem, it becomes necessary that the value of Q1 is larger than 30%.

<Verification of Pressure and Secondary Color Toner Chroma at Tone Low Start Temperature>

Next, a verification of a relationship between an applied pressure and a secondary color toner chroma at the toner incipient fluidization temperature was conducted. In this verification, conditions of the toner, the fixing device constitution, the fixing speed and the like are similar to those used during the verification of the pressure and the single-color toner image density at the toner softening temperature.

Under each condition, the pressures P1, P2 and P3 were calculated. As the influence of the pressure applied at the toner softening temperature, a relationship among values Q1, A2 and A3 which are calculated as proportions (percentages) of P1, P2 and P3, respectively, to (P1+P2+P3) and the resultant image chroma is shown in Table 2 below. Incidentally, in Table 2, the image chroma is evaluated as to whether or not the resultant image is practically of no problem at an appropriately set control temperature.

TABLE 2

| Sample No. | Q1 (%) | Q2 (%) | A3 (%) | Chroma |
|---|---|---|---|---|
| 1 | 50 | 22 | 28 | x |
| 2 | 32 | 23 | 44 | x |
| 3 | 47 | 25 | 27 | x |
| 4 | 49 | 27 | 25 | x |
| 5 | 26 | 27 | 47 | x |
| 6 | 45 | 28 | 28 | x |
| 7 | 38 | 29 | 32 | x |
| 8 | 45 | 30 | 25 | x |
| 9 | 48 | 31 | 21 | Δ |
| 10 | 36 | 35 | 29 | ○ |
| 11 | 35 | 36 | 29 | ○ |
| 12 | 38 | 37 | 24 | Δ |
| 13 | 45 | 38 | 18 | x |
| 14 | 35 | 38 | 27 | Δ |
| 15 | 38 | 38 | 24 | ○ |
| 16 | 36 | 38 | 26 | ○ |
| 17 | 31 | 38 | 31 | Δ |
| 18 | 42 | 39 | 20 | ○ |
| 19 | 35 | 39 | 26 | ○ |
| 20 | 39 | 39 | 22 | ○ |
| 21 | 37 | 39 | 24 | ○ |
| 22 | 39 | 40 | 20 | ○ |
| 23 | 33 | 40 | 26 | ○ |
| 24 | 39 | 42 | 19 | x |
| 25 | 38 | 43 | 19 | x |
| 26 | 36 | 44 | 20 | ○ |
| 27 | 38 | 45 | 18 | x |
| 28 | 45 | 46 | 9 | x |
| 29 | 46 | 47 | 7 | x |
| 30 | 24 | 48 | 28 | ○ |

(Chroma
x: Practically insufficient chroma
Δ: Practically level of no problem
○: Practically good level Here, when the relationship between Q2 and the image chroma is noted, it is understood that a result that the image density is at the practically insufficient chroma level with Q2 of 30% or less irrespective of the values of Q1 and Q3. This is because the pressure sufficient to enhance the secondary color toner overlapping ratio cannot be applied at the toner incipient fluidization temperature as described above and as a result, the color registration is insufficient and thus the chroma becomes a poor vividness.

Even when Q2 is larger than 30%, there is also the case where the image chroma is at the practically insufficient chroma level. This is because the image chroma is determined by not only the value of Q2 but also another condition (factor). Therefore, in order to achieve the image chroma at least at the practically level of no problem, it becomes necessary that the value of Q2 is larger than 30%.

<Verification of Pressure, Single-Color Toner Image Density and Secondary Color Toner Chroma after Tone Low Start Temperature>

Next, a verification of a relationship among an applied pressure when the toner deformation amount is maximum, the single-color toner image density and a secondary color toner chroma after the toner incipient fluidization temperature was conducted. In this verification, conditions of the toner, the fixing device constitution, the fixing speed and the like are similar to those used during the verification of the pressure and the single-color toner image density at the toner softening temperature.

Under each condition, the pressures P1, P2 and P3 were calculated. As the influence of the pressure applied, when the toner deformation amount is maximum, after the toner softening temperature, a relationship among values Q1, A2 and A3 which are calculated as proportions (percentages) of P1, P2 and P3, respectively, to (P1+P2+P3) and the resultant image density and image chroma are shown in Tables 3 and 4, respectively, below.

TABLE 3

| Sample No. | Q1 (%) | Q2 (%) | A3 (%) | Density |
|---|---|---|---|---|
| 1 | 46 | 47 | 7 | x |
| 2 | 45 | 46 | 9 | x |
| 3 | 34 | 55 | 11 | Δ |
| 4 | 44 | 44 | 12 | ○ |
| 5 | 39 | 45 | 17 | Δ |
| 6 | 38 | 45 | 18 | Δ |
| 7 | 45 | 38 | 18 | ○ |
| 8 | 36 | 44 | 20 | x |
| 9 | 48 | 30 | 22 | x |
| 10 | 39 | 39 | 22 | ○ |
| 11 | 38 | 38 | 24 | ○ |
| 12 | 37 | 39 | 24 | ○ |
| 13 | 38 | 37 | 24 | Δ |
| 14 | 49 | 27 | 25 | Δ |
| 15 | 36 | 38 | 26 | Δ |
| 16 | 35 | 39 | 26 | Δ |
| 17 | 35 | 38 | 27 | Δ |
| 18 | 24 | 48 | 28 | x |
| 19 | 35 | 36 | 29 | ○ |
| 20 | 36 | 35 | 29 | ○ |
| 21 | 31 | 39 | 30 | ○ |
| 22 | 35 | 34 | 31 | ○ |
| 23 | 38 | 29 | 32 | x |
| 24 | 21 | 46 | 33 | x |
| 25 | 37 | 28 | 36 | x |
| 26 | 18 | 46 | 36 | x |
| 27 | 21 | 39 | 39 | x |
| 28 | 37 | 23 | 39 | x |
| 29 | 25 | 33 | 42 | x |
| 30 | 26 | 27 | 47 | x |

(Density)
x: Practically thin (poor) level
Δ: Practically level of no problem
○: Practically good level Here, when the relationship between Q3 and the image density is noted, it is understood that a result that the image density is at the practically thin level with Q1 of 30% or more respective of the values of Q2 and Q3. This is because the toner viscosity is abruptly lowered after the toner incipient fluidization temperature as described above to cause such a see-thru phenomenon that when the high pressure which is more than necessary is applied in the second half side of the nip, the toner is excessively melted and thus the toner at the projections of the recording material surface is melted to expose the background surface of the recording material.

Even when Q3 is smaller than 30%, there is also the case where the image density is at the practically thin level. This is because the image density is determined by not only the value of Q3 but also another condition (factor). Therefore, in order to achieve the image density at least at the practically level of no problem, it becomes necessary that the value of Q1 is smaller than 30%.

TABLE 4

| Sample No. | Q1 (%) | Q2 (%) | A3 (%) | Chroma |
|---|---|---|---|---|
| 1 | 46 | 47 | 7 | x |
| 2 | 45 | 46 | 9 | x |
| 3 | 34 | 55 | 11 | x |
| 4 | 44 | 44 | 12 | x |
| 5 | 39 | 45 | 17 | x |
| 6 | 38 | 45 | 18 | x |
| 7 | 45 | 38 | 18 | x |

TABLE 4-continued

| Sample No. | Q1 (%) | Q2 (%) | A3 (%) | Chroma |
|---|---|---|---|---|
| 8 | 38 | 43 | 19 | x |
| 9 | 39 | 42 | 19 | x |
| 10 | 42 | 38 | 20 | x |
| 11 | 36 | 43 | 21 | ○ |
| 12 | 48 | 30 | 22 | ○ |
| 13 | 39 | 39 | 22 | ○ |
| 14 | 37 | 39 | 24 | ○ |
| 15 | 38 | 37 | 24 | Δ |
| 16 | 49 | 27 | 25 | x |
| 17 | 36 | 38 | 26 | ○ |
| 18 | 35 | 39 | 26 | ○ |
| 19 | 35 | 38 | 27 | Δ |
| 20 | 45 | 28 | 28 | x |
| 21 | 24 | 48 | 28 | ○ |
| 22 | 35 | 36 | 29 | ○ |
| 23 | 36 | 35 | 29 | ○ |
| 24 | 31 | 38 | 31 | Δ |
| 25 | 39 | 37 | 24 | Δ |
| 26 | 21 | 46 | 33 | Δ |
| 27 | 32 | 30 | 38 | ○ |
| 28 | 21 | 39 | 39 | ○ |
| 29 | 37 | 23 | 39 | x |
| 30 | 25 | 33 | 42 | ○ |

(Chroma)
x: Practically insufficient chroma
Δ: Practically level of no problem
○: Practically good level Here, when the relationship between Q3 and the image chroma is noted, it is understood that a result that the image density is at the practically insufficient chroma level with Q3 of 20% or less irrespective of the values of Q1 and Q2. This is because the toner viscosity is abruptly lowered after the toner incipient fluidization temperature as described above the single-color toner is liable to cause the see-thru phenomenon while when the applied pressure is excessively low, the toner deformation amount is excessively small and thus the secondary color toner overlapping ratio is lowered.

Even when Q3 is larger than 20%, there is also the case where the image chroma is at the practically insufficient chroma level. This is because the image chroma is determined by not only the value of Q2 but also another condition (factor). Therefore, in order to achieve the image chroma at least at the practically level of no problem, it becomes necessary that the value of Q3 is larger than 20%.

From the above, with respect to the toner melting state, it is possible to increase the single-color toner spread ratio and the secondary color toner overlapping ratio by applying proper pressure. As a necessary function, there are the following three points 1) to 3).

1) At the toner softening temperature, a pressure sufficient to accelerate the spreading of the single-color toner is applied.
2) At the toner incipient fluidization temperature, a pressure sufficient to enhance the secondary color toner overlapping ratio is applied.
3) After the incipient fluidization temperature, the see-thru phenomenon of the single-color toner is liable to occur and therefore the pressure which is more than necessary is not applied. However, there is a need to apply the pressure to the extent that the secondary color toner overlapping ratio is not lowered.

A pressure applied when a toner temperature of the toner image reaches a softening temperature T1 (° C.) is P1 (kgf/cm$^2$). A pressure applied when the toner temperature reaches an incipient fluidization temperature T2 (° C.) is P2 (kgf/cm$^2$). The toner temperature when P(t)/η(t) wherein η(t) is a toner melt viscosity (Pa·s) and P(t) is a pressure (kgf/cm$^2$) applied with the toner melt viscosity η(t) is maximum is T3 (° C.). A pressure applied when the toner temperature reaches T3 (° C.) is P3 (kgf/cm$^2$).

Further, the following relationships 1), 2) and 3) are satisfied:

$$0.3<P1/(P1+P2+P3), \quad 1)$$

$$0.3<P2/(P1+P2+P3), \text{ and} \quad 2)$$

$$0.2<P3/(P1+P2+P3)<0.3. \quad 3)$$

By satisfying these relationships 1), 2) and 3), it becomes possible to simultaneously optimize the single-color toner spread ratio and the secondary color toner overlapping ratio. Further, in both of the case where the toner image is formed on the recording material in the single layer and the case where the toner image is formed on the recording material in the multiple layers, a good fixing state can be obtained and thus it is possible to simultaneously satisfying energy saving and image quality improvement.

[Embodiment 2]

In Embodiment 2, by using the toner having the melt viscosity characteristic as shown in FIG. 33, a verification of a relationship among the pressure, the single-color toner image density and the secondary color toner chroma was conducted in the same manner as in Embodiment 1. The softening temperature Ts and the incipient fluidization temperature Tfb of the toner measured by using the follow tester were as follows.

Ts: 65.0° C.

Tfb: 82.3° C.

Further, in this embodiment, the toner had the specific gravity ρ of 1.1 (g/cm$^3$) and the weight-average particle size L of 6.0 (μm). As the recording material, the sheet ("CS814" (81 g/m$^2$) mfd. by Nippon Paper Group Corp.) was used. Further, the toner amount per unit area of the single-color toner was 0.3 (mg/cm$^2$). This toner amount per unit area was set at the value smaller than that necessary to cover the recording material.

Further, the fixing device used in this embodiment employed the fixing device constitution described above and the fixing speed was set at 300 (mm/sec). The surface temperature of the fixing belt was set so as to appropriately provide a control temperature in a range from 150° C. to 170° C. In this embodiment, the number and interval of the projections of the fixing pad as shown in FIG. 6 were variously changed and in each case, the single-color toner density was measured. The projection height and projection width of each projection was set at 0.5 mm.

In this embodiment, compared with Embodiment 1, the surface temperature of the fixing belt is set at a low level. This is because the toner used in this embodiment is fixed at a low temperature side compared with the toner used in Embodiment 1. The fixing at the above set temperature or more can also be performed but in this case, the toner image is placed in a state in which the image defect such as hot offset is liable to occur and therefore the higher fixing temperature is not suitable for image comparison.

<Verification of Pressure and Single-Color Toner Image Density at Toner Softening Temperature>

First, a verification of a relationship between the applied pressure and the single-color toner image density at the toner softening temperature was conducted.

In the above-described methods in Embodiment 1, the pressures P1, P2 and P3 with respect to each pressure distribution were calculated. As the influence of the pressure applied at the toner softening temperature, a relationship among values Q1, A2 and A3 which are calculated as proportions (percentages) of P1, P2 and P3, respectively, to (P1+P2+P3) and the resultant image density is shown in Table 5 below. Incidentally, in Table 5, the image density is evaluated as to whether or not the resultant image is practically of no problem at an appropriately set control temperature.

TABLE 5

| Sample No. | Q1 (%) | Q2 (%) | A3 (%) | Density |
|---|---|---|---|---|
| 1 | 19 | 47 | 34 | x |
| 2 | 19 | 38 | 43 | x |
| 3 | 22 | 52 | 26 | x |
| 4 | 25 | 49 | 27 | x |
| 5 | 25 | 28 | 47 | x |
| 6 | 27 | 30 | 44 | x |
| 7 | 29 | 50 | 21 | x |
| 8 | 29 | 35 | 36 | x |
| 9 | 30 | 45 | 25 | x |
| 10 | 31 | 40 | 29 | ○ |
| 11 | 32 | 39 | 30 | ○ |
| 12 | 35 | 40 | 27 | ○ |
| 13 | 33 | 41 | 26 | Δ |
| 14 | 33 | 55 | 12 | Δ |
| 15 | 35 | 38 | 28 | ○ |
| 16 | 35 | 31 | 34 | x |
| 17 | 35 | 45 | 20 | Δ |
| 18 | 35 | 39 | 26 | ○ |
| 19 | 36 | 38 | 26 | Δ |
| 20 | 37 | 36 | 27 | ○ |
| 21 | 37 | 26 | 37 | x |
| 22 | 37 | 46 | 17 | Δ |
| 23 | 38 | 29 | 33 | x |
| 24 | 38 | 21 | 41 | x |
| 25 | 39 | 39 | 23 | ○ |
| 26 | 40 | 36 | 24 | ○ |
| 27 | 41 | 31 | 28 | ○ |
| 28 | 45 | 46 | 9 | ○ |

(Density)
x: Practically thin (poor) level
Δ: Practically level of no problem
○: Practically good level Here, when the relationship between Q1 and the image density is noted, it is understood that a result that the image density is at the practically thin level with Q1 of 30% or less irrespective of the values of Q2 and Q3. This is because the pressure sufficient to accelerate the single-color toner spreading cannot be applied at the toner softening temperature as described above and such a see-thru phenomenon that the pressure proportion is increased in the second half side of the nip to place the toner in an excessively melted state and thus the toner at the projections of the recording material surface is melted to expose the background surface of the recording material occurs.

Even when Q1 is larger than 30%, there is also the case where the image density is at the practically thin level. This is because the image density is determined by not only the value of Q1 but also another condition (factor). Therefore, in order to achieve the image density at least at the practically level of no problem, it becomes necessary that the value of Q1 is larger than 30%.

<Verification of Pressure and Secondary Color Toner Chroma at Tone Low Start Temperature>

Next, a verification of a relationship between an applied pressure and a secondary color toner chroma at the toner incipient fluidization temperature was conducted. In this verification, conditions of the toner, the fixing device constitution, the fixing speed and the like are similar to those used during the verification of the pressure and the single-color toner image density at the toner softening temperature.

Under each condition, the pressures P1, P2 and P3 were calculated. As the influence of the pressure applied at the toner softening temperature, a relationship among values Q1, A2 and A3 which are calculated as proportions (percentages) of P1, P2 and P3, respectively, to (P1+P2+P3) and the resultant image chroma is shown in Table 6 below. Incidentally, in Table 6, the image chroma is evaluated as to whether or not the resultant image is practically of no problem at an appropriately set control temperature.

TABLE 6

| Sample No. | Q1 (%) | Q2 (%) | A3 (%) | Chroma |
|---|---|---|---|---|
| 1 | 41 | 16 | 44 | x |
| 2 | 38 | 21 | 41 | x |
| 3 | 37 | 26 | 37 | x |
| 4 | 48 | 26 | 25 | x |
| 5 | 25 | 28 | 47 | x |
| 6 | 45 | 28 | 27 | x |
| 7 | 29 | 29 | 43 | x |
| 8 | 45 | 29 | 26 | x |
| 9 | 38 | 30 | 32 | x |
| 10 | 35 | 31 | 34 | ○ |
| 11 | 29 | 35 | 36 | ○ |
| 12 | 37 | 36 | 27 | ○ |
| 13 | 36 | 38 | 26 | ○ |
| 14 | 35 | 38 | 28 | ○ |
| 15 | 36 | 38 | 26 | Δ |
| 16 | 32 | 39 | 30 | ○ |
| 17 | 35 | 39 | 26 | ○ |
| 18 | 39 | 39 | 23 | ○ |
| 19 | 33 | 40 | 27 | Δ |
| 20 | 33 | 41 | 26 | Δ |
| 21 | 33 | 41 | 26 | ○ |
| 22 | 39 | 44 | 17 | x |
| 23 | 35 | 45 | 20 | x |
| 24 | 37 | 46 | 17 | x |
| 25 | 31 | 46 | 23 | ○ |
| 26 | 44 | 47 | 9 | x |
| 27 | 19 | 47 | 34 | Δ |
| 28 | 22 | 52 | 26 | ○ |
| 29 | 33 | 55 | 12 | x |
| 30 | 48 | 30 | 22 | ○ |

(Chroma)
x: Practically insufficient chroma
Δ: Practically level of no problem
○: Practically good level Here, when the relationship between Q2 and the image chroma is noted, it is understood that a result that the image density is at the practically insufficient chroma level with Q2 of 30% or less irrespective of the values of Q1 and Q3. This is because the pressure sufficient to enhance the secondary color toner overlapping ratio cannot be applied at the toner incipient fluidization temperature as described above and as a result, the color registration is insufficient and thus the chroma becomes a poor vividness.

Even when Q2 is larger than 30%, there is also the case where the image chroma is at the practically insufficient chroma level. This is because the image chroma is determined by not only the value of Q2 but also another condition (factor). Therefore, in order to achieve the image chroma at least at the practically level of no problem, it becomes necessary that the value of Q2 is larger than 30%.

<Verification of Pressure, Single-Color Toner Image Density and Secondary Color Toner Chroma after Tone Low Start Temperature>

Next, a verification of a relationship among an applied pressure when the toner deformation amount is maximum, the single-color toner image density and a secondary color toner chroma after the toner incipient fluidization temperature was conducted. In this verification, conditions of the toner, the fixing device constitution, the fixing speed and the like are similar to those used during the verification of the pressure and the single-color toner image density at the toner softening temperature.

Under each condition, the pressures P1, P2 and P3 were calculated. As the influence of the pressure applied, when the toner deformation amount is maximum, after the toner softening temperature, a relationship among values Q1, A2 and A3 which are calculated as proportions (percentages) of P1, P2 and P3, respectively, to (P1+P2+P3) and the resultant image density and image chroma are shown in Tables 7 and 8, respectively, below.

TABLE 7

| Sample No. | Q1 (%) | Q2 (%) | A3 (%) | Density |
|---|---|---|---|---|
| 1 | 45 | 46 | 9 | ○ |
| 2 | 33 | 55 | 12 | Δ |
| 3 | 37 | 46 | 17 | Δ |
| 4 | 35 | 45 | 20 | Δ |
| 5 | 29 | 50 | 21 | x |
| 6 | 39 | 39 | 23 | ○ |
| 7 | 40 | 36 | 24 | ○ |
| 8 | 36 | 38 | 26 | Δ |
| 9 | 33 | 41 | 26 | Δ |
| 10 | 33 | 41 | 26 | Δ |
| 11 | 35 | 39 | 26 | ○ |
| 12 | 37 | 36 | 27 | ○ |
| 13 | 45 | 28 | 27 | x |
| 14 | 25 | 49 | 27 | x |
| 15 | 33 | 40 | 27 | ○ |
| 16 | 35 | 38 | 28 | ○ |
| 17 | 41 | 31 | 28 | ○ |
| 18 | 32 | 39 | 30 | ○ |
| 19 | 30 | 39 | 31 | x |
| 20 | 38 | 29 | 33 | x |
| 21 | 35 | 31 | 34 | x |
| 22 | 19 | 47 | 34 | x |
| 23 | 29 | 35 | 36 | x |
| 24 | 37 | 26 | 37 | x |
| 25 | 38 | 21 | 41 | x |
| 26 | 19 | 38 | 43 | x |
| 27 | 27 | 30 | 44 | x |
| 28 | 25 | 28 | 47 | x |

(Density)
x: Practically thin (poor) level
Δ: Practically level of no problem
○: Practically good level Here, when the relationship between Q3 and the image density is noted, it is understood that a result that the image density is at the practically thin level with Q1 of 30% or more respective of the values of Q2 and Q3. This is because the toner viscosity is abruptly lowered after the toner incipient fluidization temperature as described above to cause such a see-thru phenomenon that when the high pressure which is more than necessary is applied in the second half side of the nip, the toner is excessively melted and thus the toner at the projections of the recording material surface is melted to expose the background surface of the recording material.

Even when Q3 is smaller than 30%, there is also the case where the image density is at the practically thin level. This is because the image density is determined by not only the value of Q3 but also another condition (factor). Therefore, in order to achieve the image density at least at the practically level of no problem, it becomes necessary that the value of Q1 is smaller than 30%.

TABLE 8

| Sample No. | Q1 (%) | Q2 (%) | A3 (%) | Chroma |
|---|---|---|---|---|
| 1 | 45 | 47 | 8 | x |
| 2 | 45 | 46 | 9 | x |
| 3 | 44 | 47 | 9 | x |
| 4 | 33 | 55 | 12 | x |
| 5 | 38 | 50 | 12 | x |

TABLE 8-continued

| Sample No. | Q1 (%) | Q2 (%) | A3 (%) | Chroma |
|---|---|---|---|---|
| 6 | 38 | 48 | 14 | x |
| 7 | 39 | 44 | 17 | x |
| 8 | 37 | 46 | 17 | x |
| 9 | 35 | 45 | 20 | x |
| 10 | 37 | 42 | 21 | ○ |
| 11 | 33 | 45 | 22 | ○ |
| 12 | 39 | 39 | 23 | ○ |
| 13 | 31 | 46 | 23 | ○ |
| 14 | 40 | 36 | 24 | x |
| 15 | 36 | 38 | 26 | Δ |
| 16 | 33 | 41 | 26 | ○ |
| 17 | 33 | 41 | 26 | Δ |
| 18 | 35 | 39 | 26 | ○ |
| 19 | 37 | 36 | 27 | ○ |
| 20 | 45 | 28 | 27 | x |
| 21 | 25 | 49 | 27 | ○ |
| 22 | 33 | 40 | 27 | Δ |
| 23 | 35 | 38 | 28 | ○ |
| 24 | 32 | 39 | 30 | ○ |
| 25 | 38 | 29 | 33 | x |
| 26 | 35 | 31 | 34 | ○ |
| 27 | 29 | 35 | 36 | ○ |
| 28 | 38 | 21 | 41 | x |
| 29 | 29 | 29 | 43 | x |
| 30 | 19 | 38 | 43 | ○ |

(Chroma)
x: Practically insufficient chroma
Δ: Practically level of no problem
○: Practically good level Here, when the relationship between Q3 and the image chroma is noted, it is understood that a result that the image density is at the practically insufficient chroma level with Q3 of 20% or less irrespective of the values of Q1 and Q2. This is because the toner viscosity is abruptly lowered after the toner incipient fluidization temperature as described above the single-color toner is liable to cause the see-thru phenomenon while when the applied pressure is excessively low, the toner deformation amount is excessively small and thus the secondary color toner overlapping ratio is lowered.

A pressure applied when a toner temperature of the toner image reaches a softening temperature T1 (° C.) is P1 (kgf/cm$^2$). A pressure applied when the toner temperature reaches an incipient fluidization temperature T2 (° C.) is P2 (kgf/cm$^2$). The toner temperature when P(t)/η(t) wherein η(t) is a toner melt viscosity (Pa·s) and P(t) is a pressure (kgf/cm$^2$) applied with the toner melt viscosity η(t) is maximum is T3 (° C.). A pressure applied when the toner temperature reaches T3 (° C.) is P3 (kgf/cm$^2$).

Further, the following relationships 1), 2) and 3) are satisfied:

$$0.3<P1/(P1+P2+P3), \quad 1)$$

$$0.3<P2/(P1+P2+P3), \text{ and} \quad 2)$$

$$0.2<P3/(P1+P2+P3)<0.3. \quad 3)$$

By satisfying these relationships 1), 2) and 3), it becomes possible to simultaneously optimize the single-color toner spread ratio and the secondary color toner overlapping ratio. Further, in both of the case where the toner image is formed on the recording material in the single layer and the case where the toner image is formed on the recording material in the multiple layers, a good fixing state can be obtained and thus it is possible to simultaneously satisfying energy saving and image quality improvement.

Further, a verification that the above relationships are irrespective of the toner used was conducted. A necessary temperature at the fixing portion varies depending on the toner used. In order to obtain the fixing state in a proper range, the temperature is required to be se in the range satisfying the above relationships.

[Embodiment 3]

In Embodiment 3, a degree of pressure drop in the pressure distribution in the fixing nip and an image property will be described.

<Influence of Pressure Drop>

In the fixing nip, the toner temperature is gradually increased and reaches the highest temperature at the outlet portion of the fixing nip. With respect to the toner temperature, by applying a proper pressure at each portion, a good fixing image can be obtained.

However, when there a portion where the pressure is largely dropped in the fixing nip, the proper toner melting state is impaired and thus the image property is disturbed. Although also described in <Verification of toner characteristic and toner melting state> in Embodiment 1, e.g., as shown in the graphs of FIGS. 19 and 22, in the case where the high pressure state and the low pressure state are compared, the single-color toner spread ratio (amount) and the secondary color toner overlapping ratio are larger in the high pressure state.

This is because when the pressure is P and the toner viscosity is $\eta$, the toner deformation amount is represented by $P/\eta$, in the case where there is the portion where the pressure is largely dropped in the fixing nip, at the pressure-dropped portion, the pressure is once lowered from the high level to the low level and then is applied again. Particularly, before (below) the incipient fluidization temperature where the toner viscosity is not so low, the acceleration of the toner melting is largely depend on the pressure. When the pressure is largely dropped at this portion, the proper toner melting state is largely impaired.

In Embodiment 3, the degree of this pressure drop is taken as P4 and the verification of the relationship between P4 and the image property was conducted.

<Verification of Pressure Drop Degree and Image Property>

A pressure applied when a toner temperature of the toner image reaches a softening temperature T1 (° C.) is P1 (kgf/cm$^2$). A pressure applied when the toner temperature reaches an incipient fluidization temperature T2 (° C.) is P2 (kgf/cm$^2$). The toner temperature when $P(t)/\eta(t)$ wherein $\eta(t)$ is a toner melt viscosity (Pa·s) and P(t) is a pressure (kgf/cm$^2$) applied with the toner melt viscosity $\eta(t)$ is maximum is T3 (° C.). A pressure applied when the toner temperature reaches T3 (° C.) is P3 (kgf/cm$^2$). A minimum pressure between P1 and P2 is P4 (kgf/cm$^2$).

For example, the case where when the fixing step is performed by using the toner having the melt viscosity characteristic as shown in FIG. 7 and by using the fixing device constitution providing the pressure distribution as shown in (a) of FIG. 34, the toner temperature in the fixing nip is changed as shown in (b) of FIG. 34 will be described. Incidentally, the calculating methods of P1, P2 and P3 are the same as those described in Embodiment 1.

The pressures P1 and P2 at positions corresponding to the softening temperature and incipient fluidization temperature of the toner used are calculated as shown in (a) and (b) of FIG. 34. In this case, a minimum pressure between P1 and P2 is calculated to obtain P4.

<Verification of Pressure Drop Degree and Image Property>

In this embodiment, by using the toners having the melt viscosity characteristics shown in FIGS. 7 and 33, the verification of the degree of the pressure drop and the image property was conducted. These toners are the same as those in Embodiments 1 and 2. Further, the softening temperature, incipient fluidization temperature, specific gravity and weight-average particle size of each toner are also the same as those in Embodiments 1 and 2. The image property is a performance from the viewpoints of both of the single-color toner image density and the secondary color toner chroma.

As the recording material in this embodiment, the sheet ("CS814" (81 g/m$^2$) mfd. by Nippon Paper Group Corp.) was used. Further, the toner amount per unit area of the single-color toner was 0.3 (mg/cm$^2$). This toner amount per unit area was set at the value smaller than that necessary to cover the recording material.

Further, the fixing device used in this embodiment employed the fixing device constitution described above and the fixing speed was set at 300 (mm/sec). The surface temperature of the fixing belt was set so as to appropriately provide a control temperature in a range from 150° C. to 190° C. In this embodiment, the number and interval of the projections of the fixing pad as shown in FIG. 6 were variously changed and in each case, the single-color toner density was measured. The projection height and projection width of each projection was set at 0.5 mm.

The pressures P1, P2, P3 and P4 with respect to each pressure distribution were calculated. A relationship among values Q1, Q2, Q3 and Q4 which are calculated as proportions (percentages) of P1, P2, P3 and P4 (the minimum pressure between P1 and P2), respectively, to (P1+P2+P3) and the resultant image property is shown in Table 9 below.

TABLE 9

| Sample No. | Q1 (%) | Q2 (%) | A3 (%) | A4 (%) | Image |
|---|---|---|---|---|---|
| 1 | 17 | 48 | 35 | 18 | x |
| 2 | 19 | 47 | 34 | 19 | x |
| 3 | 38 | 38 | 24 | 19 | Δ |
| 4 | 20 | 48 | 32 | 20 | x |
| 5 | 38 | 21 | 41 | 21 | x |
| 6 | 20 | 41 | 38 | 21 | x |
| 7 | 36 | 35 | 28 | 22 | Δ |
| 8 | 28 | 52 | 20 | 23 | x |
| 9 | 45 | 32 | 24 | 25 | Δ |
| 10 | 40 | 31 | 25 | 26 | x |
| 11 | 32 | 41 | 27 | 27 | Δ |
| 12 | 42 | 33 | 26 | 28 | Δ |
| 13 | 35 | 33 | 32 | 29 | x |
| 14 | 28 | 42 | 30 | 29 | x |
| 15 | 34 | 42 | 24 | 30 | Δ |
| 16 | 35 | 40 | 25 | 31 | ○ |
| 17 | 36 | 41 | 23 | 32 | ○ |
| 18 | 33 | 40 | 27 | 32 | ○ |
| 19 | 37 | 36 | 27 | 34 | ○ |
| 20 | 38 | 41 | 21 | 34 | ○ |
| 21 | 35 | 38 | 28 | 35 | ○ |
| 22 | 36 | 40 | 23 | 35 | ○ |
| 23 | 35 | 39 | 26 | 35 | ○ |
| 24 | 39 | 39 | 23 | 39 | ○ |
| 25 | 35 | 37 | 28 | 40 | ○ |
| 26 | 38 | 41 | 21 | 43 | ○ |

x: Practically problematic level of density or chroma

Δ: Practical level of no problem of density and chroma but the level is not a good level ○: Practically good level of density and chroma Here, the relationship between Q4 and the image property is noted. When Q4 is 30% or less, it is understood that the image property is, irrespective of the values of Q1, A2 and A3, at the practically problematic level of density or chroma or at the practical level of no problem but the level is not a good level. This is because, as described above, when the pressure drop occurs in the fixing nip, the proper toner melting state is impaired.

On the other hand, in the case where Q1 and Q2 are larger than 30%, Q3 is larger than 20% and smaller than 30%, and Q4 is larger than 30%, as a result, the practically good level of density and chroma is obtained.

A pressure applied when a toner temperature of the toner image reaches a softening temperature T1 (° C.) is P1 (kgf/cm$^2$). A pressure applied when the toner temperature reaches an incipient fluidization temperature T2 (° C.) is P2 (kgf/cm$^2$). The toner temperature when P(t)/η(t) wherein η(t) is a toner melt viscosity (Pa·s) and P(t) is a pressure (kgf/cm$^2$) applied with the toner melt viscosity η(t) is maximum is T3 (° C.). A pressure applied when the toner temperature reaches T3 (° C.) is P3 (kgf/cm$^2$). A minimum pressure between P1 (kgf/cm$^2$) and P2 (kgf/cm$^2$) is P4 (kgf/cm$^2$).

Further, the following relationships 1), 2), 3) and 4) are satisfied:

$$0.3<P1/(P1+P2+P3), \quad 1)$$

$$0.3<P2/(P1+P2+P3), \quad 2)$$

$$0.2<P3/(P1+P2+P3)<0.3, \text{ and} \quad 3)$$

$$0.3<P4/(P1+P2+P3). \quad 4)$$

By satisfying these relationships 1), 2), 3) and 4), it becomes possible to simultaneously more optimize the single-color toner spread ratio and the secondary color toner overlapping ratio. Further, in both of the case where the toner image is formed on the recording material in the single layer and the case where the toner image is formed on the recording material in the multiple layers, a very good fixing state can be obtained and thus it is possible to simultaneously satisfying energy saving and image quality improvement.

[Other Embodiment]

(1) In the above-described embodiments, the plurality of projections are provided but even when a constitution in which the pressure distribution in the fixing nip can be provided by a method other than the method providing the projections is employed, by providing the pressure distribution in the present invention, the same effect as that in the present invention can be obtained.

(2) The heating method of the belt 34 is not limited to the electromagnetic induction heating method in the embodiments described above. It is also possible to employ a constitution in which the belt is heated by bringing a heater into contact with the inner surface or outer surface of the belt 34. A constitution in which the belt 34 is heated a non-contact manner by using an infrared lamp.

(3) The belt 34 may also have a device constitution in which the belt 34 is extended and stretched around a plurality of stretching members and is rotationally driven by the driving stretching member.

(4) The opposite member 32 is not limited to the roller. It is also possible to employ a constitution in which a flexible and rotatable endless belt including a back-up member at its inside is used. Further, the opposite member 32 can also be a non-rotational (fixed) pad member.

(5) The image forming apparatus is not limited to the apparatus using the transfer type electrophotographic process in the above-described embodiments. The image forming apparatus may also be a monochromatic image forming apparatus and multi-color image forming apparatus which use an electrostatic recording process, a magnetic recording process and the like of the transfer type or a direct type.

As described hereinabove, according to the present invention, in both of the case where the toner image is formed on the recording material in the single layer and the case where the toner image is formed on the recording material in the multiple layers, a good fixing state can be obtained and it is also possible to simultaneously satisfy energy saving and high-quality image. That is, irrespective of the image formation state, such as the single layer state or the multiple layer state, of the unfixed toner image on the recording material, the image defect such that the fixed toner is excessively melted on the recording material to cause the lowering in image density and at the same time, the secondary color toner and the multi-order color toner can maintain high chroma to provide a good toner melting state.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 231076/2010 filed Oct. 14, 2010, which is hereby incorporated by reference.

What is claimed is:

1. A fixing device comprising:

a belt for heating a toner image on a recording material;

a back-up member slidable on an inner surface of said belt;

a pressing member for pressing said belt against said back-up member to form a nip in which the recording material is to be nip-conveyed; and a projection-recess portion, provided on a nip-forming surface of said back-up member, including a projection and a recess with respect to a recording material conveyance direction in the nip, wherein when a pressure applied when a toner temperature of the toner image reaches a softening temperature T1 (° C.) is P1 (kgf/cm$^2$), a pressure applied when the toner temperature reaches an incipient fluidization temperature T2 (° C.) is P2 (kgf/cm$^2$), the toner temperature when P(t)/η(t) wherein η(t) is a toner melt viscosity (Pa·s) and P(t) is a pressure (kgf/cm$^2$) applied with the toner melt viscosity η(t) is maximum is T3 (° C.), and a pressure applied when the toner temperature reaches T3 (° C.) is P3 (kgf/cm$^2$), the following relationships 1), 2) and 3) are satisfied:

$$0.3<P1/(P1+P2+P3), \quad 1)$$

$$0.3<P2/(P1+P2+P3), \text{ and} \quad 2)$$

$$0.2<P3/(P1+P2+P3)<0.3. \quad 3)$$

2. A device according to claim 1, wherein when a minimum of the pressure between P1 (kgf/cm$^2$) and P2 (kgf/cm$^2$) is P4 (kgf/cm$^2$), the following relationship 4) is satisfied:

$$0.3<P4/(P1+P2+P3). \quad 4)$$

3. A device according to claim 1, wherein when the toner image is a superposed image of a plurality of color toner images, when a specific gravity of the toner is ρ (g/cm$^3$), a weight-average particle size of the toner is L (μm), a unit length of the recording material surface is T0 (mm), a surface length per the verification length of the recording material surface is T1 (mm), a toner amount per unit area on the recording material when the unit length of the recording material surface is T0 is A0 (mg/cm$^2$) and a toner amount per unit area on the recording material when the unit length of the recording material surface is T1 is A1 (mg/cm$^2$), the following relationships are satisfied:

$$A0<(\rho\pi L)/30\sqrt{3},$$

$$A1=T1\times A0/T0, \text{ and}$$

$$A1<(T0/T1)\times(\rho\pi L)/30\sqrt{3}.$$

* * * * *